US007841706B2

(12) United States Patent
Ishinaga et al.

(10) Patent No.: US 7,841,706 B2
(45) Date of Patent: Nov. 30, 2010

(54) INK SUPPLY APPARATUS AND METHOD FOR CONTROLLING THE INK PRESSURE IN A PRINT HEAD

(75) Inventors: Hiroyuki Ishinaga, Tokyo (JP); Yoichi Sonobe, Matsudo (JP); Kazuo Haida, Yokohama (JP); Yuichi Takahashi, Tokyo (JP)

(73) Assignee: Canon Finetech, Inc., Ibaraki (JP)

( * ) Notice: Subject to any disclaimer, the term of this patent is extended or adjusted under 35 U.S.C. 154(b) by 363 days.

(21) Appl. No.: 11/597,200

(22) PCT Filed: Jun. 1, 2005

(86) PCT No.: PCT/JP2005/010058

§ 371 (c)(1),
(2), (4) Date: Nov. 21, 2006

(87) PCT Pub. No.: WO2005/118300

PCT Pub. Date: Dec. 15, 2005

(65) Prior Publication Data

US 2008/0273046 A1 Nov. 6, 2008

(30) Foreign Application Priority Data

Jun. 1, 2004 (JP) ..... 2004-163730
Jun. 1, 2004 (JP) ..... 2004-163731

(51) Int. Cl.
*B41J 2/17* (2006.01)
*B41J 2/175* (2006.01)
*B41J 2/18* (2006.01)

(52) U.S. Cl. ..... 347/84; 347/85; 347/89

(58) Field of Classification Search ..... 347/84
See application file for complete search history.

(56) References Cited

U.S. PATENT DOCUMENTS

| | | | | |
|---|---|---|---|---|
| 4,680,696 | A * | 7/1987 | Ebinuma et al. | 347/85 |
| 5,446,486 | A * | 8/1995 | Reis | 347/84 |
| 5,646,666 | A * | 7/1997 | Cowger et al. | 347/87 |
| 5,880,748 | A * | 3/1999 | Childers et al. | 347/85 |
| 5,992,990 | A * | 11/1999 | Childers et al. | 347/87 |
| 6,203,759 | B1 * | 3/2001 | Pelc et al. | 422/100 |
| 6,428,156 | B1 * | 8/2002 | Waller et al. | 347/89 |
| 6,460,984 | B1 | 10/2002 | Matsumoto et al. | 347/86 |
| 6,474,796 | B1 | 11/2002 | Ishinaga | 347/85 |
| 6,705,711 | B1 * | 3/2004 | Richards | 347/85 |
| 6,773,099 | B2 | 8/2004 | Inoue et al. | 347/86 |
| 6,840,605 | B2 * | 1/2005 | Hauck | 347/86 |
| 6,969,161 | B2 | 11/2005 | Kuwabara et al. | 347/85 |

(Continued)

FOREIGN PATENT DOCUMENTS

EP 0339770 A2 * 11/1989

(Continued)

*Primary Examiner*—Matthew Luu
*Assistant Examiner*—Shelby Fidler
(74) *Attorney, Agent, or Firm*—Fitzpatrick, Cella, Harper & Scinto

(57) ABSTRACT

Variations in the negative pressure in the print head is minimized by positively controlling the ink supply pressure. For this purpose, the pump (36) and the valve (35) are installed in the ink communication path between the ink tank (40) and the print head (811), and are controlled to adjust the negative pressure applied to the print head (811).

20 Claims, 39 Drawing Sheets

U.S. PATENT DOCUMENTS

| | | | | |
|---|---|---|---|---|
| 7,004,575 | B2 | 2/2006 | Inoue et al. | 347/86 |
| 2002/0097284 | A1* | 7/2002 | Vosahlo | 347/7 |
| 2003/0211620 | A1* | 11/2003 | LaBudde et al. | 436/50 |
| 2005/0116999 | A1* | 6/2005 | Ando et al. | 347/85 |
| 2006/0017787 | A1 | 1/2006 | Inoue et al. | 347/85 |
| 2007/0171263 | A1 | 7/2007 | Inoue et al. | 347/74 |

FOREIGN PATENT DOCUMENTS

| | | |
|---|---|---|
| JP | 5-261934 | 10/1993 |
| JP | 6-183018 | 7/1994 |
| JP | 7-68776 | 3/1995 |
| JP | 9-193414 | 7/1997 |
| JP | 2000-25266 | 2/2000 |
| JP | 2000-52566 | 2/2000 |
| JP | 2001-315350 | 11/2001 |
| JP | 2002-355990 | 12/2002 |

* cited by examiner

INK SUPPLY APPARATUS AND METHOD FOR CONTROLLING THE INK PRESSURE IN A PRINT HEAD

TECHNICAL FIELD

The present invention relates to an ink supply device and an ink supply method to supply ink applied with a negative pressure to a print head, and a printing apparatus and a printing method to print an image by using the print head.

BACKGROUND ART

An ink jet printing apparatus that forms an image by ejecting ink from a print head onto a print medium can form a high-resolution image using a small print head having a plurality of nozzles arrayed at high density. The ink jet printing apparatus can also realize a color printing with a relatively inexpensive, compact construction that comprises a plurality of print heads and supplies a plurality of different color inks to the respective print heads. Therefore the ink jet printing apparatus is currently used in a variety of image output devices, such as printers, facsimiles and copying machines, whether for business use or for home use.

In such an ink jet printing apparatus, it is important to maintain the ink in the print head at a constant negative pressure to stabilize the ink ejection operation of the print head. For this purpose, it is common practice to provide a negative pressure generation means in an ink supply system and supply the ink given a negative pressure by the negative pressure generation means to the print head.

One of such conventional negative pressure generation means utilizes a capillary attraction of a sponge-like ink absorber installed in an ink tank to generate a negative pressure (for example, Patent Document 1).

Another example has at least a part of the ink tank formed of a flexible member and biases the flexible member outwardly of the ink tank by a bias means such as spring in order to keep an interior of the ink tank at a negative pressure (for example, Patent Document 2).

Still another example has an ink tank disposed at a position lower than the print head and utilizes a water head difference to apply a negative pressure to the ink (for example, Patent Document 3).

The ink applied with a constant negative pressure by the negative pressure generation means is supplied to the print head, as if it is drawn into the print head, by a pressure difference between its negative pressure and a negative pressure in the print head that increases as the ink ejection proceeds. The interior of the print head is therefore maintained at a constant negative pressure.

Patent Document 1: Japanese Patent Application Laid-open No. 07-068776

Patent Document 2: Japanese Patent Application Laid-open No. 2001-315350

Patent Document 3: Japanese Patent Application Laid-open No. 06-183018

DISCLOSURE OF THE INVENTION

The ink supply system having the above negative pressure generation means uses the pressure difference caused by the negative pressure in the print head that rises as the ink ejection proceeds, to draw the ink from the ink tank into the print head.

However, when an ink consumption per unit time by the print head increases sharply, there is a possibility that an ink supply may not be able to meet the demand, leaving the negative pressure in the print head to rise. If on the other hand the ink consumption per unit time falls sharply, the negative pressure in the print head may decrease by inertia of ink. Variations in the negative pressure in the print head will likely destabilize the ink ejection operation of the print head, degrading the quality of a printed image. Particularly, in an industrial printing apparatus that prints an image at high speed on a large-size print medium, an instantaneous ink consumption varies by a large margin, so the negative pressure in the print head easily changes. It is therefore important to minimize negative pressure variations in the print head in order to meet the demand for high print quality.

The object of this invention is to provide an ink supply device, a printing apparatus, an ink supply method and a printing method that can minimize negative pressure variations in the print head by positively controlling an ink supply pressure.

The ink supply device of this invention is installed in an ink path communicating the ink tank with the print head and comprises a negative pressure application means to apply to the print head a negative pressure that is adjustable and a control means to control the negative pressure application means to adjust the negative pressure applied to the print head.

The printing apparatus of this invention is capable of printing an image using a print head supplied with ink and includes the ink supply device to supply ink to the print head.

The ink supply method of this invention for supplying ink from an ink tank to the print head uses a negative pressure application means installed in an ink path communicating the ink tank with the print head to apply an adjustable negative pressure to the print head and controls the negative pressure application means in such a way as to keep the negative pressure applied to the print head in a predetermined range during a printing operation using the print head.

The printing method of this invention for printing an image using a print head supplied with ink from an ink tank uses a negative pressure application means installed in an ink path communicating the ink tank with the print head to apply an adjustable negative pressure to the print head and controls the negative pressure application means in such a way as to keep the negative pressure applied to the print head in a predetermined range during a printing operation using the print head.

With this invention, the negative pressure variations in the print head can be minimized by positively controlling the negative pressure applied to the print head, which in turn can stabilize the printing operation using the print head and form an image of high quality.

BEST MODE FOR CARRYING OUT THE INVENTION

Now, embodiments of this invention will be described by referring to the accompanying drawings.

First Embodiment

Figure 1:
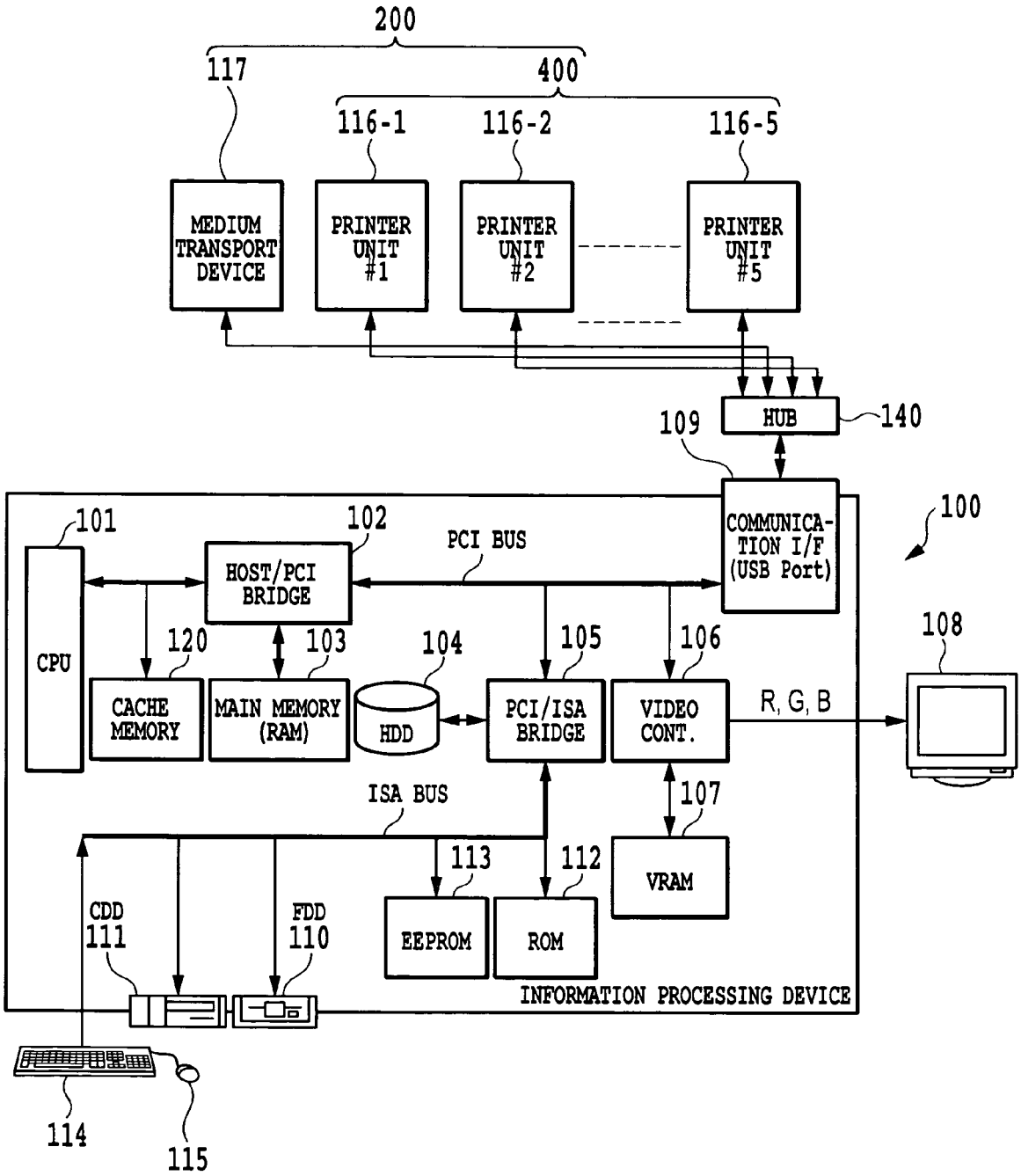
FIG. 1 is a block diagram showing an outline of an image forming system with printing apparatus in a first embodiment of the invention.
Figure 2:
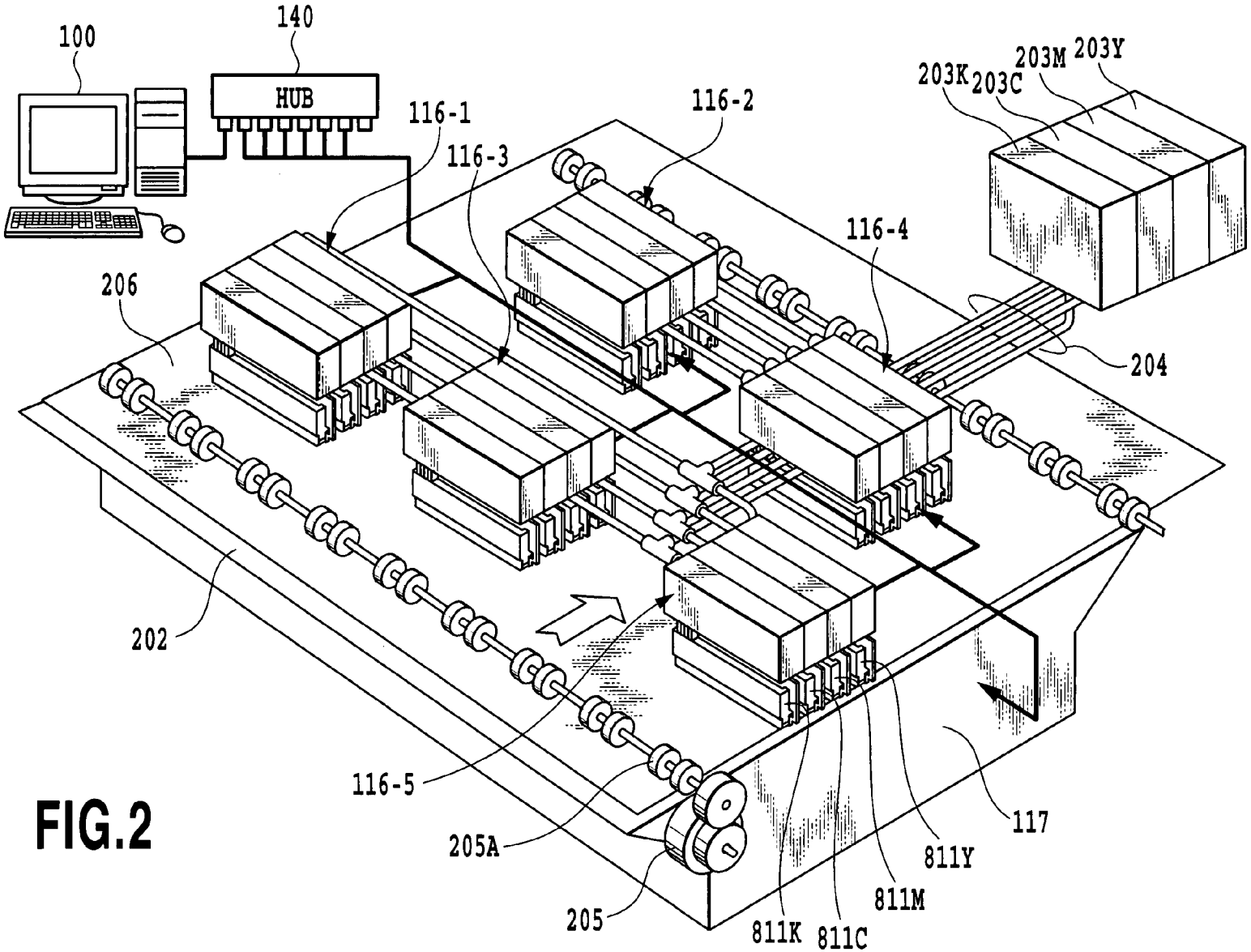
FIG. 2 is a schematic perspective view showing an outline construction of the image forming system of FIG. 1.

This embodiment represents a case in which a printing apparatus is incorporated in an image forming system such as shown in FIG. 1 and FIG. 2.

(Overview of Image Forming System)

FIG. 1 and FIG. 2 are a block diagram and a schematic perspective view, respectively, showing an outline configuration of an image forming system. A printer composite system of this example comprises an information processing device 100 and an image forming device 200. The image forming device 200 has a medium transport device 117 and a printer composite system 400. The printer composite system has a plurality of independent engines or printer units (also referred to as "printing apparatus" or "printers") 116-1 to 116-5.

The information processing device 100 is a source of data for an image to be formed, and divides one page of image into a plurality of areas and supplies a plurality of divided pieces of image data corresponding to the divided areas to a plurality of printer units 116-1 to 116-5, respectively. A print medium 206 transported by the medium transport device 117 has a widthwise size that matches an area printable by an array of printer units 116-1 to 116-5. The medium transport device 117 detects an end of the print medium 206 (paper end) and outputs signals that define print start positions for individual printer units 116-1 to 116-5.

The printer composite system 400 has a plurality (in this example, five) of printer units 116-1 to 116-5 arranged to print associated divided areas of a print area on the print medium 206. Each of the printer units independently performs a printing operation on the associated divided print area at a timing defined by the medium transport device 117 according to the divided image data supplied from the information processing device 100. Each printer unit mounts print heads for ejecting three primary color inks, yellow (Y), magenta (M) and cyan (C), and a black (K) ink to form a full color image on the print medium 206. To each of the print heads, the associated color ink is supplied from an ink source, i.e., ink tanks 203Y, 203M, 203C, 203K.

In FIG. 1, CPU 101 is a central processing unit that performs an overall system control on the information processing device 100. In the information processing device 100, the CPU 101 under the control of an operating system (OS) executes processing defined by application programs for generation and editing of image data, processing defined by an image dividing program of this embodiment, processing defined by a print program (printer driver) for a plurality of the printer units 116-1 to 116-5, and processing defined by a control program (described later in connection with FIG. 5) for the medium transport device 117.

The CPU 101 has a hierarchical system bus configuration, in which the CPU is connected to a PCI bus as a local bus through a host/PCI bridge 102 and further connected to an ISA bus through a PCI/ISA bridge 105 for connection with devices on these buses.

A main memory 103 is a RAM (Random Access Memory) which temporarily stores the OS, application programs and control programs and is also used as a work memory area for the execution of programs. These programs are read from, for example, a hard disk drive HDD 104 and loaded into the main memory. The system bus is connected with a cache memory 120, a high-speed memory using a static RAM (SRAM), which stores codes and data that the CPU 101 accesses frequently.

A ROM (Read Only Memory) 112 stores a program (BIOS: Basic Input Output System) that controls input/output devices, such as keyboard 114, mouse 115, CDD 111 and FDD 110, connected through an input/output circuit (not shown), an initialization program that is activated when a system power is turned on, and a self-diagnostic program. An EEPROM (Electrically Erasable Programmable ROM) 113 is a nonvolatile memory to store a variety of permanently used parameters.

A video controller 106 continuously and cyclically reads RGB display data written into a Video RAM (VRAM) 107 and continually transfers them as screen refresh signals to a display 108 such as CRT, LCD and PDP (Plasma Display Panel).

A communication interface 109 with the printer units 116-1 to 116-5 is connected with the PCI bus and may use, for example, bidirectional Centronix interface, USB (Universal Serial Bus) and hub connections, all conforming to IEEE 1284 standard. In FIG. 1, the PCI bus is connected through the communication interface 109 to the hub 140, which in turn is connected to each of the printer units 116-1 to 116-5 and the medium transport device 117. While this embodiment uses the wired type communication interface 109, other types of communication interface such as wireless LAN may be used.

Figure 3:
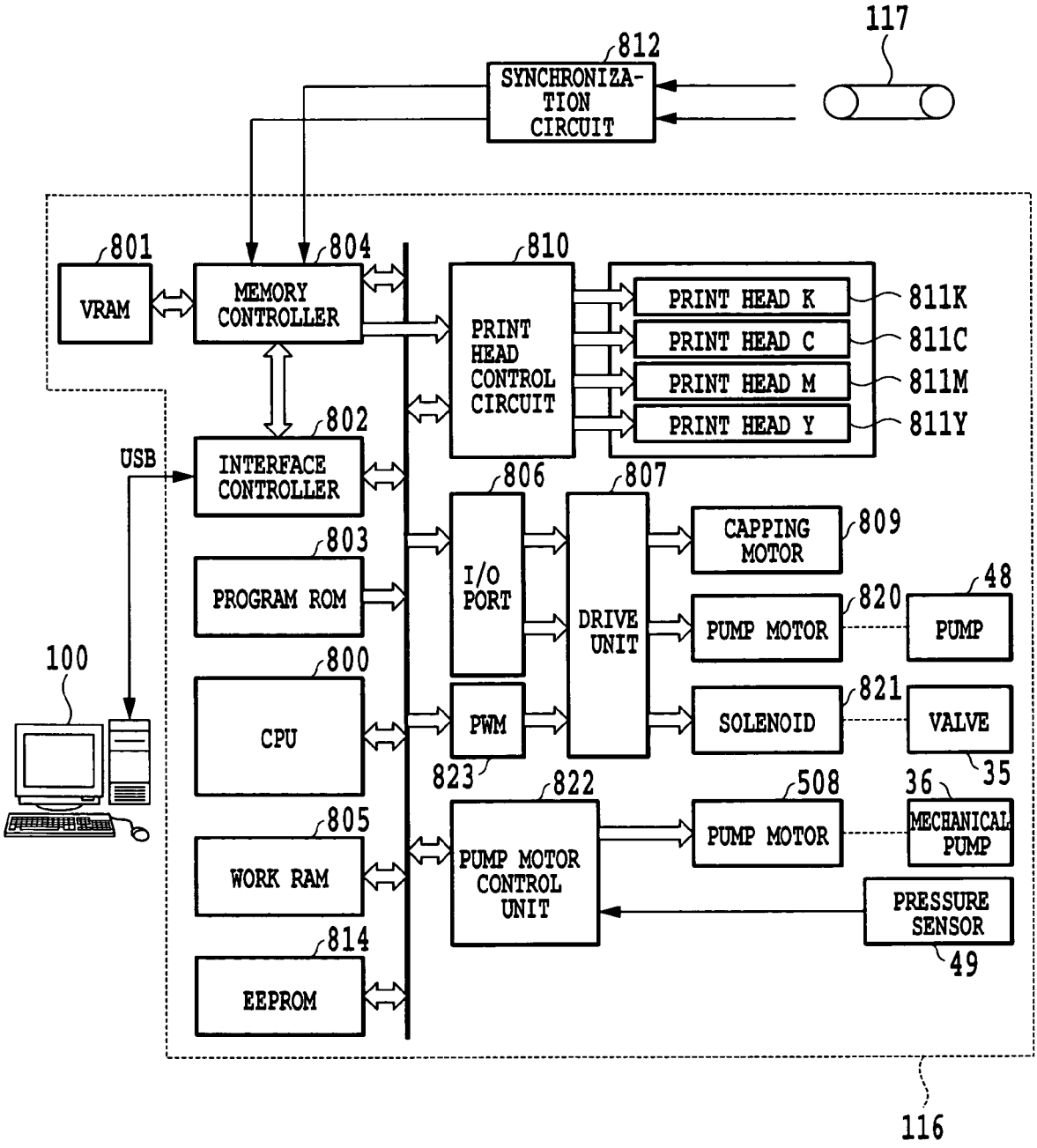
FIG. 3 is a block configuration diagram of a control system for the printing apparatus of FIG. 1.

The print program (printer driver) has a means to set the number of printer units 116-1 to 116-5 connected to the information processing device 100 (corresponding to the number of divisions by which one page of image is divided), a means to assign an area-(divided width) to each of the printer units 116-1 to 116-5 (described later in connection with FIG. 4), and a means to allocate which part of one page to which printer unit (see FIG. 3). Based on the settings made by these setting means, one page of image is divided and the corresponding divided image data are transferred to the individual printer units 116-1 to 116-5 for printing.

As described earlier, the print program generates print data for the printer units 116-1 to 116-5 and transfers them to the associated printer units. Therefore, the print programs themselves, or the print data generation processing and the print data transfer processing in the print program, can be run parallelly (multiprocess, multithread) for fast processing.

Referring to FIG. 2 again, the information processing device 100 is connected to the printer units 116-1 to 116-5 and the medium transport device 117 through the hub 140 for transfer of print data, operation start/end commands and others. Connections are also made between each of the printer units 116-1 to 116-5 (hereinafter referred to by a reference number 116 unless otherwise specifically stated) and the medium transport device 117 for transfer of a detection signal representing the front end of print medium 206, a signal for setting the print start position and a signal for synchronizing the medium transport speed and the printing (ink ejection) operation of each printer unit.

For continuous full color printing on the print medium 206, each of the printer units 116 mounts four print heads 811Y, 811M, 811C and 811K (hereinafter referred to by a reference number 811 unless otherwise specifically noted) that eject yellow (Y), magenta (M), cyan (C) and black (K) inks respectively. The order of arrangement of the color ink print heads in the transport direction of the print medium 206 is the same among the printer units and thus the order of color overlapping is also the same. Ink ejection nozzles in each print head are arrayed at a density of 600 dpi (dots/inch (for reference)) in the width direction of the print medium (a direction perpendicular to the medium transport direction) over four inches (about 100 mm (for reference)). The printer units 116-1 to 116-5 in combination can therefore cover the maximum print width of about 500 mm.

The print heads 811Y, 811M, 811C and 811K in each printer unit 116 are supplied their associated color inks through dedicated tubes 204 from the ink source, i.e., ink tanks 203Y, 203M, 203C and 203K.

(Control System for Printer Units)

FIG. 3 shows an example configuration of a control system in each printer unit 116.

In the figure, 800 represents a CPU that performs an overall control on the printer unit 116 according to a program defining a sequence of processing described later with reference to FIG. 5. Denoted 803 is a ROM that stores the program and fixed data; 805 a RAM used as a work memory area; and 814 an EEPROM that holds parameters used by the CPU 800 for control even when the power supply to the printer unit is turned off.

Designated 802 is an interface controller for connecting the printer unit 116 to the information processing device 100 through USB cable. Denoted 801 is a VRAM to expand image data of each color. A memory controller 804 transfers image data received through the interface controller 802 to the VRAM 801 and also controls an operation of reading image data as the printing operation proceeds. When divided print data is received by the interface controller 802 from the information processing device 100 through USB cable, the CPU 800 analyzes a command attached to the print data and issues an instruction to rasterize image data of each color component into a bit map in the VRAM 801. Upon receipt of this instruction, the memory controller 804 writes the image data from the interface controller 802 into the VRAM 801 at high speed.

Denoted 810 is a control circuit to control the print heads 811Y, 811M, 811C, 811K. Denoted 809 is a capping motor that operates a capping mechanism (not shown) to cap the surface of the print heads 811 in which nozzles are formed. The capping motor 809 is driven through an input/output port 806 and a drive unit 807.

A pump motor 820 is a reversible motor that operates a pump 48 inserted between subtanks 40 described later (see FIG. 9) and the print heads 811. A solenoid 821 is an actuator to operate a valve 35 and can be controlled by a PWM (Pulse Width Modulation) value set in a PWM circuit 823 by the CPU 800 so as to secure a linear open-close state of the valve 35.

A pump motor 508 is a-servo motor that controls a mechanical pump 36 by feeding back an output of a pressure sensor 49 installed near a path in each print head to a pump motor controller 822. A set of the pump motors 820, 508, solenoid 821 and pressure sensor 49 is provided independently for each of the print heads 811Y, 811M, 811C, 811K of different color inks.

These are characteristic constitutional elements of this invention and will be described later in more detail.

When the printer unit 116 is not in use, the capping motor 809 is driven to move the capping mechanism toward the print heads 811Y, 811M, 811C, 811K for capping. When image data to be printed is mapped in the VRAM 801, the capping motor 809 is driven to move the capping mechanism away from the print heads 811Y, 811M, 811C, 811K for uncapping and the printer unit waits for a print start signal from the medium transport device 117 described later.

Denoted 806 is an input/output (I/O) port which is connected with the motor drive unit 807, other drive means and sensors (not shown) for signal transfer to and from the CPU 800. A synchronization circuit 812 receives from the medium transport device 117 a print medium head detection signal and a position pulse signal representing the movement of the print medium and generates a timing signal to cause the printing operation to be executed, properly synchronized with these signals. That is, in synchronism with the position pulse produced as the print medium is transported, data in the VRAM 801 is read out at high speed by the memory controller 804 and transferred though the print head control circuit 810 to the print heads 811 to execute the color printing.

(Configuration of Transport Device and Control System)

Referring to FIG. 2, the medium transport device 117 so sized as to be suited for transporting a print medium is large in a widthwise direction of the print medium and has an arbitrary dimension in the transport direction. A media stage 202 is provided to ensure that gaps between all print heads 811 of the printer units 116-1 to 116-5 and a print surface of the print medium 206 are equal as much as possible. Print mediums used vary in thickness, so a means may be added for improving the level of intimate contact of the print medium with the media stage 202 so as to keep the gaps between the print surface of even thick paper and the print heads 811 within a predetermined range. The transport motor 205 drives an array of transport rollers 205A to feed the print medium in intimate contact with the upper surface of the media stage 202.

Figure 4:
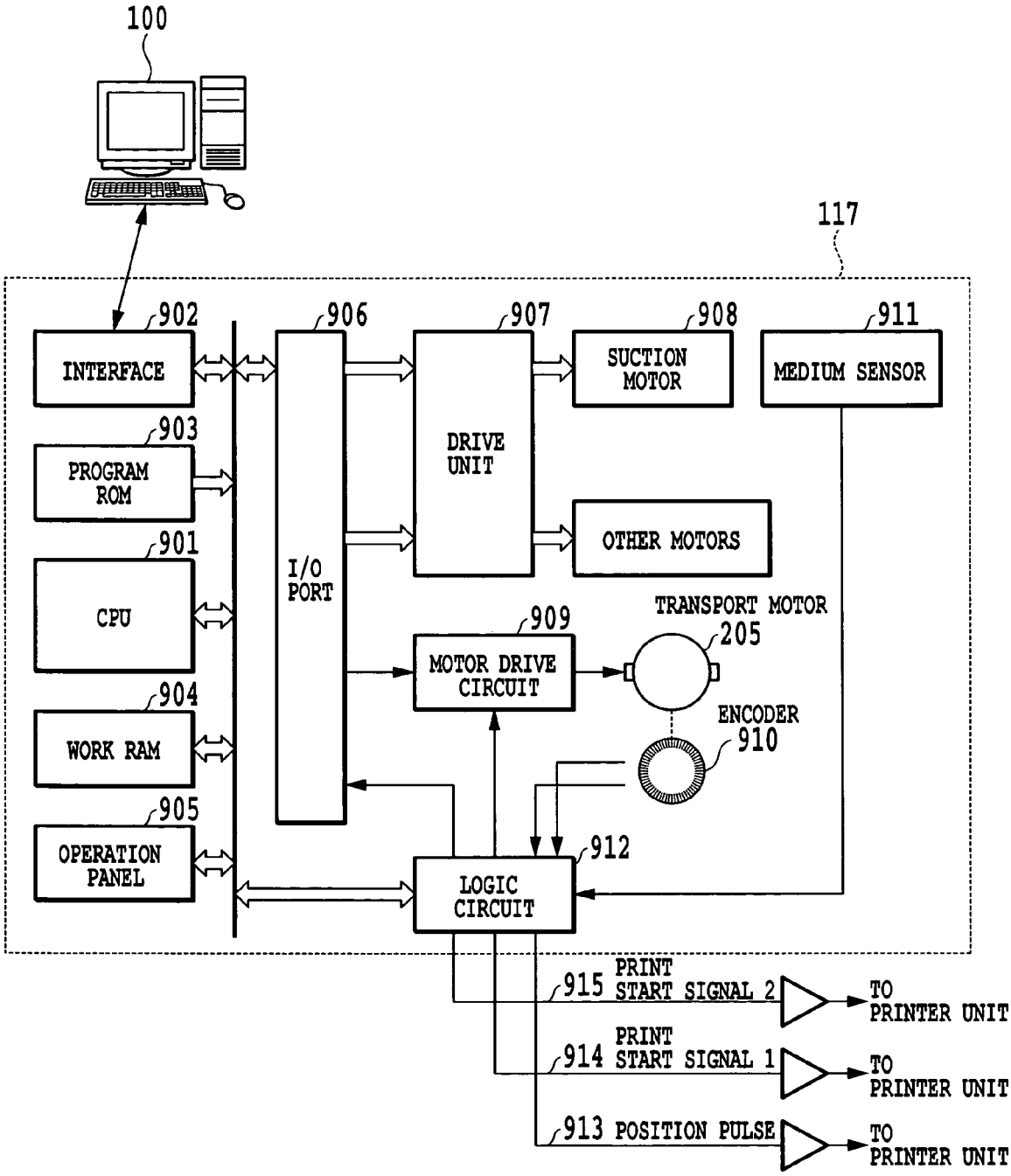
FIG. 4 is a block configuration diagram of a control system for a medium transport device in the image forming system of FIG. 1.

FIG. 4 shows an example configuration of a control system for the medium transport device 117.

In the figure, reference number 901 represents a CPU that performs an overall control on the medium transport device according to a program defining a sequence of processing described later with reference to FIG. 5. Denoted 903 is a ROM storing the program and fixed data; and 904 a RAM used as a work memory area.

Denoted 902 is an interface to connect the medium transport device 117 to the information processing device 100. Designated 905 is an input unit for the user to enter his or her instructions or other inputs to the image forming device and also an operation panel having a display unit for predetermined indications. In this example, this unit is installed on the medium transport device.

Denoted 908 is a suction motor to operate a vacuum pump. The vacuum pump forms one example of means to keep a non-print surface (back) of the print medium in intimate contact with the upper surface of the media stage 202. More specifically, a large number of fine holes are formed in the media stage 202, extending from the bottom of the media stage 202 to its transport surface, and the vacuum pump is operated to keep the print medium in intimate contact with the media stage 202 by a suction applied through the fine holes. When a transport start command is received from the information processing device 100 through the interface 902, the suction motor 908 is started to draw the print medium 206 to the upper surface of the media stage 202 by suction.

Denoted 907 is a drive unit to operate the suction motor 908 and other associated operating units. Denoted 909 is a drive unit for the transport motor 205.

A logic circuit 912 forms a servo system that receives an output from a rotary encoder 910 mounted on the transport motor 205 and performs a feedback control on the transport motor 205 to feed the print medium at a constant speed. The transport speed can be set arbitrarily by a speed value written in the logic circuit 912 by the CPU 901. The rotary encoder 910 may be arranged coaxial with the row of transport rollers 205A, rather than being mounted on the shaft of the transport motor 205.

Also supplied to the logic circuit 912 is an output from a medium sensor 911 that is provided upstream of the print position in the transport direction to detect when the front end of the print medium 206 reaches a point close to the print start position. According to a distance in the transport direction from the position where the front end of the print medium is detected by the medium sensor 911 to each printer unit, the logic circuit 912 outputs an appropriate print instruction signal to each printer unit. In this embodiment, since the printer units 116-1 to 116-5 are arranged in two rows in the transport direction as shown in FIG. 2, i.e., the printer units 116-1, 116-3, 116-5 are arranged in line on the upstream side in the transport direction and printer units 116-2, 116-4 are arranged in line on the downstream side, the logic circuit 912 issues two print command signals 914, 915. Considering errors in the mounting positions of the printer units, corrections may be made of the print start signal 914 or 915 for each printer unit independently according to a physical distance from the medium sensor 911 to each printer unit.

The logic circuit 912 properly transforms the output of the rotary encoder 910 into a print medium position pulse 913. In synchronism with this position pulse 913, each printer unit performs a printing operation. A resolving power of the position pulse may be determined as desired. For example, it may be set equal to a plurality of print lines.

Further, the construction of a print medium transport unit in the medium transport device 117 is not limited to the one shown in FIG. 2 which has the fixed media stage 202. For example, the print medium transport may be accomplished by feeding it on an endless transport belt, which is wound around a pair of drums installed upstream and downstream of the print position in the transport direction and which is driven by the rotating drums. The transport unit of these constructions can feed print mediums of both cut paper type and continuous sheet type.

(Outline of Operation of Image Forming System)

Figure 5:
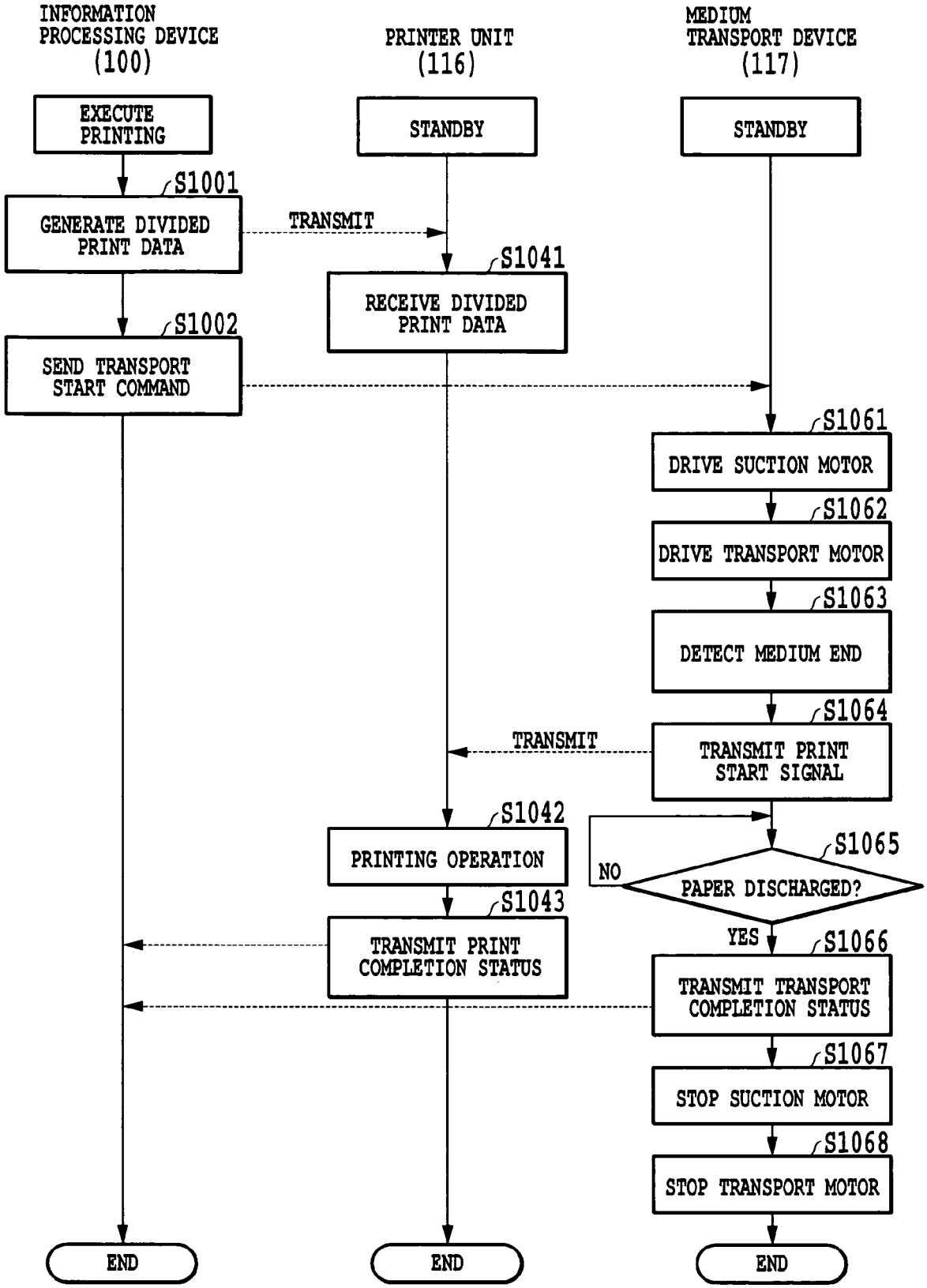
FIG. 5 is a flow chart showing an operation sequence among an information processing device, the printing apparatus and the medium transport device in the image forming system of FIG. 1.

FIG. 5 shows a sequence of operations among the information processing device 100, the printer units 116 of the printer composite system 400, and the medium transport device 117.

For execution of a printing operation, the information processing device 100 generates divided print data and sends them to the associated printer units (step S1001). According to the data received, each of the printer units 116 uncaps the print heads 811 and performs data mapping on the VRAM 801 (step S1041). When all printer units 116-1 to 116-5 have completed the reception of data, the information processing device 100 sends a transport start command to the medium transport device 117 (step S1002).

The medium transport device 117 first drives the suction motor 908 (step S1061) in preparation for drawing the print medium 206 to the media stage 202 by suction. Next, the medium transport device 117 drives the transport motor 205 to start feeding the print medium 206 (step S1062). When it detects the front end of the medium (step S1063), the medium transport device 117 sends the print start signals 914, 915 and the position pulse 913 to the printer units 116-1 to 116-5 (step S1064). As described earlier, the print start signal is issued according to the distance from the medium sensor 911 to each printer unit.

When the printing operation by the printer units 116 (step S1042) is finished, they send a print completion status to the information processing device 100 (step S1043) and end the processing. At this time, each printer unit caps its print heads 811 with a capping mechanism not shown to prevent possible drying and clogging of the nozzles (ink ejection openings).

With the printing operation complete and the print medium 206 discharged from the media stage 202 (step S1065—Yes), the medium transport device 117 sends a transport completion status to the information processing device 100 (step S1066). Next, the medium transport device 117 stops the suction motor 908 and the transport motor 205 (step S1067, S1068) and ends its operation.

(Signal System for Printer Composite System)

Figure 6:
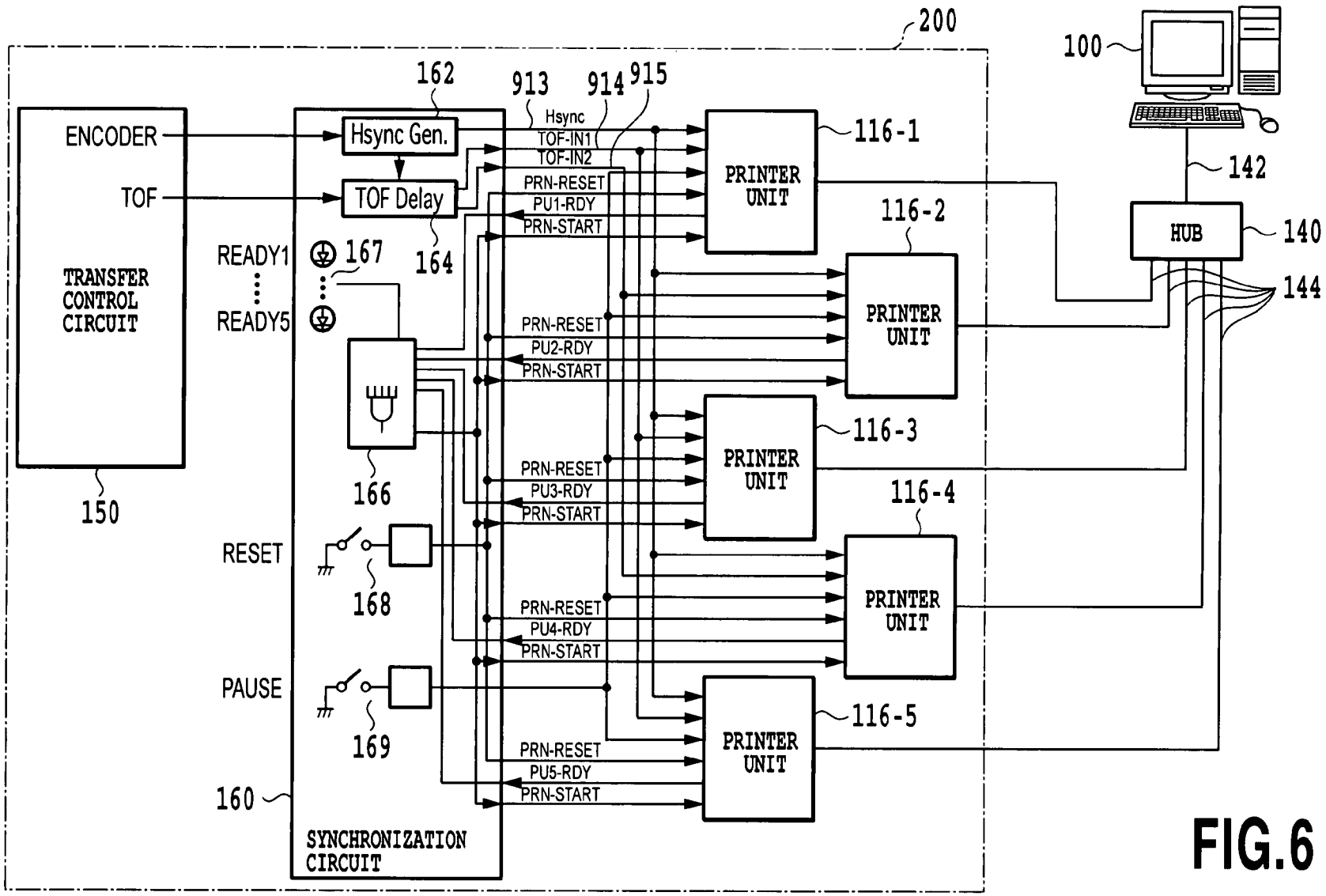
FIG. 6 is a block configuration diagram of a control system for a plurality of printing apparatus of FIG. 1.

FIG. 6 shows an example of signal system for the printer units 116-1 to 116-5 making up the printer composite system. The signal system connected to each of the printer units 116-1 to 116-5 is largely divided in two systems. One is involved in transmitting the divided print data (including the operation start and end commands) supplied from the information processing device 100 and the other is involved in transmitting a print timing defining signal (including the print start signal and position pulse) supplied from the medium transport device 117.

In the example shown in FIG. 6, the divided print data transmission system has a hub 140 that relays data between the information processing device 100 and the printer units 116-1 to 116-5. The hub 140 is connected to the information processing device 100 through, for example, a 100BASE-T standard connector/cable 142 and to each of the printer units 116-1 to 116-5 through, for example, a 10BASE-T standard connector/cable 144.

The print timing defining signal transmission system has, in the example of FIG. 6, a transfer control circuit 150 and a synchronization circuit 160. These may be provided as circuits making up the logic circuit 912 of FIG. 4. The transfer control circuit 150 supplies to the synchronization circuit 160 an output ENCODER of the rotary encoder 910 mounted on the transport motor 205 and a print medium front end detection output TOF.

The synchronization circuit 160 has a print operation enable circuit 166 which takes a logical AND of the operation ready signals PU1-RDY to PU5-RDY issued from the printer units 116-1 to 116-5 upon receipt of the divided image data to determine if all the printer units are ready for the printing operation (with their print heads uncapped), and which, if so, issues a print operation enable signal PRN-START. The synchronization circuit 160 also has an indication unit 167 such as LED to perform an indication associated with the operation ready signals PU1-RDY to PU5-RDY for the user to check that the printer units are ready to operate. Further, the synchronization circuit 160 also has a reset circuit 168 for the user to manually reset the printer units and a pause circuit 169 to temporarily stop the operation after one sheet of print medium has been printed out.

The synchronization circuit 160 also has a synchronization signal generation circuit 162 and a delay circuit 164. The synchronization signal generation circuit 162 generates from the encoder output ENCODER a position pulse signal 913, a synchronization signal (Hsync) that causes the printer units to perform the printing operation in synchronism with one another (e.g., 300 pulse signals per inch of transport distance of print medium). The resolving power of the position pulse signal 913 is preferably an integer times the print resolution in the print medium transport direction.

The delay circuit 164 produces from the print medium front end detection output TOF the print command signals 914, 915 that are delay signals corresponding to the position of each printer unit in the medium transport direction.

The printing operation of the printer units 116-1, 116-3, 116-5 on the upstream side of the print medium in the transport direction is started upon reception of the print command signal (TOF-IN1) 914. The print command signal (TOF-IN1) 914 is a delay signal that has a delay corresponding to a distance from the medium sensor 911 to the positions of these printer units. If the distance from the medium sensor 911 to these printer units is zero, the print command signal 914 is issued almost simultaneously with the front end detection output TOF.

The printing operation of the printer units 116-2, 116-4 arranged downstream of the print medium in the transport direction, on the other hand, is started upon reception of the print command signal (TOF-IN2) 915. The print command signal (TOF-IN2) 915 is a delay signal that has a delay corresponding to a distance from the medium sensor 911 to the positions of these printer units. In this embodiment the distance from the medium sensor 911 to these printer units is set at 450 mm. Thus, if the position pulse 913 or synchronization signal (Hsync) is 300 pulses per inch (25.4 mm) of print medium transport distance, the print command signal 915 is issued with a delay of 5,315 pulses after the front end detection output TOF.

In order to make fine corrections on the print positions of individual printer units in the medium transport direction or considering a case where the printer units are not arranged in two rows, the print command signal may be supplied independently to each printer unit.

As can be seen from FIG. 6, the printer units 116-1 to 116-5 each receive the divided print data from the information processing device 100 and perform the printing operation independently of each other according to the print timing defining signal supplied from the medium transport device 117. That is, each of the printer units 116-1 to 116-5 is a complete circuit in terms of the signal system such that the print data and print timing are not transmitted from one printer unit to another and that each printer unit has a means (shift register and latch circuit) to arrange the data for the print heads 811Y-811K and for the nozzles arrayed in each print head and eject ink at specified timings. That is, the printer units 116-1 to 116-5 have the same hardware and operate under the same software; the operation of one printer unit does not directly affect the operation of another printer unit; and they cooperate to print one whole image.

(Outline of Ink System)

The printer units 116-1 to 116-5 in this example are independently operable printers and are also independent of each other in the ink system including an ink supply system and a recovery system for the print heads 811 in each printer unit.

Figure 7:
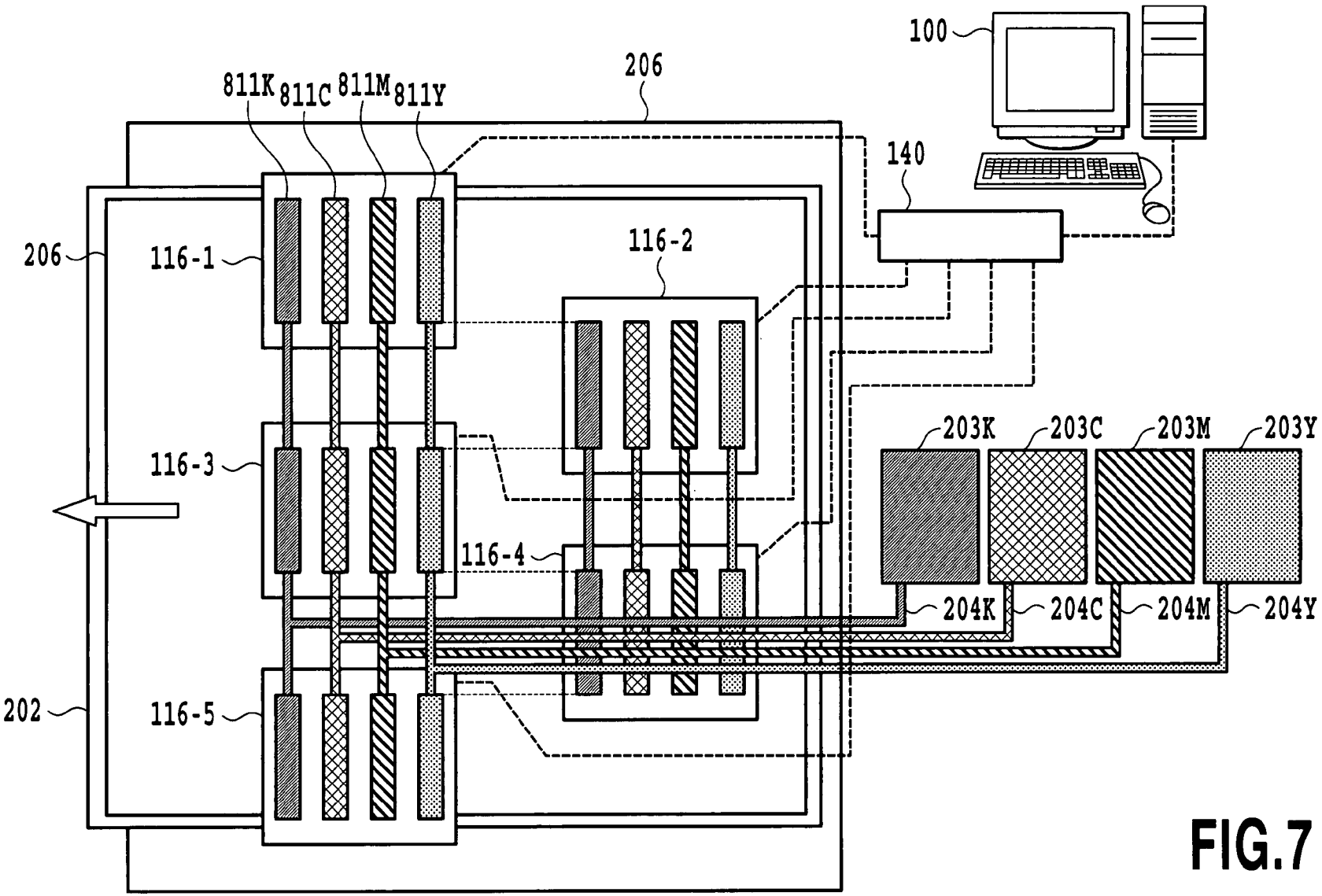
FIG. 7 is a schematic diagram showing a configuration of an ink supply system for the plurality of printing apparatus of FIG. 1.

FIG. 7 is a schematic diagram showing the configuration of the ink system, particularly the ink supply system. As shown in the figure, color inks are distributed from the ink source or ink tanks (also referred to as main tanks) 203Y, 203M, 203C, 203K to the print heads 811Y, 811M, 811C, 811K of each printer unit 116 through dedicated tubes 204Y, 204M, 204C, 204K. Ink supply may be done in either of two modes: one establishes a fluid communication with ink tanks at all times; and the other establishes the fluid communication with an ink supply unit provided for each print head only when the ink in the unit is running low, thereby supplying ink intermittently.

The recovery system of this embodiment has a cap that comes into contact with a nozzle forming surface of the print heads 811 and receives ink forcibly discharged from the nozzles. The recovery system further circulates the received ink for reuse.

The cap is disposed below the transport plane of the print medium 206, i.e., inside the media stage 202, and can be arranged to face or contact the nozzle forming surface of the print heads. Considering the use of a continuous sheet of print medium such as rolled paper, the cap may be disposed above the print medium transport plane, i.e., on the same side as the print heads 811 to allow the recovery operation to be performed without removing the print medium.

As described above, in this embodiment the ink supply system and the recovery system for the print heads 811 in each printer unit are constructed to be independent of other printer units. This arrangement allows for the supply of an appropriate amount of ink and the recovery operation according to the operation state, i.e., the amount of ink used for printing in each printer unit.

(Example Configuration of Ink System)

Figure 8:
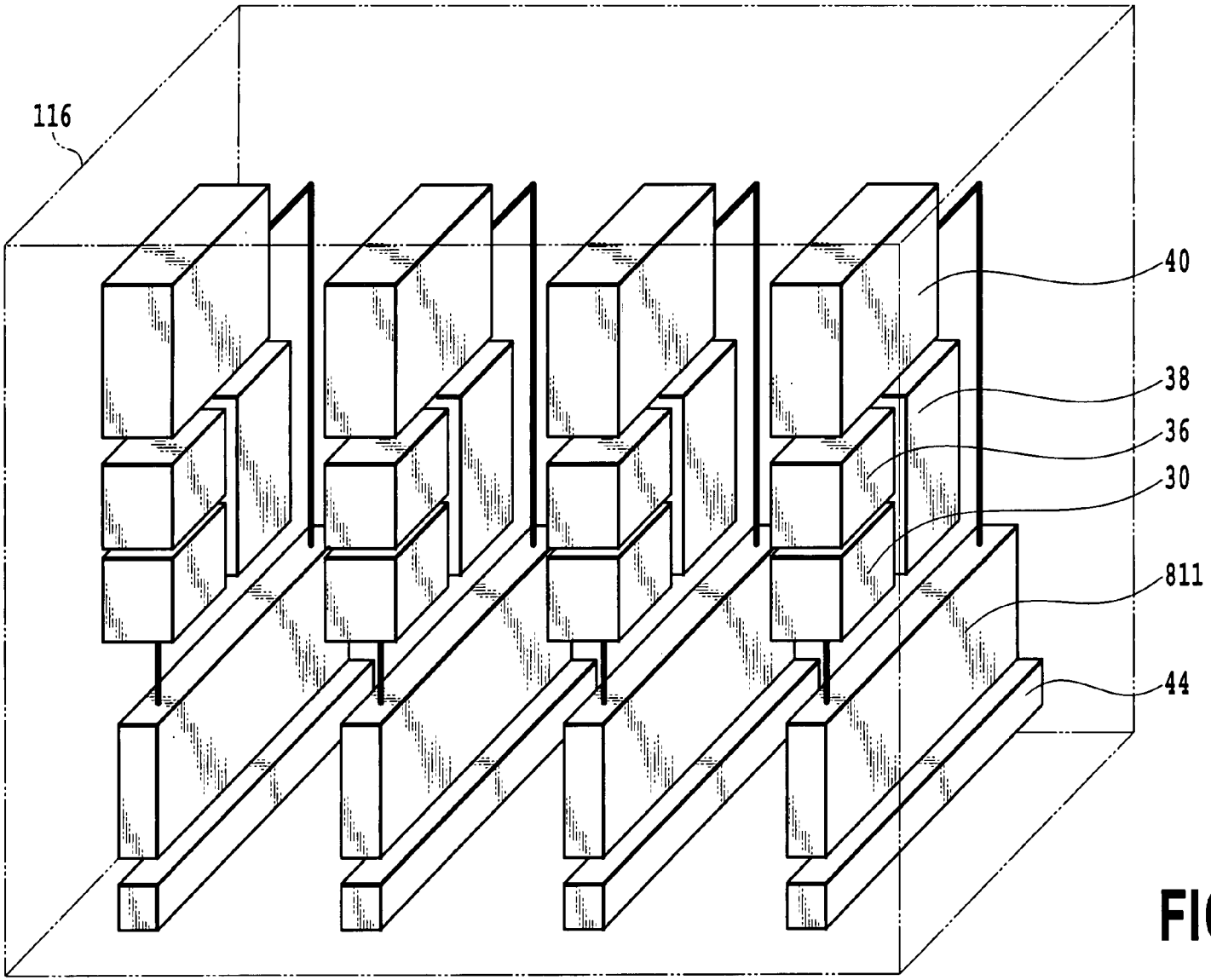
FIG. 8 is a schematic diagram showing a positional relation among essential portions of an ink system in one of the printing apparatus of FIG. 1.
Figure 9:
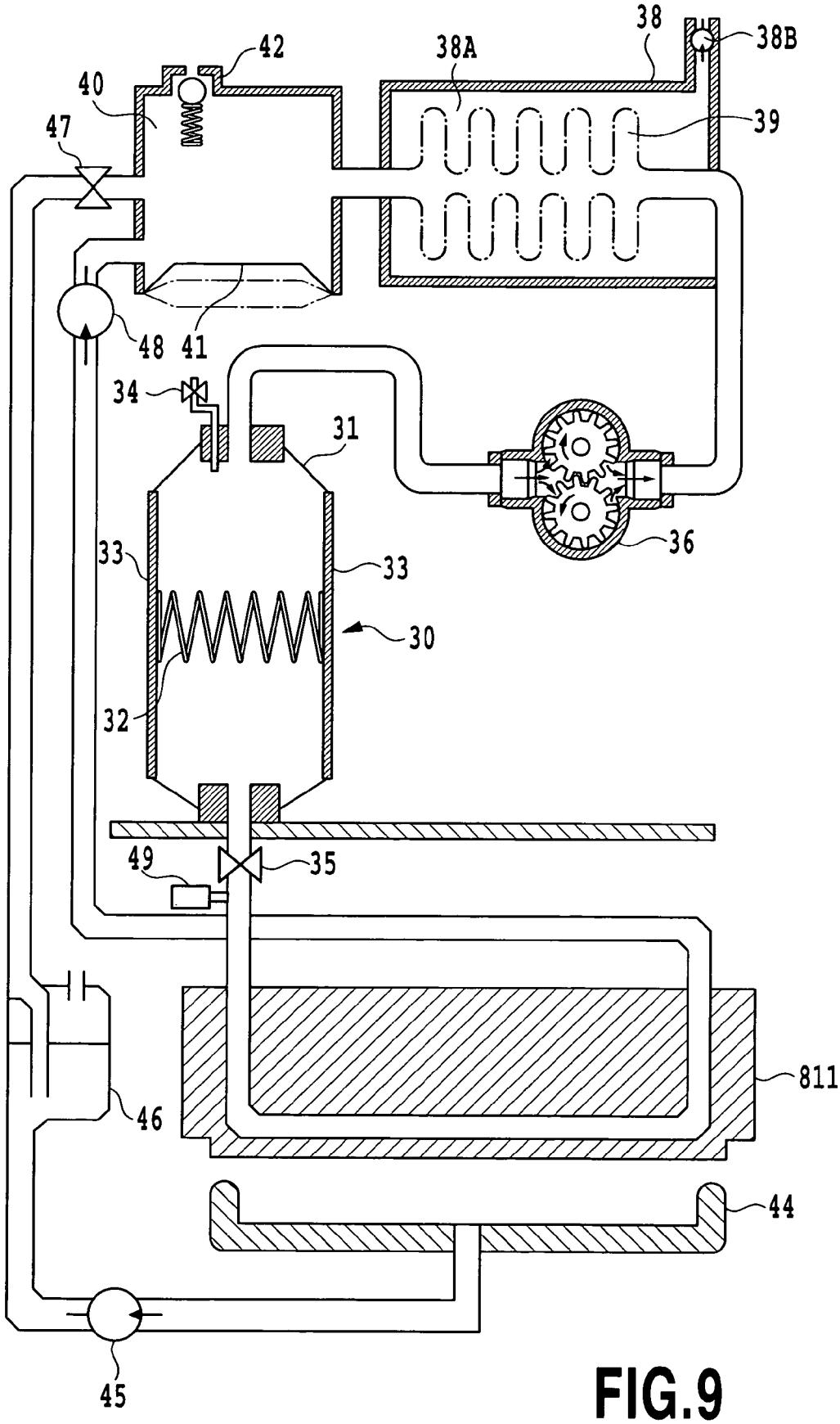
FIG. 9 is a schematic diagram showing a configuration of an ink system for one print head in the printing apparatus of FIG. 1.

FIG. 8 shows a positional relation among essential portions of the ink system in one printer unit 116 and FIG. 9 shows an example inner construction of the ink system for one print head. The print head 811 is connected with two ink tubes, one of which is connected to a negative pressure chamber 30 to generate a negative pressure that balances with a force holding a meniscus formed in the nozzles of the print head and the other is connected to the ink supply unit (hereinafter referred to as a subtank) 40 provided for each print head through the pump 48.

Figure 10:
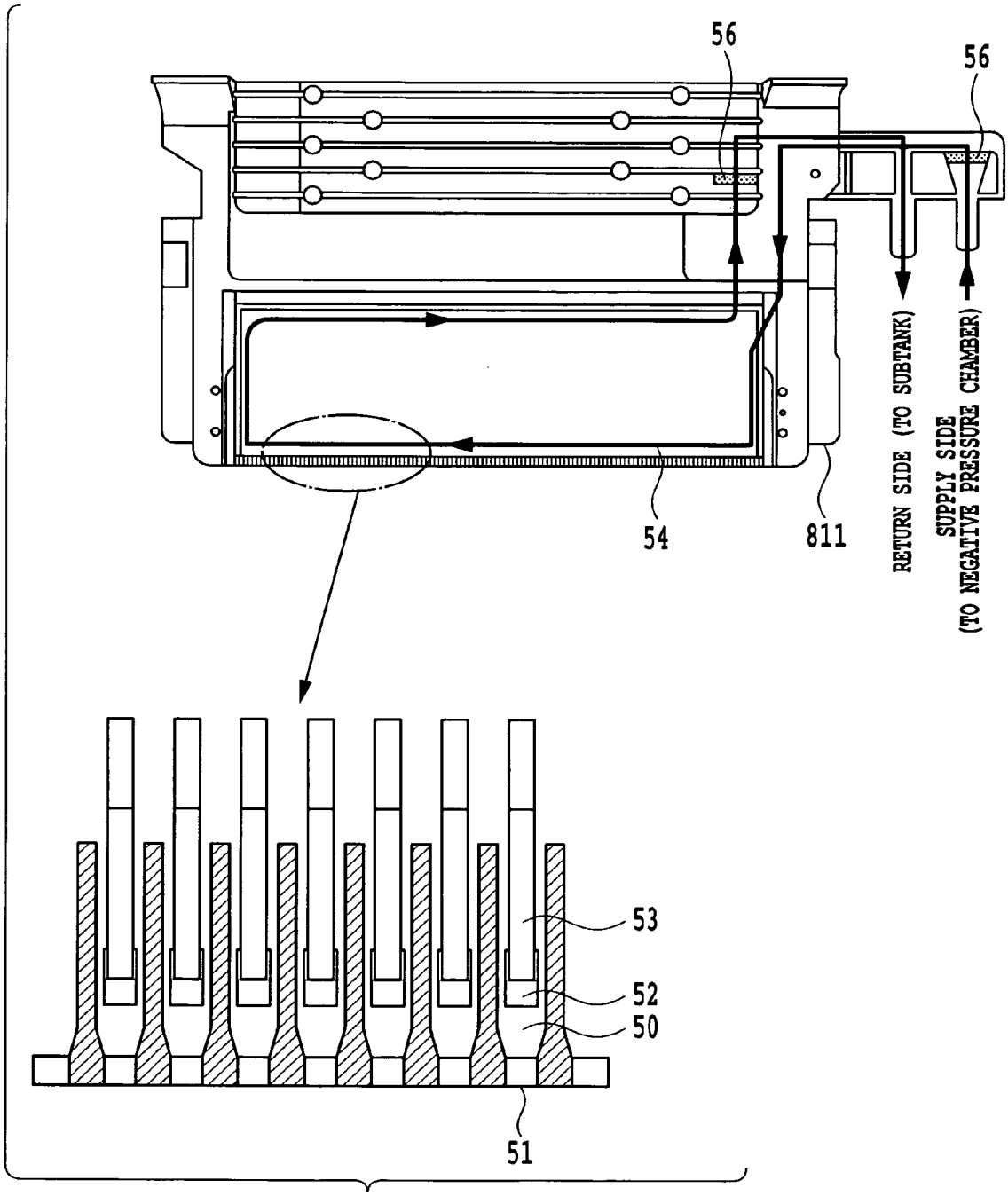
FIG. 10 is an explanatory diagram showing an ink path in the print head of FIG. 9.

FIG. 10 shows an ink path in the print head 811 and a partly magnified view. The print head used in this embodiment has 2,400 nozzles 50 arrayed at a density of 600 dpi (dots per inch) over a width of four inches. Each nozzle 50 has an ejection opening 51 at one end and, at the other end, is connected to an ink supply path 54. In each of the nozzles 50 there is provided an electrothermal transducer (heater) 52 that generates a thermal energy to heat ink and produce a bubble in ink to eject ink as it is energized. When the heater 52 is energized for 1μ to 5μ, the ink is heated and begins a film boiling at more than 300° C. on the heater surface. The ink is given an inertia force and ejected from the ejection opening 51 to land on the print medium, thereby forming an image. Each nozzle 50 is provided with a nozzle valve 53 as a fluid control element. This member is displaced as a bubble is formed so as to effectively apply the inertia force to the ink on the ejection opening side and blocks the movement of the ink on the supply path side toward the supply path side. Denoted 56 is a filter provided on both the supply side and return side of the ink supply path 54.

Figure 11C:
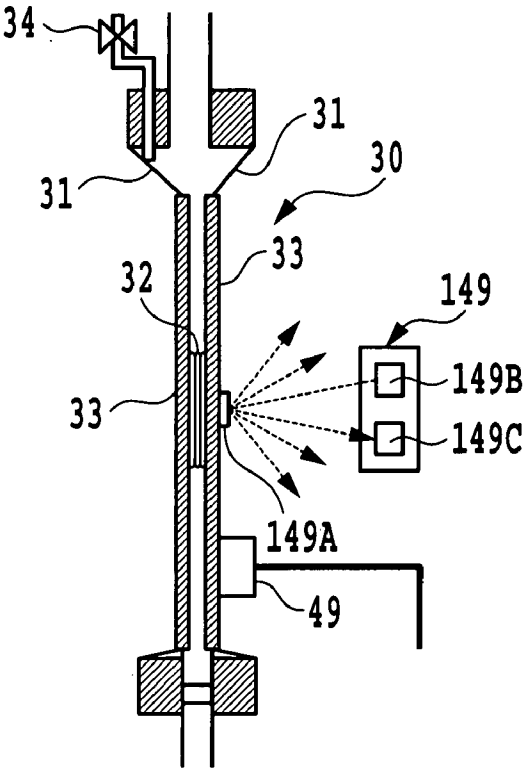
FIG. 11C is a schematic diagram showing the operation of the negative pressure chamber of FIG. 9.
Figure 11B:
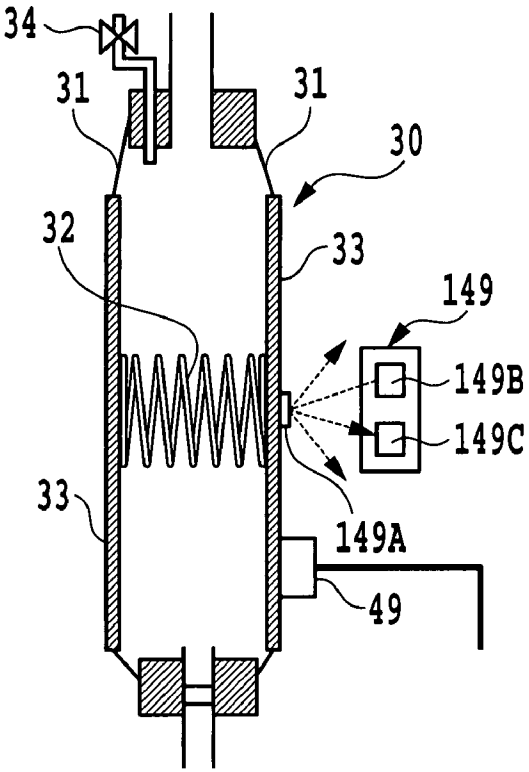
FIG. 11B is a schematic diagram showing the operation of the negative pressure chamber of FIG. 9.
Figure 11A:
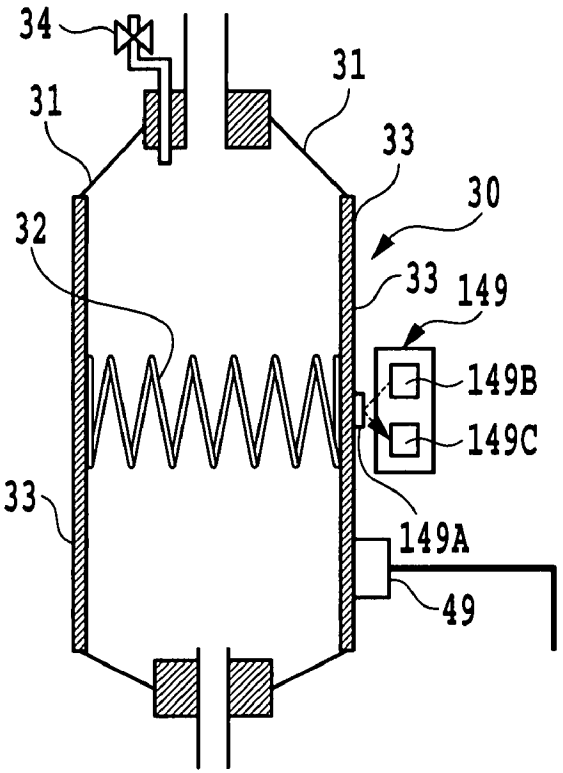
FIG. 11A is a schematic diagram showing an operation of a negative pressure chamber of FIG. 9.

As shown in FIG. 11A, FIG. 11B and FIG. 11C, the negative pressure chamber 30 comprises an ink holding member 31 formed of a resilient material and a pair of opposing platelike ink holding members 33. The negative pressure chamber 30 holds ink in an inner space defined by these members. Between the pair of opposing platelike ink holding members 33 is installed a compression spring 32, which urges the platelike ink holding members 33 away from each other to generate a negative pressure. This negative pressure chamber 30 is placed near the print head 811, so there is almost no pressure loss in the connection portion between them. Therefore, the interior of the negative pressure chamber 30 is almost equal to the negative pressure in the print head. If the ink demand from the print head 811 sharply changes and the pump 36 cannot catch up with the increased ink demand, the negative pressure chamber 30 works as a backup to help meet the demand. More specifically, the pair of platelike ink holding members 33 move toward each other compressing the compression spring 32 against its expansion force to reduce the inner volume of the negative pressure chamber 30 to supply ink.

The pressure sensor 49 may use a detection system that directly detects a negative pressure in the negative pressure chamber 30 or any other detection system. For example, an optical sensor 149 shown in FIG. 11A may be used. This sensor 149 comprises a reflection plate 149A mounted on the platelike ink holding member 33, a light emitting device (light emitting diode) 149B installed at a predetermined position opposite the reflection plate 149A outside the negative pressure chamber 30, and a light receiving device (light receiving transistor) 149C. Light from the light emitting device 149B is reflected by the reflection plate 149A and received by the light receiving device 149C. The quantity of light received is large when the ink volume in the negative pressure chamber 30 is large as shown in FIG. 11A, and decreases as the ink volume in the negative pressure chamber 30 decreases as shown in FIG. 11B and FIG. 11C. Thus, the sensor 149 detects the ink volume in the negative pressure chamber 30 and indirectly determines the negative pressure in the negative pressure chamber 30 from the relationship between the ink volume and the negative pressure in the negative pressure chamber 30.

The negative pressure chamber 30 is connected through a pressure adjust valve 35 (see FIG. 9) to a mechanical ink pump (also referred to as a "mechanical pump") 36 that controls the ink supply to the negative pressure chamber 30. In this example, the ink pump 36 is a gear pump.

Figure 12A:
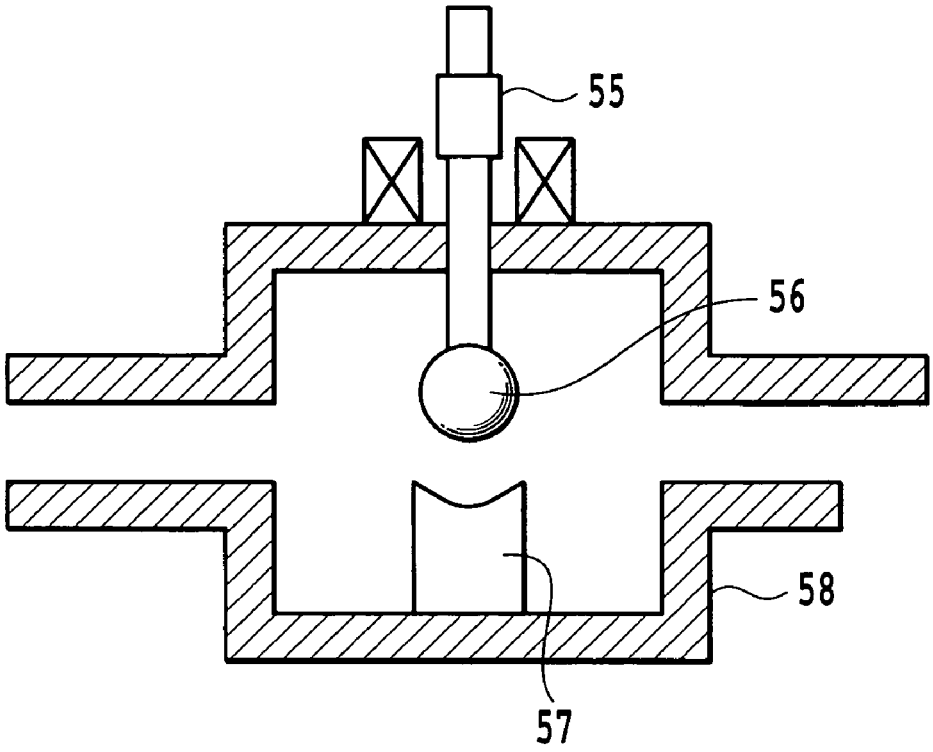
FIG. 12A is a schematic diagram showing an example construction of a valve of FIG. 9 and its operation.
Figure 12B:
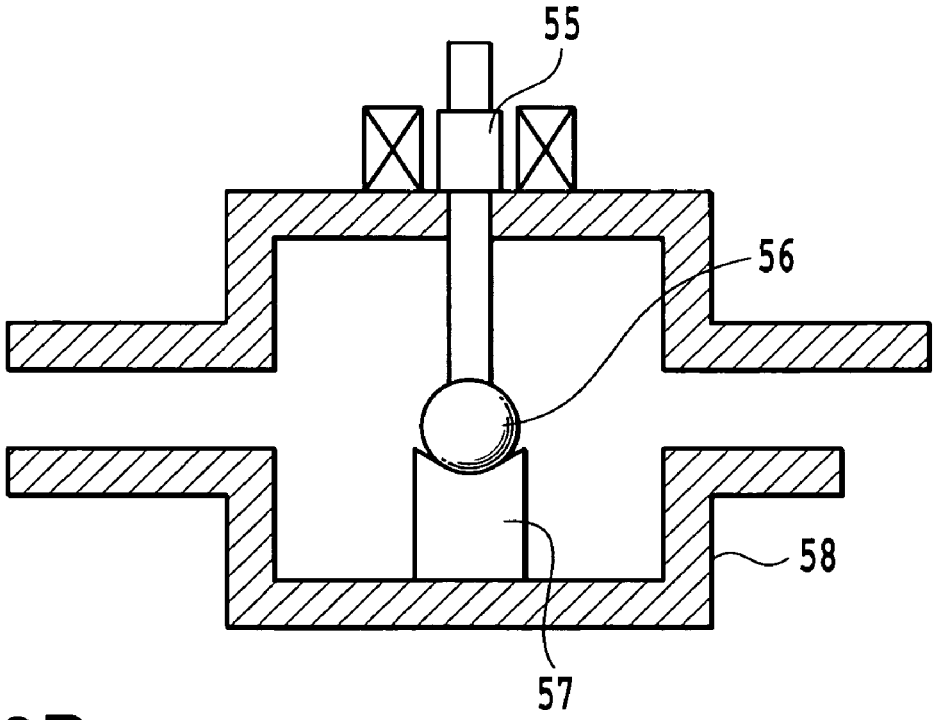
FIG. 12B is a schematic diagram showing the example construction of the valve of FIG. 9 and its operation.

Valves installed at various parts of the ink supply path, including the valve 35, may be of any desired type as long as they can properly open and close the path or properly control the ink flow in response to a control signal. For example, as shown in FIG. 12A and FIG. 12B, a valve 58 may be used which has a ball valve disc 56 and a seat 57 to receive the ball disc, with the valve disc connected to a plunger 55 that is driven forward and backward by a solenoid. In this case, the ink path can be opened and closed by controlling the energization of the solenoid to move the valve disc 56 toward or away from the seat 57. FIG. 12A represents a state in which the ink path is open and FIG. 12 represents a state in which the ink path is closed. As to the valve 35, however, it may use as an actuator a lightweight device such as piezoelectric element to allow for a highly responsive, high-performance negative pressure control.

As for the pumps installed at various parts of the ink supply path, including the pump 36, any desired type may be used as long as they can deliver ink in response to a drive signal. The pump 36 of this embodiment can control the direction and volume of ink flow. That is, the pump 36 of this example is a gear pump capable of selectively delivering ink in a direction that supplies ink to the negative pressure chamber 30 (the rotation in this direction is called a forward rotation) or in a direction that draws ink out of the negative pressure chamber 30 (the rotation in this direction is called a reverse rotation).

Figure 13:
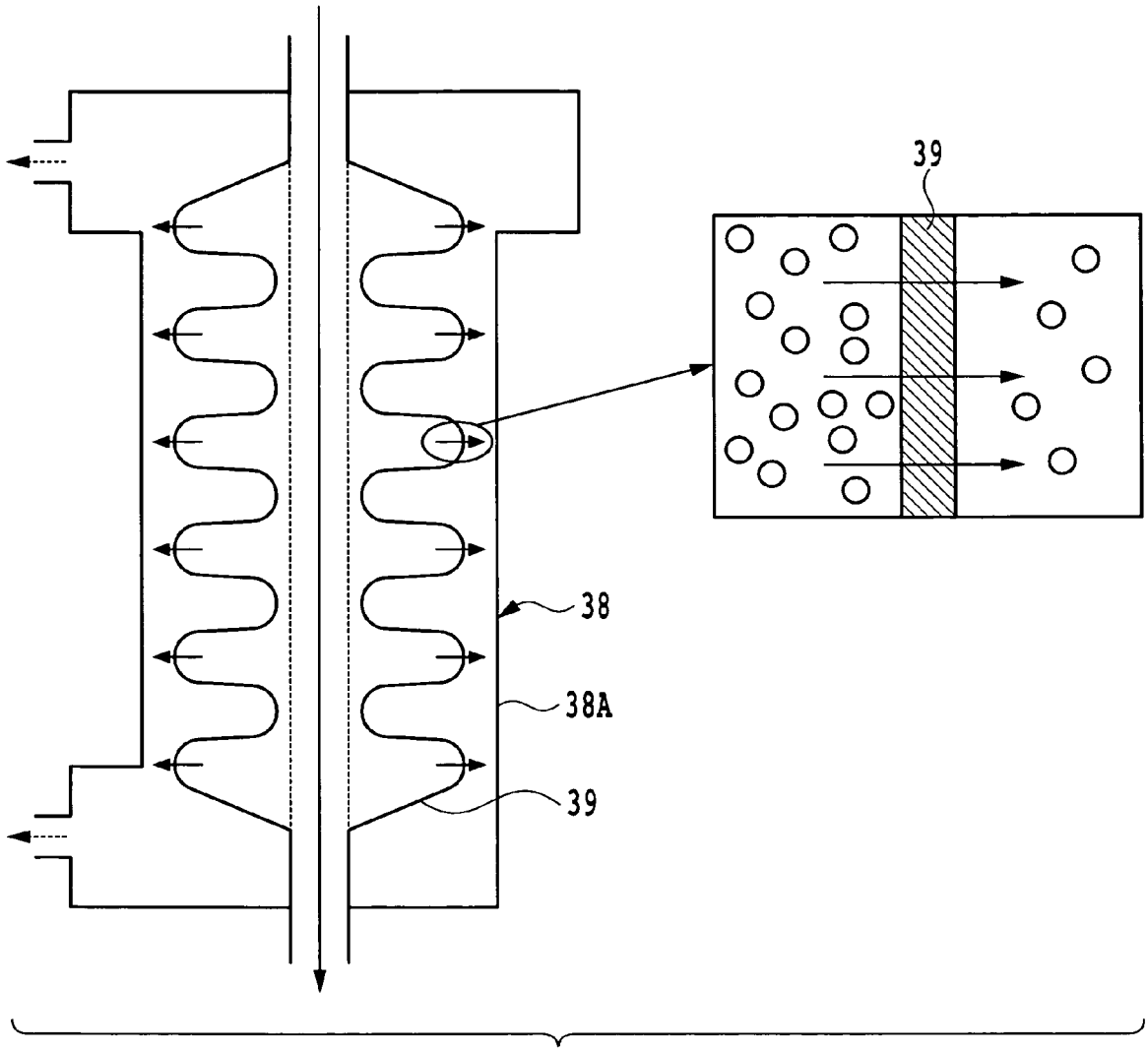
FIG. 13 is a schematic diagram showing an example construction of a deaeration system of FIG. 9.

The pump 36 is connected to a deaeration system 38 that removes gas components dissolved in the ink being delivered by the pump 36. The deaeration system 38, as shown in FIG. 13, comprises an ink supply path formed by a gas-liquid separation membrane 39 made of a material that passes gas but not liquid, a pressure reducing chamber 38A enclosing an ambient space, and a pump 38B (see FIG. 9) that reduces a pressure in the pressure reducing chamber 38A. The deaeration system 38 effectively removes gas from the ink flowing in the ink path by means of the gas-liquid separation membrane 39.

Figure 14A:
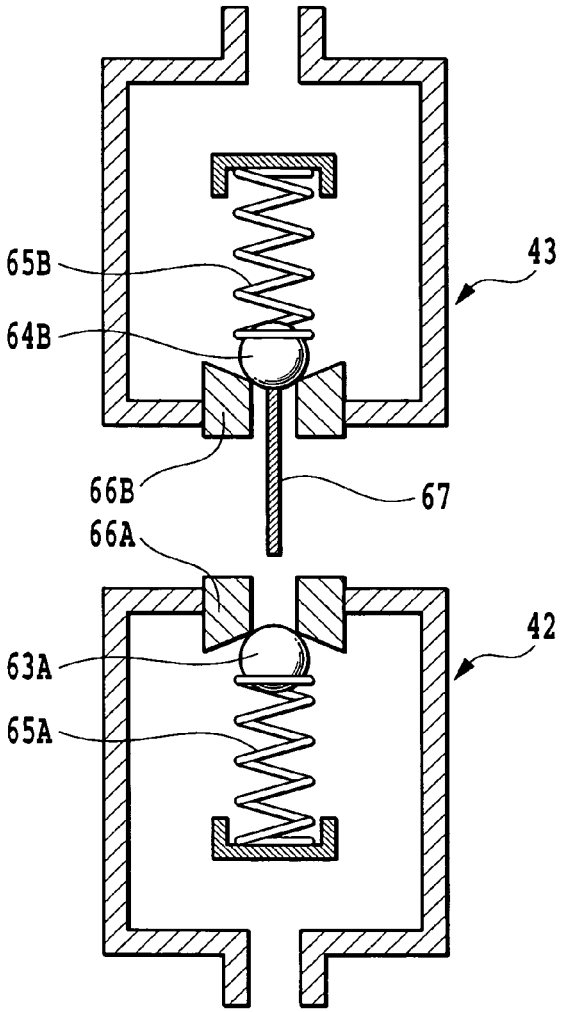
FIG. 14A is a schematic diagram showing an operation of a joint of FIG. 9.
Figure 14B:
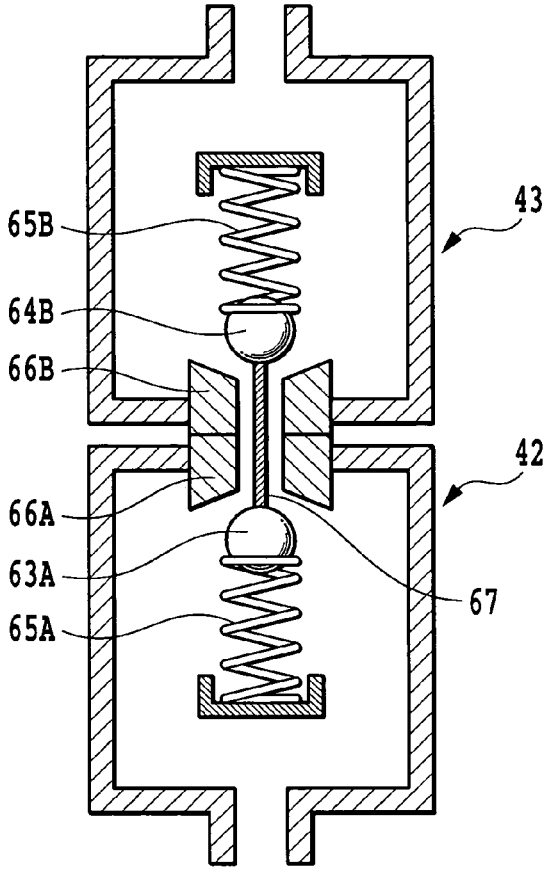
FIG. 14B is a schematic diagram showing the operation of the joint of FIG. 9.

The deaeration system 38 is connected to a subtank 40 (see FIG. 9) that contains an appropriate amount of ink to be consumed by the printing operation. The subtank 40 comprises a buffer member 41 defining a part of an ink accommodation space therein and capable of being displaced or deformed according to the ink volume accommodated, and a joint 42 to establish an ink connection, as necessary, with the ink tube 204 (see FIG. 2) connected to the main tank 203. When the ink in the subtank is running short, this joint 42 connects to a joint 43 fitted to the ink tube 204, as shown in FIG. 14B, to supply ink from the main tank 203 to the subtank 40, as needed.

The joints 42, 43 have at their opposing parts valve rubbers 66A, 66B each formed with a communication hole. When the joints 42, 43 are not connected, valve balls 63A, 64B urged by valve springs 65A, 65B close openings of the communication holes in the valve rubbers 66A, 66B, as shown in FIG. 14A. In this state the ink paths connected to the joints 42, 43 are isolated from outer air. When connecting the joints 42, 43, they are brought close together, as shown in FIG. 14B, to hold the valve rubbers 66A, 66B against each other, causing a ball lever 67 fitted to the valve ball 64B to push the valve ball 63A. As a result, the valve balls 63A, 64B part from the valve rubbers 66A, 66B bringing the ink paths connected to the joints 42 and 43 into communication with each other.

The joints 42, 43 may have any desired construction as long as they can close the openings to prevent ink leakage when not connected and establish a connection of ink paths, isolated from outer air.

In addition to the appropriate connection and disconnection of joints as described above to enable or disable the fluid communication, it is possible to have the ink supply paths themselves connected at all times and to establish the fluid communication in an on/off fashion by means of an open-close valve. What is required is that, when the ink volume required differs among the printer units depending on the contents of the divided image data, the ink supply operation in one printer unit does not interfere with that of another printer unit. In this respect, the independence of the individual printer units in this embodiment is assured.

Figure 15A:
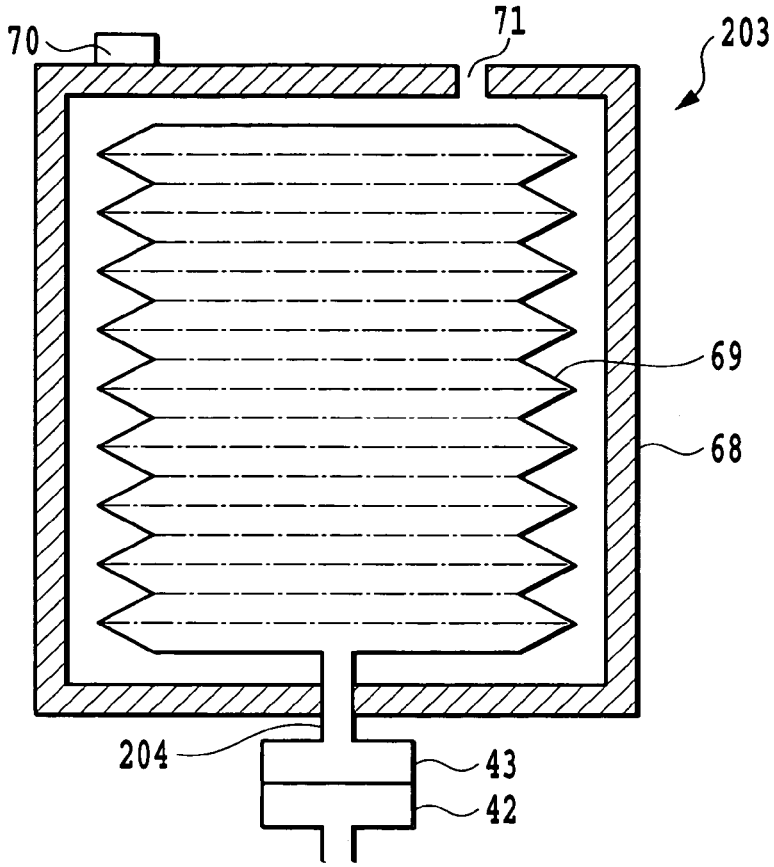
FIG. 15A is a schematic diagram showing an operation of a main ink tank of FIG. 2.
Figure 15B:
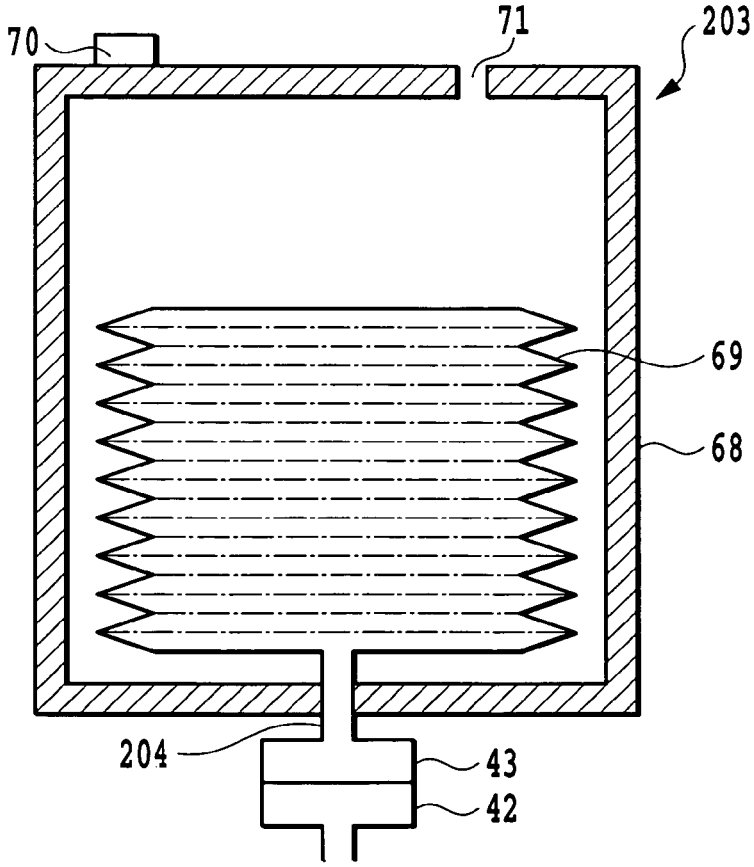
FIG. 15B is a schematic diagram showing the operation of the main ink tank of FIG. 2.

FIG. 15A and FIG. 15B illustrate an outline construction of an ink tank 203 (203Y, 203M, 203C, 203K) connected to the joint 43. The ink tank 203 of this example includes a resilient ink bag 69 and a tank housing 68 accommodating the ink bag. The tank housing 68 is formed with an atmosphere communication hole 71 and attached with a memory device 70. The memory device 70 can store various information associated with the ink tank 203. For example, information such as a kind of ink accommodated, a remaining ink volume and a type of ink tank may be written into the memory device and read out for use, as required. The ink bag 69 is deformed, as shown in FIG. 15A and FIG. 15B, depending on the consumption of ink contained in the ink bag. Therefore, the ink in the ink bag 69 can be supplied in isolation from outer air.

The other end of the tube installed in the print head 811 is connected to the subtank 40 through the pump 48, as shown in FIG. 9. The operation of the pump 48 and the pump 36 described above can circulate ink among the subtank 40, the negative pressure chamber 30 and the print head 811.

The printer unit 116 has a recovery mechanism to maintain the ink ejection performance of the print heads 811 in normal state or recover their normal state, and as part of the recovery mechanism has a cap 44 to hermetically cap the print heads 811.

During the recovery operation by the recovery mechanism, the mechanical pump 36 is rotated forwardly with the pump 48 stopped (path: closed). This rapidly pressurizes the interior of the print head 811, forcibly discharging a relatively large amount of ink (ink not contributing to the printing of an image) from nozzles of the print head 811 in a short time. As a result, the nozzles recover their sound condition. The forcibly discharged ink is received in an ink receiver of the cap 44, from which it is quickly collected by the action of the already running pump 45 through the valve 47 into the subtank 40 for reuse. This is followed by the wiping of the nozzle arrays of the print head 811 with a wiper blade not shown and by the preliminary ejection of ink not contributing to the formation of an image. Now, the recovery operation of the print head 811 is complete.

The printer units 116 or print heads 811 have the above-described ink (supply) system and therefore can perform control under a variety of conditions separately from the image forming system and image forming device or independently of other printer units, and can also be installed or replaced independently.

Denoted 60 in FIG. 9 is a control circuit board which incorporates control system constitutional devices of FIG. 3 for each printer unit 116.

(Operation of Ink System)

An operation of the ink system will be described under different conditions of use of the printer unit 116.

Figures 16A, 16B, 16C:
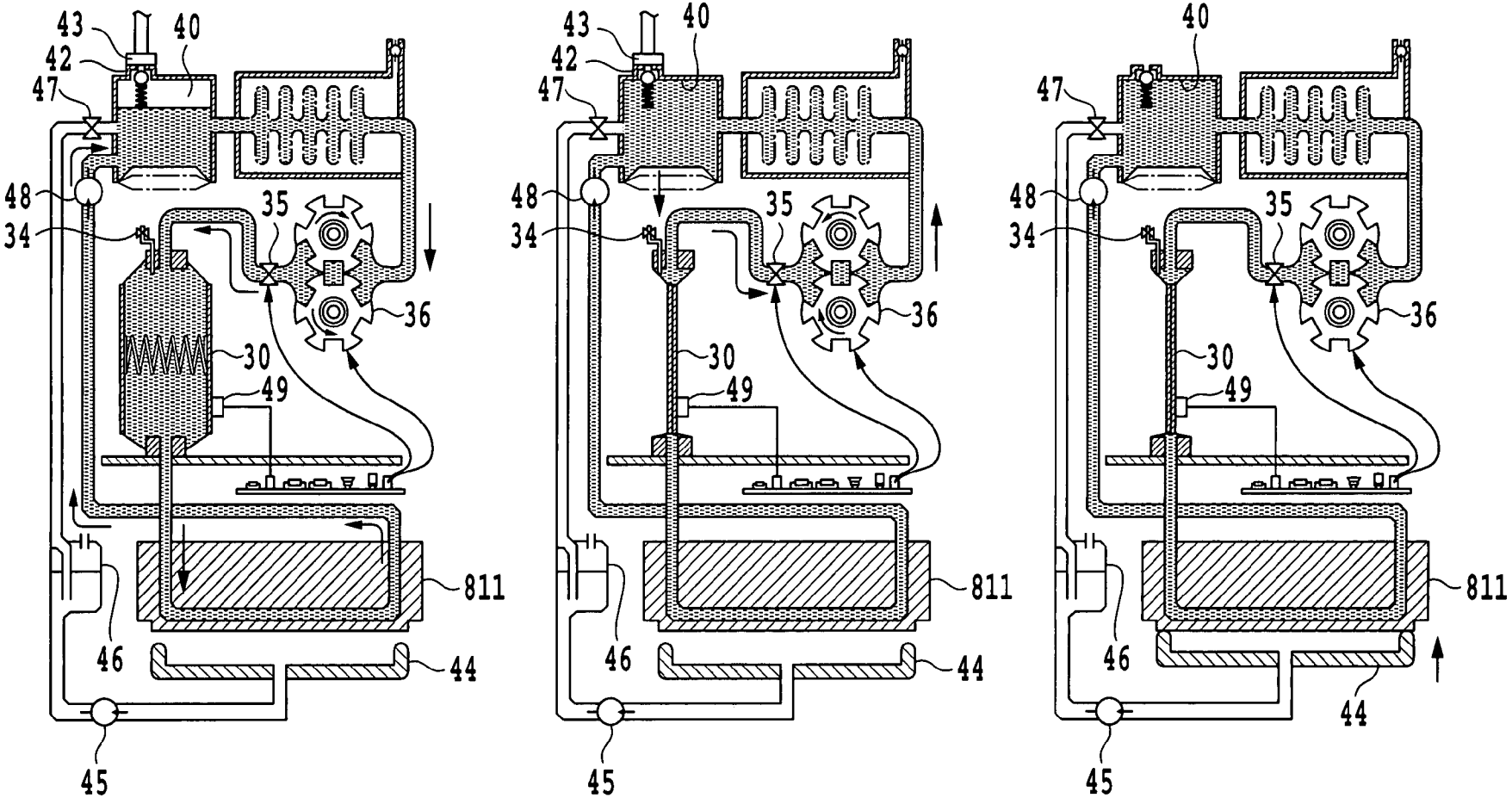
FIG. 16A is a schematic diagram showing an operation of the ink system of FIG. 9 at time of shipping.
FIG. 16B is a schematic diagram showing the operation of the ink system of FIG. 9 at time of shipping.
FIG. 16C is a schematic diagram showing the operation of the ink system of FIG. 9 at time of shipping.

Preparation for Shipping (see FIGS. 16A, 16B and 16C)

After the printer units 116 or print heads 811 have been manufactured, ink is poured into the tank 40 through the joint 42 as shown in FIG. 16A while at the same time operating the pumps 36, 48 and 45 to fill the ink system in the printer unit 116 with ink. At this time, air initially present in the ink system is exhausted from a vent opening of the deaeration system 38. Then, the print heads are subjected to a recovery operation which consists in forcibly discharging ink from the nozzles of the print head 811 into the cap 44, wiping the face of the print head with the wiper blade, and performing a preliminary ink ejection. After this, test printing operations and ageing are performed.

Next, considering the conditions to which the printer units will be subjected during transport, the amount of ink in the ink system in the printer units 116 are reduced. That is, the mechanical pump 36 is reversed, as shown in FIG. 16B, to move the ink in the ink system of the printer unit 116 back into the main tank 203 to reduce the amount of ink in the negative pressure chamber 30. Then, as shown in FIG. 16C, the cap 44 is held in intimate contact with the print head 811. The above procedure makes an ink leakage less likely even when the printer units 116 are subjected to environmental changes, particularly temperature rise and pressure drop, during transport.

As the ink to be filled into the ink system during the transport of the printer units 116, a liquid dedicated for transport use may be used as well as the ink used for the normal printing operation. The liquid dedicated for use during transport is a liquid generated by taking the environmental changes during transport and a prolonged transport period into account and may use a liquid obtained by removing coloring materials such as dye and pigment from the normal ink components. When such a transport-dedicated liquid is used, an additional process needs to be performed to replace the transport-dedicated liquid in the ink system with the normal ink before starting the printing operation.

Figures 17A, 17B, 17C:
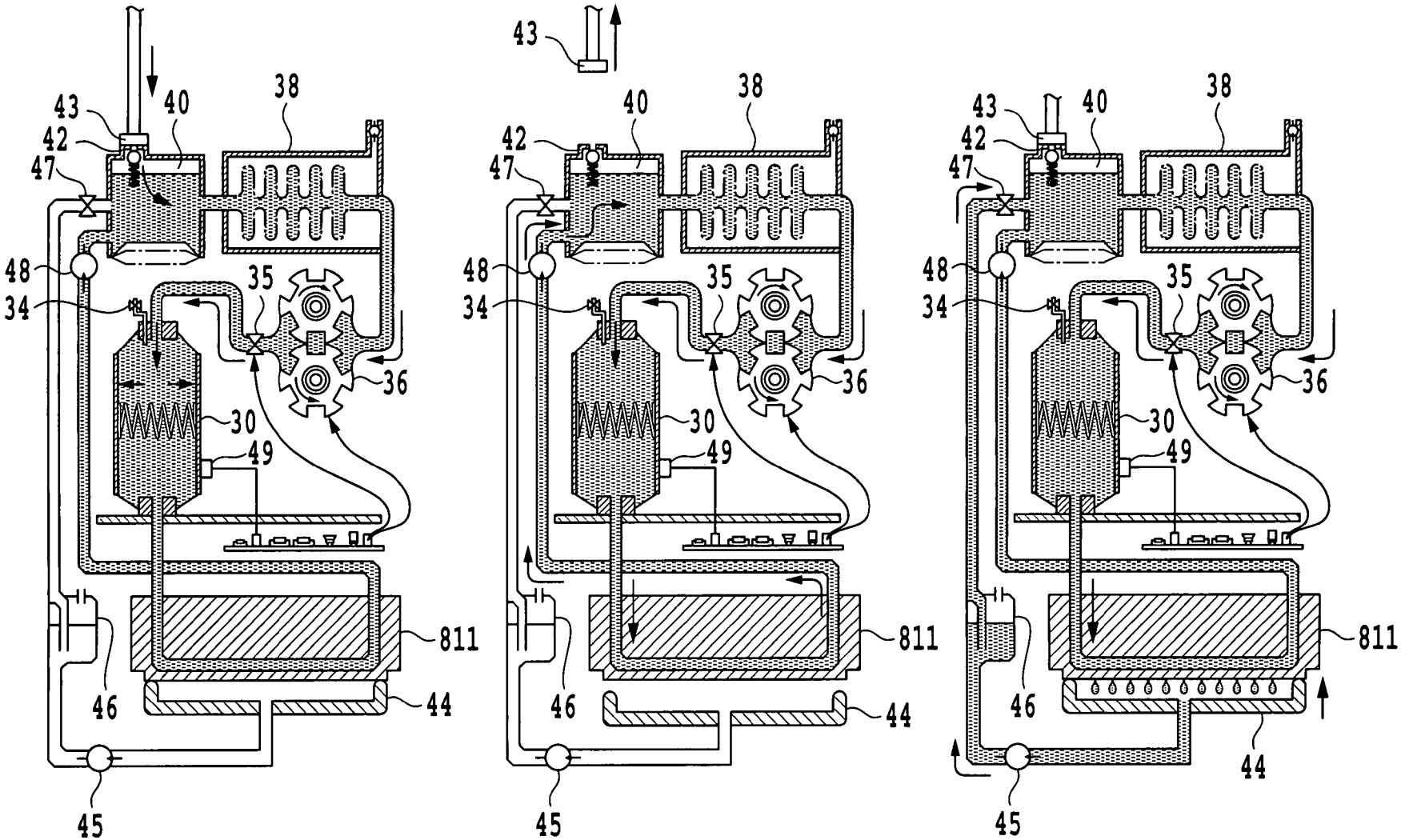
FIG. 17A is a schematic diagram showing an operation of the ink system of FIG. 9 when the apparatus begins to be used.
FIG. 17B is a schematic diagram showing the operation of the ink system of FIG. 9 when the apparatus begins to be used.
FIG. 17C is a schematic diagram showing the operation of the ink system of FIG. 9 when the apparatus begins to be used.

Preparation for Operation (see FIGS. 17A, 17B and 17C)

Before using the printing apparatus that was delivered and installed, the joint 42 is connected to the joint 43 on the main tank 203 side and the pump 36 is operated forwardly, as shown in FIG. 17A, to deliver ink into the negative pressure chamber 30. Then, to remove bubbles remaining in the path, the pumps 36 and 48 are operated, as shown in FIG. 17B, to circulate ink from the negative pressure chamber 30 through the print head 811, subtank 40 and deaeration system 38. This ink circulation is continued for an appropriate length of time, removing the air trapped in the path through the deaeration system 38 to a level that poses almost no problem. Next, to discharge air remaining near the nozzles in the print head 811 and to restore the sound ejection performance, the mechanical pump 36 is operated forwardly with the pump 48 at rest (path: closed), as shown in FIG. 17C. This rapidly pressurizes the interior of the print head 811 through the negative pressure chamber 30, forcibly discharging a relatively large amount of ink from the nozzles of the print head 811 in a short duration of time. As a result, the nozzles are restored to the normal state. The forcibly discharged ink is received in an ink receiver of the cap 44, from which it is quickly collected by the action of the already running pump 45 through the valve 47 into the subtank 40 for reuse. This is followed by the wiping of the nozzle arrays of the print head 811 with a wiper blade not shown and by the preliminary ejection. Now, the recovery operation of the print head 811 is complete.

Figure 18C:
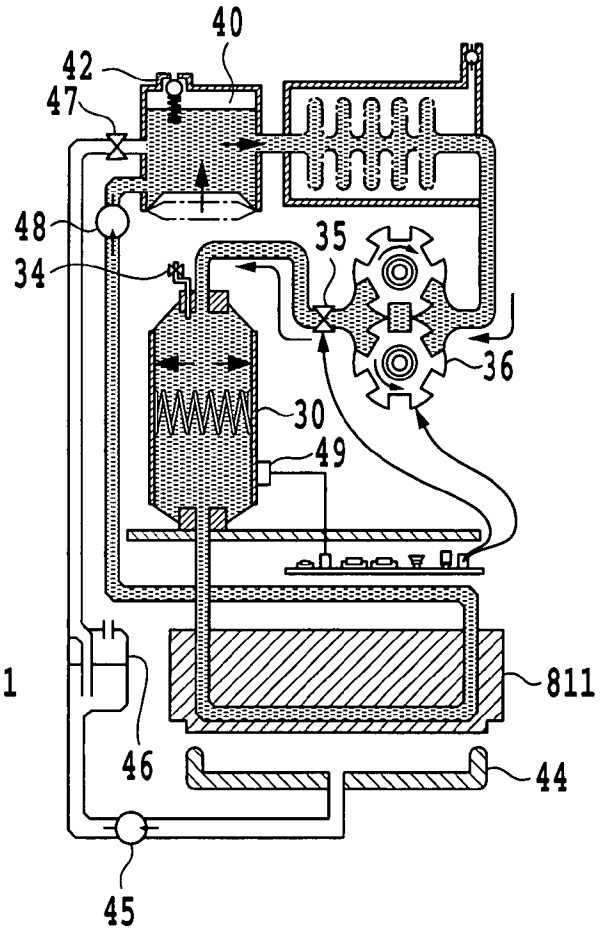
FIG. 18C is a schematic diagram showing the operation of the ink system of FIG. 9 during a standby for printing.
Figure 18B:
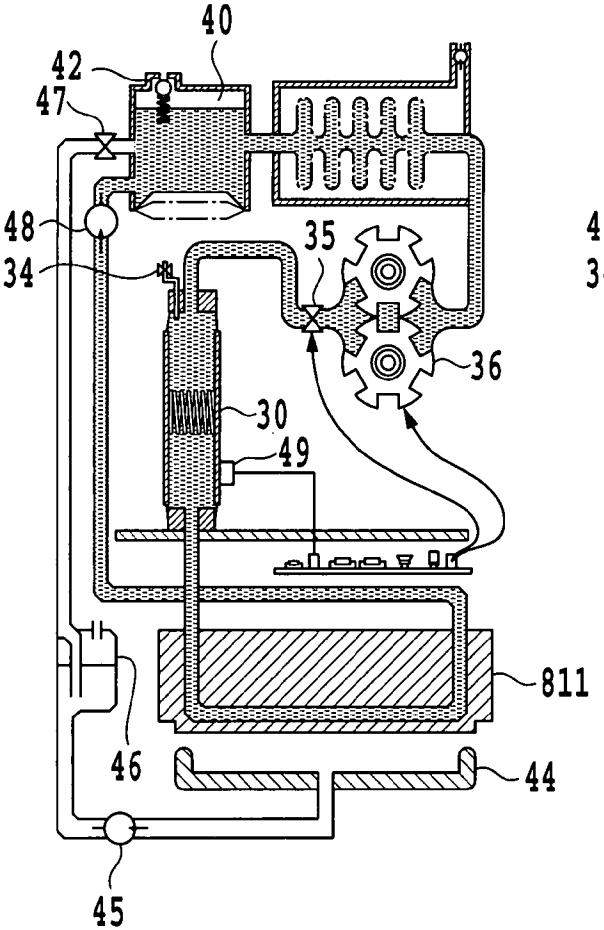
FIG. 18B is a schematic diagram showing the operation of the ink system of FIG. 9 during a standby for printing.
Figure 18A:
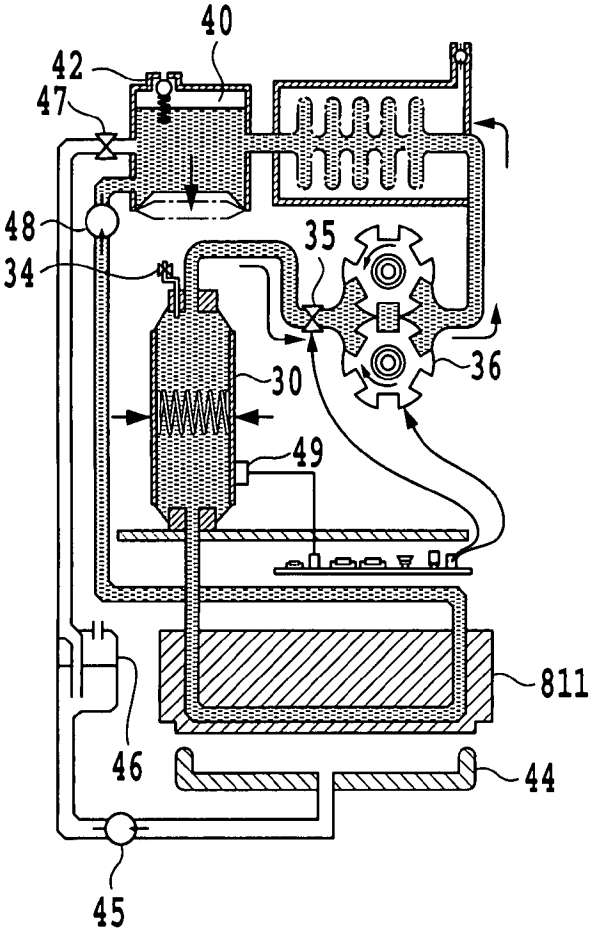
FIG. 18A is a schematic diagram showing an operation of the ink system of FIG. 9 during a standby for printing.

Standby for Printing Operation (see FIGS. 18A, 18B and 18C) During a normal standby before the start of the printing operation, a relatively large negative pressure (about 20-150 mmAq below the atmospheric pressure) is applied to the ink in the print head 811 to maintain stability against environmental changes. That is, as shown in FIG. 18A, the pump 48 is stopped to limit the return of ink from the print head 811 to the subtank 40 and the pump 36 is reversed to return the ink in the negative pressure chamber 30 to the subtank 40. This increases the negative pressure applied to the ink in the print head 811. Then, as shown in FIG. 18B, with a greater negative pressure maintained, the apparatus waits for the start of the printing operation. The subtank 40 increases in volume in a direction of down arrow of FIG. 18A by an amount of ink returned from the negative pressure chamber 30.

If the ink system is left in the negative pressure state of FIG. 18B, however, the performance of ink supply (refill) to the print head 811 during the printing operation deteriorates making it difficult to drive the print head at high frequency. Thus, when a print signal is input (step S1041 of FIG. 5), the pump 36 is operated forwardly, as shown in FIG. 18C, to perform a preliminary ink supply. That is, the negative pressure chamber 30 is pressurized to control the negative pressure acting on the print head 811 toward the positive direction to reduce the negative pressure to an appropriate level for printing. The negative pressure in the negative pressure chamber 30 can be detected by the negative pressure sensor 49 or sensor 149 (see FIG. 11A). The subtank 40 decreases in volume in a direction of up arrow in FIG. 18C by an amount of ink delivered into the negative pressure chamber 30.

Figure 19C:
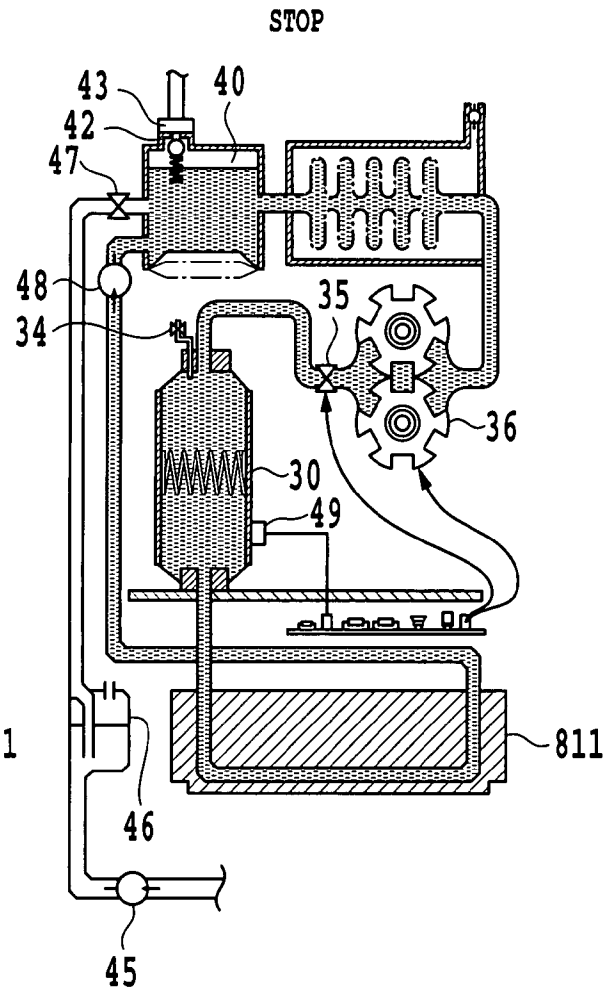
FIG. 19C is a schematic diagram showing the operation of the ink system of FIG. 9 during a printing operation.
Figure 19B:
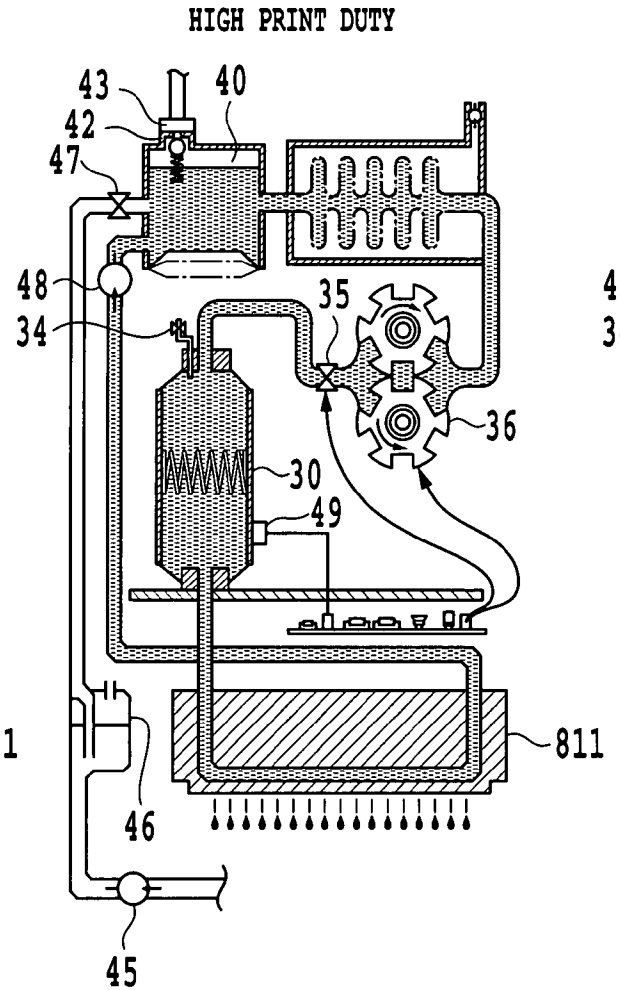
FIG. 19B is a schematic diagram showing the operation of the ink system of FIG. 9 during a printing operation.
Figure 19A:
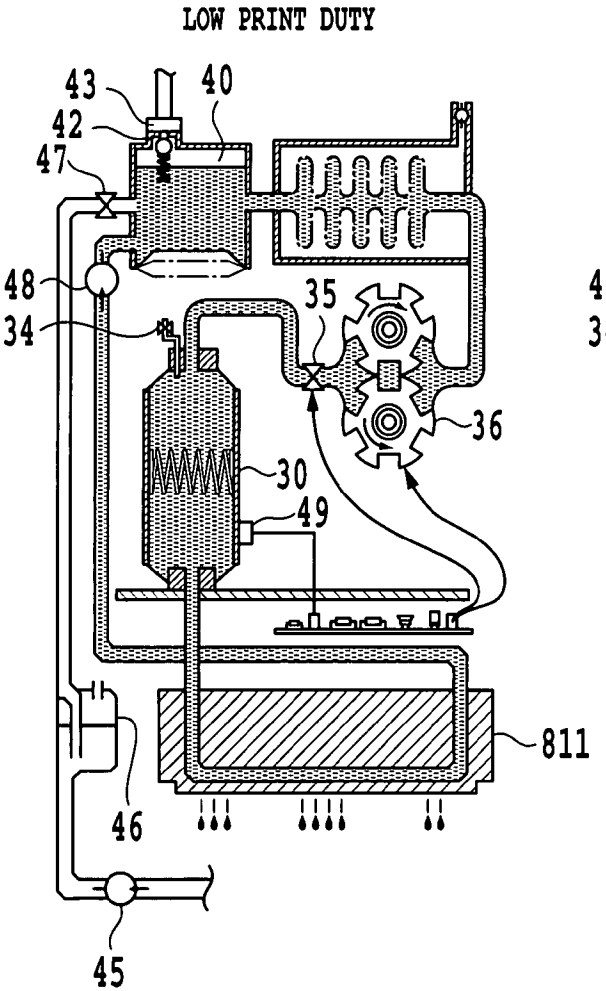
FIG. 19A is a schematic diagram showing an operation of the ink system of FIG. 9 during a printing operation.

Ink Supply Control During Printing (see FIGS. 19A, 19B and 19C)

By properly controlling the negative pressure adjust valve 35 and the mechanical pump 36, a highly uniform negative pressure can be maintained according to a print duty (print density) that corresponds to the content of image data to be printed by the printer unit 116 or print heads 811.

When, for example, the print duty is low, the pump 36 is operated forwardly at low speed, as shown in FIG. 19A, to supply ink while at the same time controlling the negative pressure adjust valve 35 to stabilize the negative pressure with high precision to optimize the ink supply. That is, by supplying a small amount of ink, the ink negative pressure in the print head is stabilized within an optimum range. Further, the open-close control or opening degree adjust control is performed on the negative pressure adjust valve 35 to further stabilize the negative pressure of ink.

In this case, the rate at which the flow path is open is relatively small and the opening degree is controlled within a relatively narrow range.

When the print duty (print density) is high, the pump 36 is operated forwardly at a higher speed, as shown in FIG. 19B, to increase the ink supply volume and at the same time the negative pressure adjust valve 35 is controlled to stabilize the negative pressure. In that case, the rate at which the flow path is open is relatively large and the opening degree is controlled within a relatively wide range.

When the printing operation is stopped, the negative pressure adjust valve 35 is closed instantly, as shown in FIG. 19C. This is intended to prevent an ink supply pressure caused by the ink inertia, that would occur when the printing operation is stopped, from acting on the negative pressure chamber 30 and the print head 811. Should the ink supply pressure be applied, the inner pressure in the print head rises, giving rise to a possibility of an ink leakage from the nozzles, which in turn will result in a degradation of print quality during subsequent printing operations.

The control of the negative pressure adjust valve 35 can be done by feeding back output signals of the negative pressure sensors 49, 149 (see FIG. 11A) of the negative pressure chamber 30. As described later, the negative pressure adjust valve 35 and the pump 36 can be controlled in connection with each other based on the print data.

Further, according to the ink volume consumed per unit time, i.e., the print duty, not only the amount of forward rotation and forward rotation speed of the pump 36 but its reverse rotation amount and reverse rotation speed can also be controlled. When the pump 36 is rotated forwardly, the negative pressure rise in the print head 811 can be suppressed by positively pressurizing the ink on the side of the print head 811 according to the ink consumption volume. When the pump 3 is reversed, on the other hand, the negative pressure reduction in the print head 811 can be minimized by positively reducing the pressure acting on the ink on the print head 811 side. Further, in connection with such a control of the pump 36, the negative pressure adjust valve 35 may be controlled to control the negative pressure in the print head 811 with high precision, further stabilizing its negative pressure.

With this embodiment, positively controlling the negative pressure of ink supplied to the print head can apply an appropriate, stable negative pressure to the print head whatever the print duty (print density). Therefore, in an industrial printing apparatus (printer) that prints an image on a large-size print medium at high speed, for example, this embodiment can control the negative pressure with good responsiveness even when the ink consumption volume per unit time varies greatly, minimizing variations in the negative pressure in the print head. In such an industrial printing apparatus, it is important to suppress negative pressure variations in the print head in order to meet the demand for a particularly high quality of printed image.

Figure 20C:
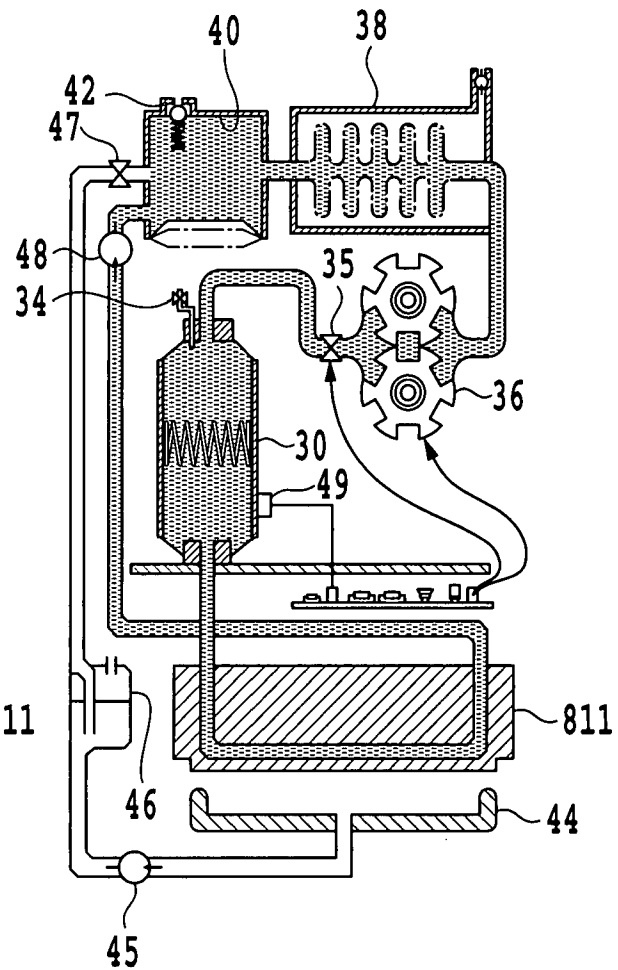
FIG. 20C is a schematic diagram showing the operation of the ink system of FIG. 9 during a maintenance operation.
Figure 20B:
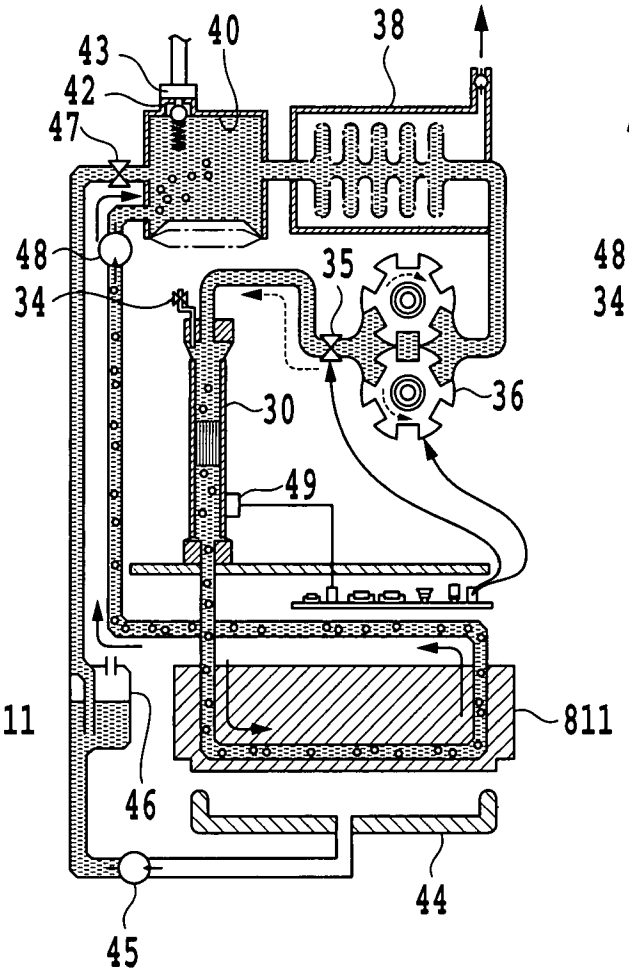
FIG. 20B is a schematic diagram showing the operation of the ink system of FIG. 9 during a maintenance operation.
Figure 20A:
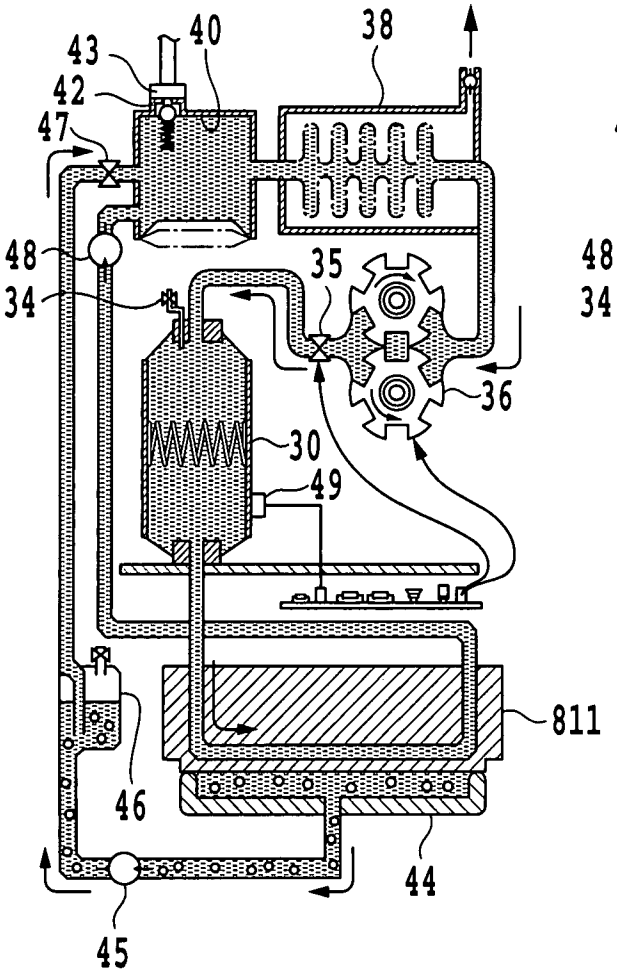
FIG. 20A is a schematic diagram showing an operation of the ink system of FIG. 9 during a maintenance operation.

Control During Recovery Operation (Maintenance) (see FIGS. 20A, 20B and 20C)

FIG. 20A shows a recovery operation that forcibly discharges ink not contributing to an image forming from the nozzles of the print head 811.

In this recovery operation, the mechanical pump 36 is operated forwardly with the pump 48 stopped (path: closed). This quickly pressurizes the interior of the print head 811 from the negative pressure chamber 30, forcibly discharging a relatively large amount of ink from the nozzles of the print head 811 in a short period of time. As a result, the nozzles are reinstated to a normal state. The forcibly discharged ink is received in an ink receiver of the cap 44, from which it is quickly collected by the action of the already running pump 45 through the valve 47 into the subtank 40 for reuse. This is followed by the wiping of the nozzle arrays of the print head 811 with a wiper blade not shown and by the preliminary ejection of ink. Now, the recovery operation of the print head 811 is complete.

FIG. 20B shows an operation to remove gas components dissolved in ink by means of the deaeration system 38.

In this operation the pump 36 is rotated forwardly at low speed to supply a small volume of ink from the deaeration system 38 into the negative pressure chamber 30 while at the same time the pump 48 is operated to return a greater amount of ink than is supplied by the pump 36 from the print head 811 to the tank 40. Thus, the amount of ink in the negative pressure chamber 30 decreases and, as the ink circulates through the deaeration system 38, it is removed of gas components dissolved therein.

FIG. 20C shows a standby state to which the ink system proceeds following the recovery operation.

In this standby state, with the interior of the negative pressure chamber 30 adjusted to a predetermined negative pressure, the valve 35 is closed and the pump 48 is stopped to maintain the adjusted negative pressure. At this time, the negative pressure in the negative pressure chamber 30 may be set at a lower negative pressure as during the standby state for the printing operation shown in FIG. 18A.

Figure 21B:
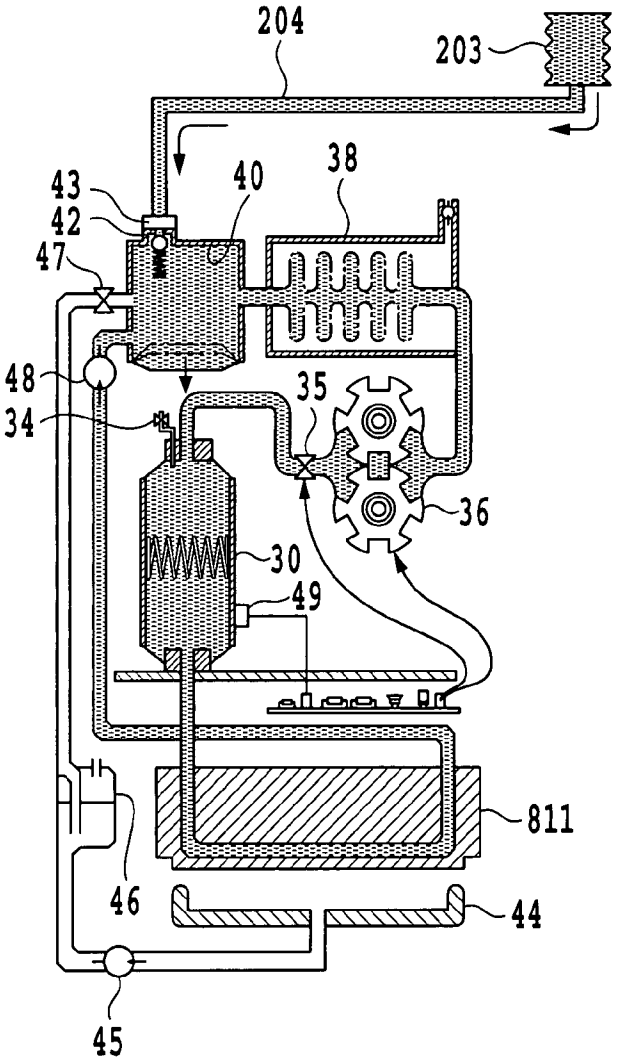
FIG. 21B is a schematic diagram showing the operation of the ink system of FIG. 9 when ink is supplied.
Figure 21A:
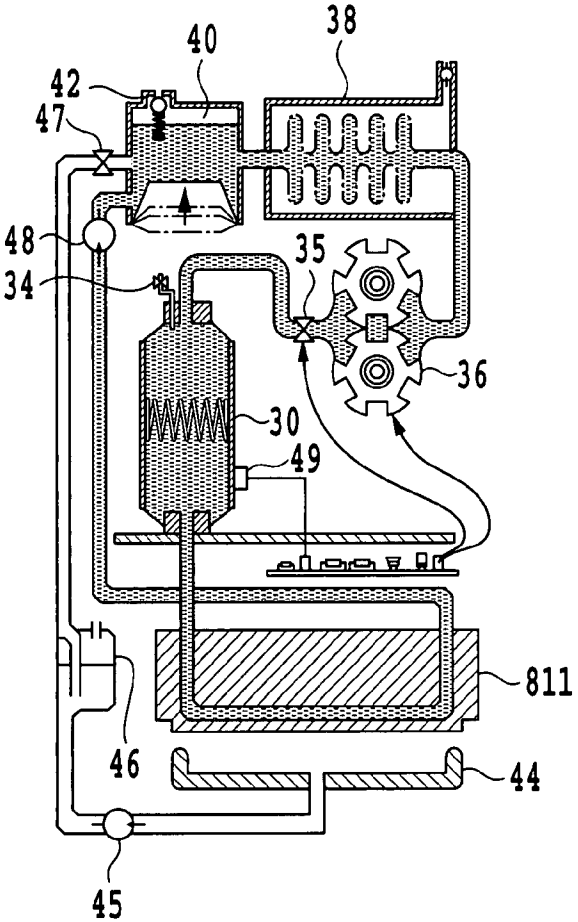
FIG. 21A is a schematic diagram showing an operation of the ink system of FIG. 9 when ink is supplied.

Ink Supply Operation (see FIGS. 21A and 21B)

FIG. 21A and FIG. 21B show an operation of supplying ink from the main ink tank 203 to the sub ink tank 40.

When the ink volume remaining in the subtank 40 decreases to less than a predetermined amount, as shown in FIG. 21A, the joints 42, 43 are connected to supply ink from the ink tank 203 into the ink tank 40. At this time the ink may be supplied by using a water head. As a result, the resilient member of the ink tank 40, that was deformed up as shown in FIG. 21A, is deformed down as shown in FIG. 21B as the ink is refilled.

(Summary of Control of Ink System)

Next, from the standpoint of print duty of the print head and the negative pressure applied to the print head, the operation of the ink system of this embodiment will be explained by referring to FIG. 22.

Figure 22:
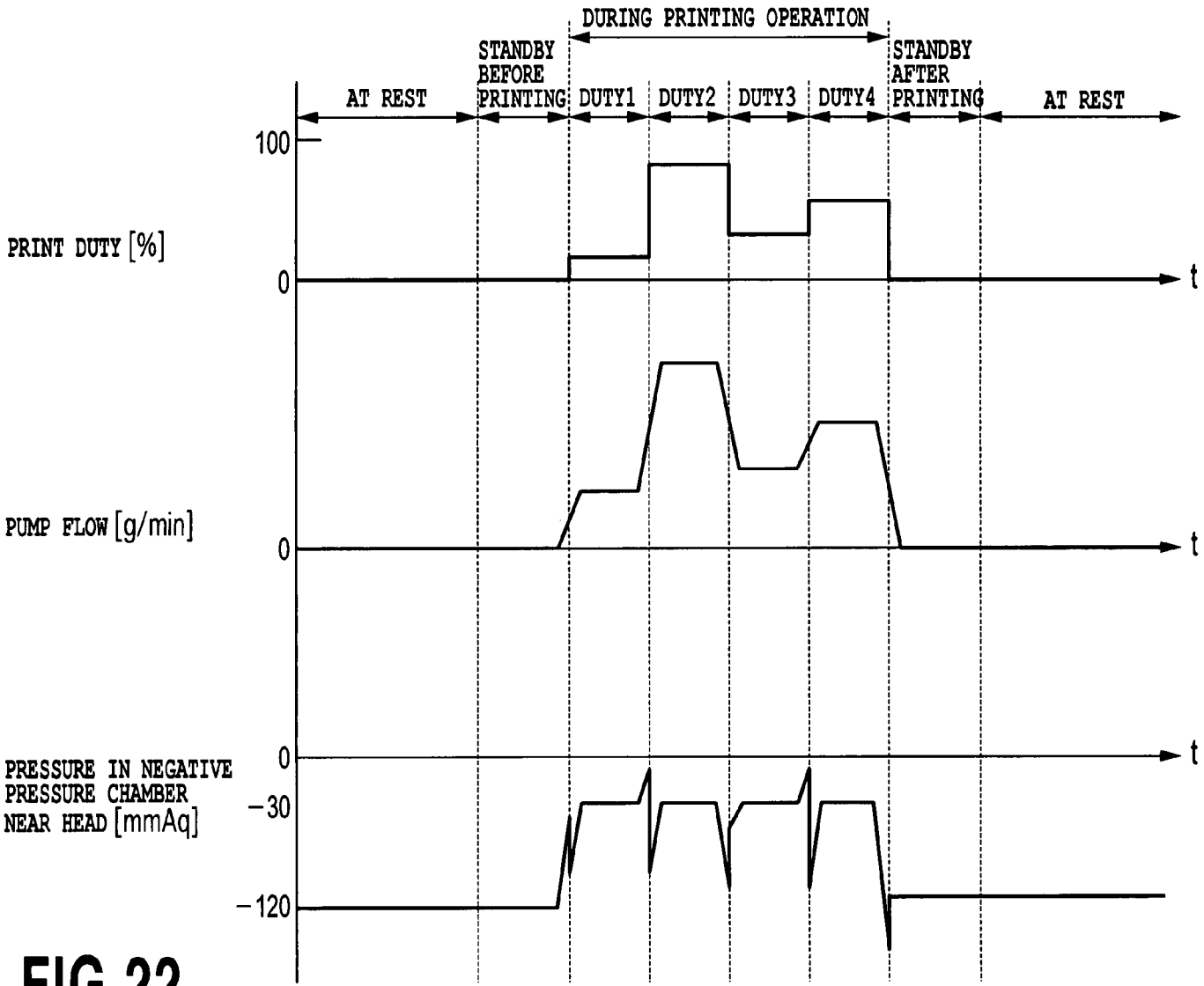
FIG. 22 is a timing chart showing an operation of the ink system of FIG. 9.

"Print duty" (print density) shown in the top tier of FIG. 22 is a print duty (print density) when the printer unit is in a printing state. An operation stage in the printing state may be divided into a rest stage during which printing is not performed, a pre-printing standby stage immediately before a printing operation, a printing stage, and a post-printing standby stage immediately after the printing operation during which time the printer unit waits for the next printing operation. During the printing stage, the amount of ink to be supplied varies depending on the print duty, namely the amount of ink consumed for printing. In this example, the print duty is divided into four stages, according to which the pump flow (ink volume delivered by the pump 36) is set as shown at the middle tier of FIG. 22. The print duty shown in the figure is only an example and of course changes according to the image data.

The negative pressure applied to the print head 811 is detected by the pressure sensor 49 (or 149) that is mounted to the negative pressure chamber 30 located close to the print head 811 and having almost the same negative pressure state as the print head. The detected negative pressure is shown at the lower tier of FIG. 22.

As described above, during the rest stage, a relatively large negative pressure (about −120 mmAq) is applied to the print head to make the ink system stable against environmental changes. During the pre-printing standby stage, the ink supply is started immediately before the start of the printing operation as shown at the middle tier of FIG. 22. Performing such a control immediately before starting the printing operation can secure a sufficient ink supply performance immediately after the start of the printing operation, enhancing the print quality.

Next, in "Duty1" during the printing stage, the negative pressure in the print head rises the moment the printing operation is started, so the pump flow is increased according to the detected value of the pressure sensor 49 to reduce the negative pressure in the print head to enhance the ink supply performance. Considering the negative pressure rise in the print head at the start of the printing operation, the pump 36 and the valve 35 may be controlled from just before the start of the printing operation to further stabilize the negative pressure in the print head. In that case, the amount of control and the control timing for the pump 36 and the valve 35 can be set according to the print duty determined from the print data.

In "Duty2" the print duty rises further, so the pump flow is further increased to minimize an increase in the negative pressure applied to the print head. This enables the ink supply to follow a high printing speed. When the print duty changes, the pump flow is controlled from a point in time before that change occurs, to further stabilize the negative pressure in the print head. In that case, the print duty before or after the change is determined from the print data and, based on the print duty, the control amount and the control timing for the pump 36 and the valve 35 can be set.

Similarly, in "Duty3" and "Duty4" the negative pressure of ink supplied to the print head is positively controlled according to the respective print duties and the detected value of the pressure sensor 49 to stabilize the negative pressure in the print head at an optimum level at all times. As a result, the responsiveness and stability of the ink supply are enhanced, allowing a high quality image to be printed regardless of the magnitude of the print duty.

If, immediately after the printing operation is ended, the negative pressure in the print head tends to decrease due to the ink inertia, it is desired that the pump flow be controlled from just before the end of the printing operation so as to cancel the negative pressure reduction. This can further stabilize the negative pressure in the print head. Further, by closing the valve 35 immediately after the printing operation, the reduction in the negative pressure in the print head can be minimized.

After the printing operation, a relatively large negative pressure is applied again to the print head to maintain the stability against environmental changes. That is, by increasing the negative pressure in the print head, an ink leakage can be prevented which would otherwise occur from the nozzles of the print head when there are environmental changes, such as temperature changes, thereby improving the reliability of the printing apparatus.

Here, the control of the pump motor 508 using an output of the pressure sensor 49 as a feedback signal will be explained by referring to FIG. 23, FIG. 24A and FIG. 24B.

Figure 23:
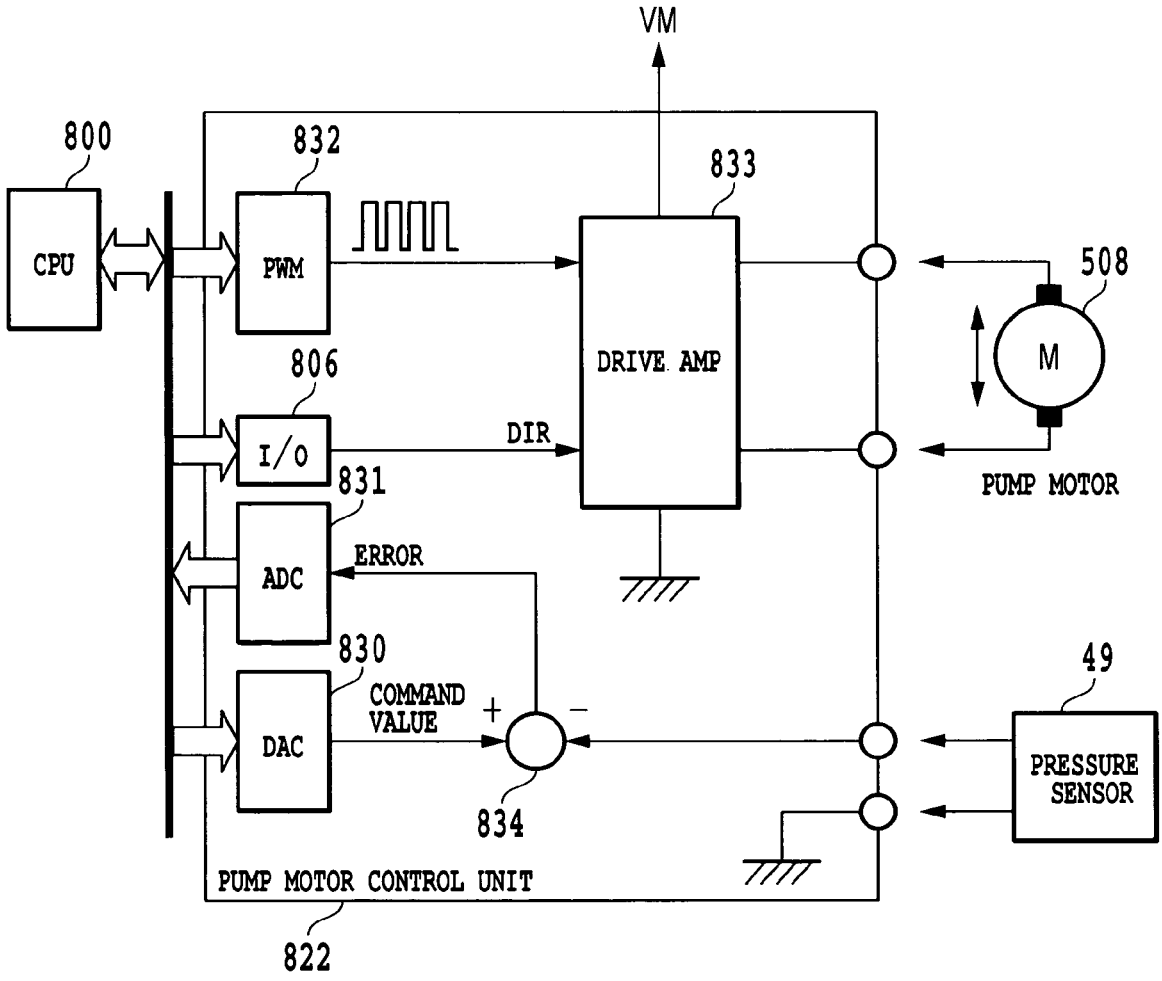
FIG. 23 is a diagram showing electrical blocks involved in a negative pressure control using a pressure sensor output and a pump control using a PWM chopper in the embodiment of this invention.

FIG. 23 is a block diagram of the pressure control system showing details inside the pump motor controller 822 explained with reference to the block diagram of FIG. 3 of the printer unit. The pump motor controller 822 feeds back the output of the pressure sensor 49 to control the pump motor 508 which is a servo motor.

When the printing operation is started, the CPU 800 writes a digital value representing a small negative pressure (e.g., about −10 mmAq) into a DA converter 830 which in turn supplies an analog demand value corresponding to the negative pressure to a (+) input of a subtractor 834. The output of the pressure sensor 49 installed near the print head 811 is fed to a (−) input of the subtractor 834 and a difference signal (Error) is fed to an AD converter 831, whose converted digital value is read by the CPU 800. The CPU 800, according to the error signal including a polarity, outputs a signal (DIR) specifying a rotation direction of the mechanical pump 36 to a drive AMP 833 that controls the pump motor 508 of the mechanical pump 36 and also sets a PWM (Pulse Width Modulation) value representing a drive duty of the drive AMP 833 in a PWM circuit 832.

Figure 24A:
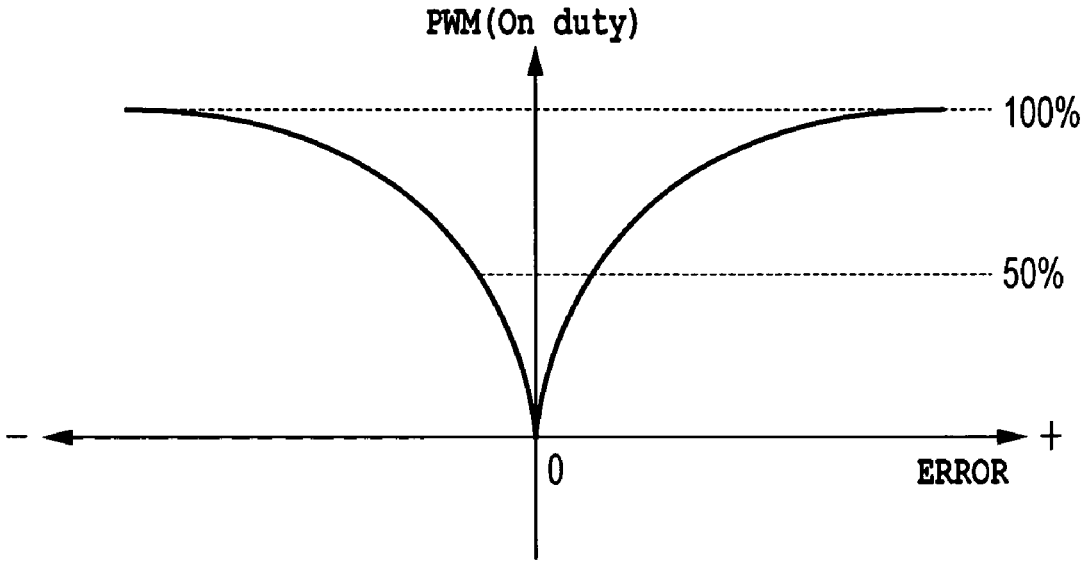
FIG. 24A is a conversion table representing a relation between an AD converter reading and a PWM value in the embodiment of this invention.
Figure 24B:
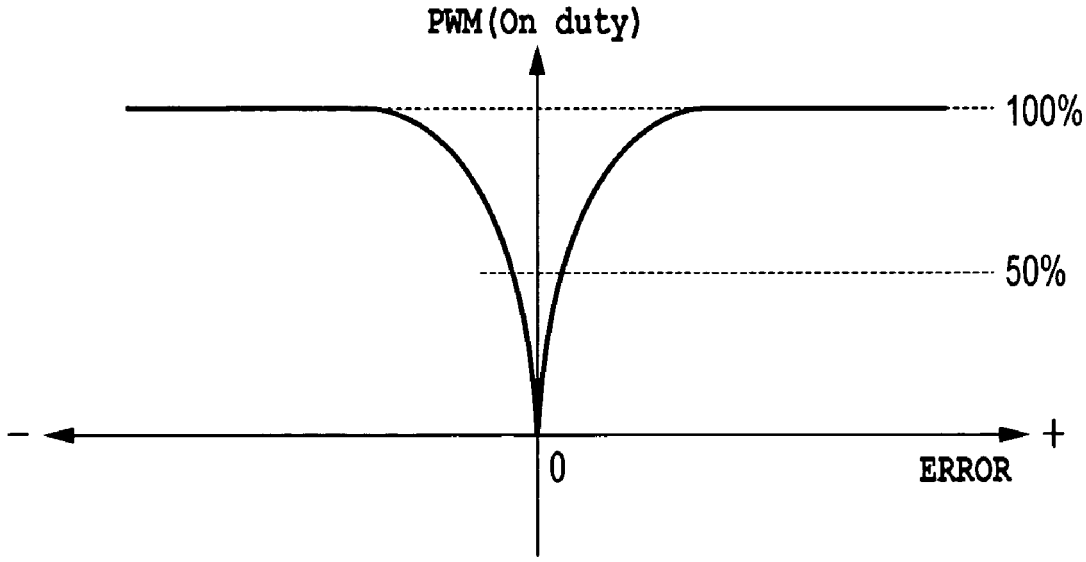
FIG. 24B is a conversion table representing the relation between an AD converter reading and a PWM value in the embodiment of this invention.

A conversion table between the reading of the AD converter 831 and the PWM value is shown in FIG. 24A. When the difference signal (Error) has a (+) polarity, the rotation direction signal (DIR) is set through an output port (I/O) 806 to a value (e.g., "1") representing a forward rotation (in a direction that pressurizes the interior of the print head 811). If the difference signal (Error) is of a (−) polarity, the rotation direction signal (DIR) is set to a value (e.g., "0") representing a reverse rotation (in a direction that reduces the inner pressure of the print head 811).

When the absolute value of the difference signal (Error), the output of the subtractor 834, is large, the drive duty of the drive AMP 833 that drives the pump motor 508 is increased to quickly establish the desired pressure. When on the other hand the absolute value of the difference signal (Error) is small, the drive duty of the drive AMP 833 is lowered to suppress pressure overshoot and undershoot.

If the valve 35 is used as an auxiliary control means though not shown in the figure, a light valve capable of high-speed response is preferably selected.

During printing, the negative pressure command value set in the subtractor 834 is not necessarily a constant value. The CPU 800 reads the content of the VRAM 801 to estimate a print duty from the number of pixels to be printed. If the print duty exceeds a predetermined value and a fall in the negative pressure in the print head 811 is expected, a high pressure command value for a point in time immediately before the negative pressure fall may be set in the DA converter 830 in advance.

By using a feedforward control in combination as described above, the stability of printing operation of the print head 811 is improved significantly. In this case, because the negative pressure may fall due to a control delay, it is possible to provide a separate PWM value conversion table with a high gain (AMP gain) for the pressure difference (Error), as shown in FIG. 24B. The PWM value conversion tables shown in FIG. 24A and FIG. 24B are stored in the ROM 803 in advance.

Figure 25A:
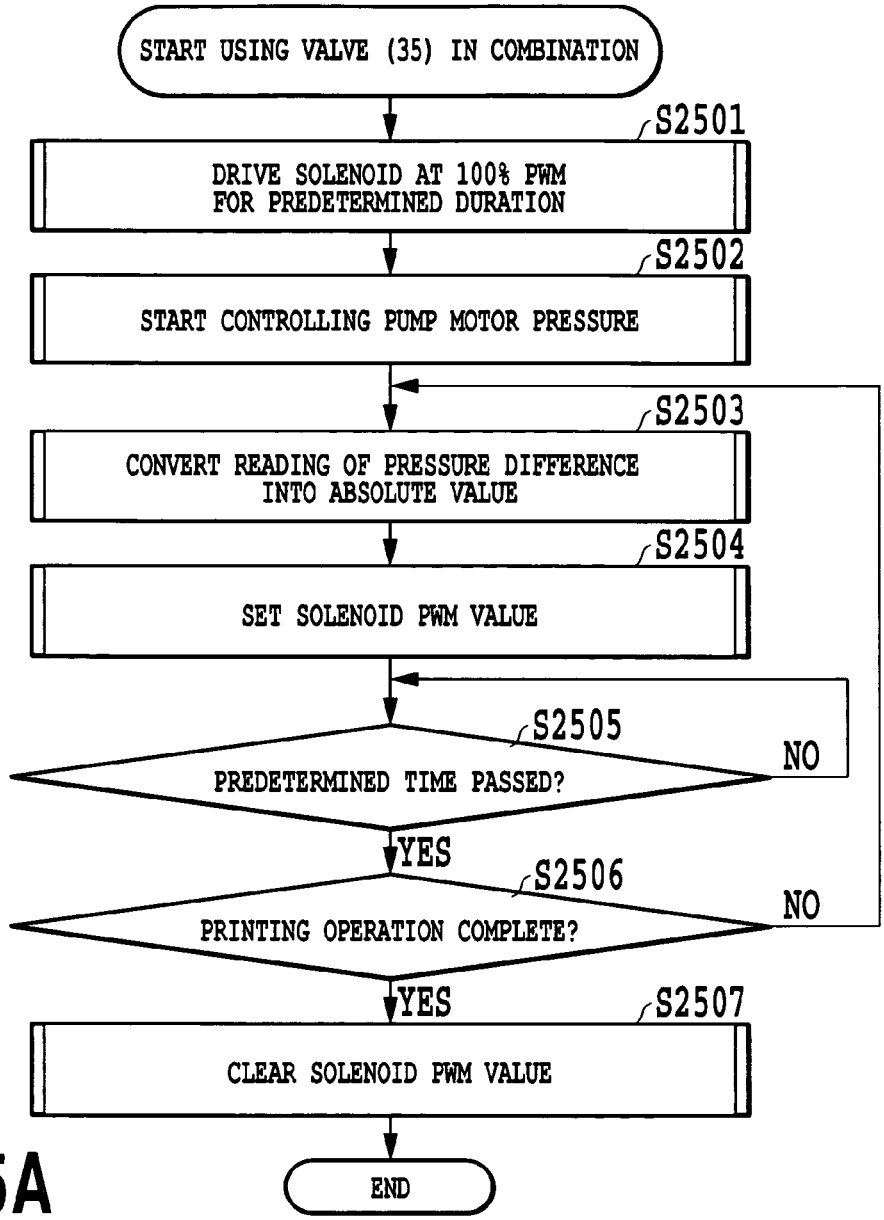
FIG. 25A is a pressure control flow chart when a valve is used in combination in the embodiment of this invention.

Further, other than the method using the adjustment of the gain (AMP gain) for the pressure difference (Error), a pressure control method involving the parallel control of the valve 35 may be performed. The operation flow of CPU 800 using this method will be explained by referring to FIG. 25A. In the normal state (solenoid: off), the valve 35 is open as shown in FIG. 12A. First, for a predetermined duration the PWM value of the PWM circuit 823 for driving the solenoid 821 (see FIG. 3) is set to 100% and the plunger of the solenoid 821 is started to move (step S2501). Then, the servo control of the pump motor 820 is also started. From this point forward, the pump motor controller 822 performs the feedback control intermittently according to the preset pressure value in the DA converter 830 (see FIG. 23) (step S2502). At this point, the pump motor controller 822 may already be executing the control.

Figure 25B:
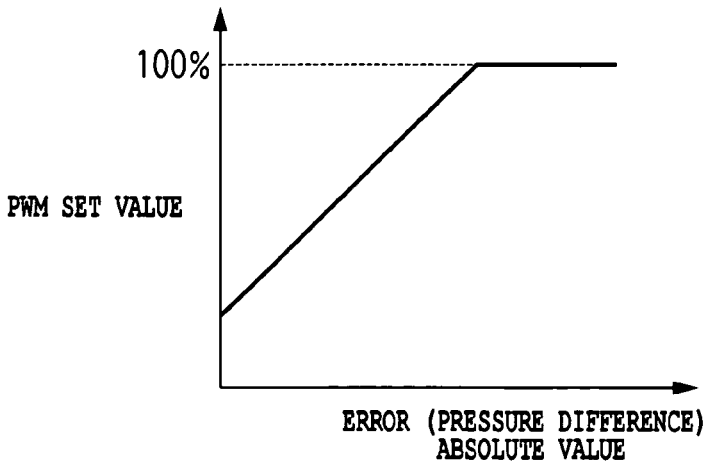
FIG. 25B is a PWM value conversion table for driving a solenoid that operates the valve.

Next, the CPU 800 reads the output of the pressure sensor 49 and converts it into an absolute value (step S2503). Based on the absolute value of the converted pressure difference, the CPU 800 reads a drive PWM value of the solenoid 821 from the conversion table of FIG. 25B and sets it in the PWM circuit 823 (step S2504). If the pressure difference is large, the valve 35 comes close to an open state. If the pressure difference decreases, the valve 35 approaches a closed state. That is, as in the example that was already explained by referring to FIG. 24A and FIG. 24B, the similar effect to that of the gain adjustment of the drive AMP 833 can be realized by the control of the valve 35. That is, when the pressure difference is large, the valve 35 is controlled to approach the set value quickly; and as the pressure difference decreases, it is controlled to prevent an overshoot or undershoot from the predetermined pressure.

The above processing is continually repeated every predetermined period (step S2505). When the printing operation is completed (step S2506), the drive PWM value of the solenoid 821 is cleared to zero (step S2507) before ending the processing.

Second Embodiment

FIG. 26 through FIG. 36 shows a second embodiment of this invention, and components identical with those of the preceding embodiment are given like reference numbers and their explanations are omitted.

This embodiment concerns an example case in which an apparatus of this invention is incorporated in the image forming system of FIG. 1 and FIG. 2. Thus, the outline of the image forming system in this embodiment is similar to that of the preceding embodiment.

(Control System in Printer Unit)

Figure 26:
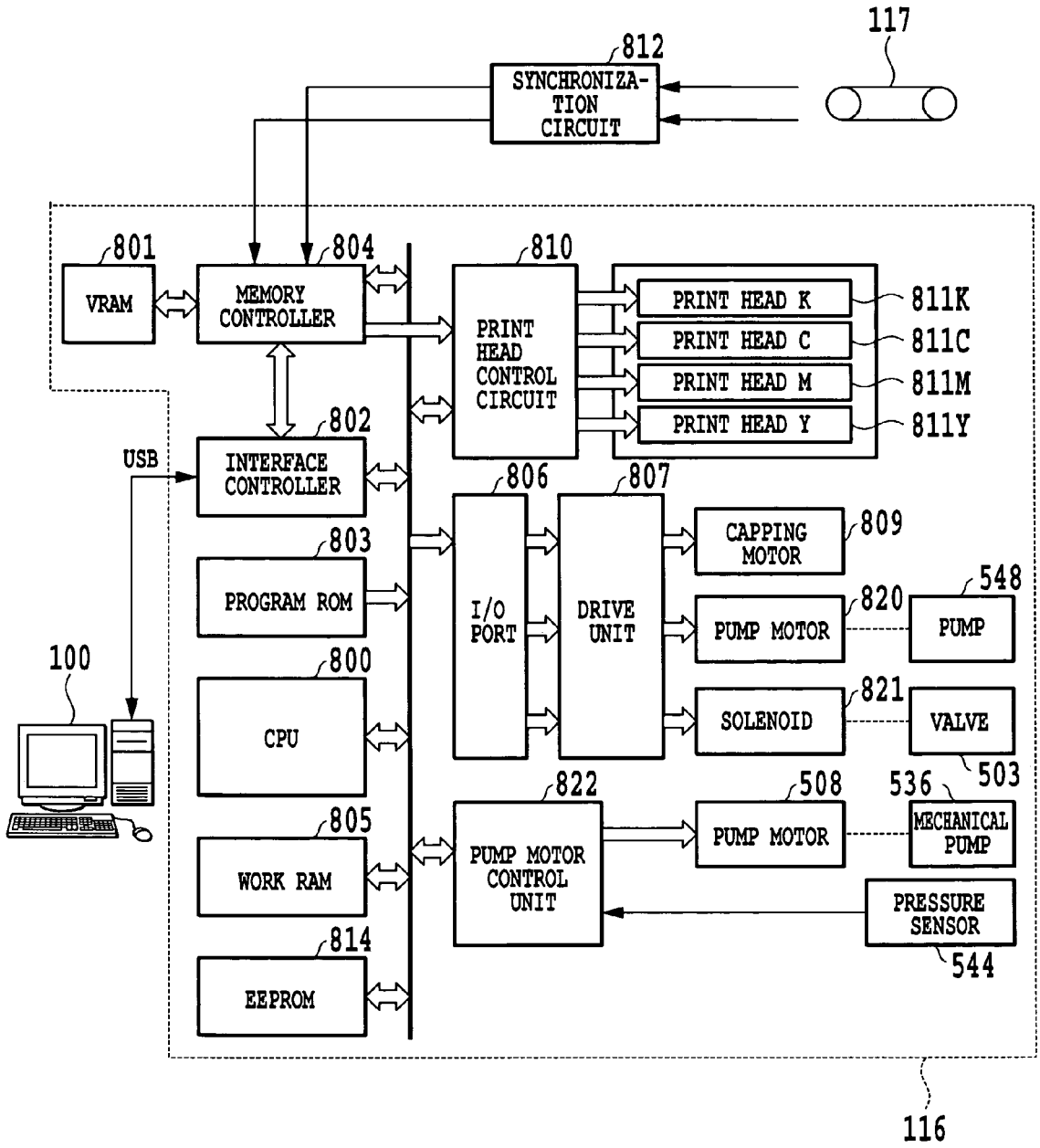
FIG. 26 is a block diagram showing a control system of a printing apparatus in a second embodiment of this invention.

FIG. 26 shows an example configuration of the control system in each printer unit 116. Components similar to those of the preceding embodiment are assigned like reference numbers and their explanations are omitted.

The pump motor 820 in this example is capable of forward and reverse rotation and drives a pump 548 (see FIG. 27) described later which is built into one end of the ink path of the print head 811 (811Y, 811M, 811C and 811K). The solenoid 821 in this example is an actuator to open and close a valve 503 (see FIG. 27) interposed between the print head 811 and the subtank described later.

The pump motor 508 is a servo motor capable of forward and reverse rotation and which drives the pump 536 (see FIG. 27) interposed between the print head 811 and the subtank described later. The pump motor 508 is servo-controlled by the pump motor controller 822 which is given a feedback of an output of a pressure sensor 544 that detects the pressure in the print head 811.

A set of pump motors 820, 508, valve control solenoid 821 and pressure sensor 544 is provided independently for each of the print heads 811Y, 811M, 811C and 811K dedicated for different ink colors. The print heads 811Y, 811M, 811C and 811K can be moved vertically by the print head U/D motor not shown and are airtightly capped at the capping position while they are standing by except during the printing operation.

The medium transport device 117 in this embodiment is constructed in the same way as in FIG. 2 and its control system is constructed in the same way as in FIG. 4. Therefore, the construction of the medium transport device and its control system in this embodiment are similar to those of the preceding embodiment. The signal system and ink system for the image forming system and the printer composite system in this embodiment are similar to those shown in FIG. 5, FIG. 6 and FIG. 7. Therefore, the outline operation of the image forming system, the signal system to the printer composite system and the outline of the ink system in this embodiment are similar to those of the preceding embodiment.

(Example Construction of Ink System)

Figure 27:
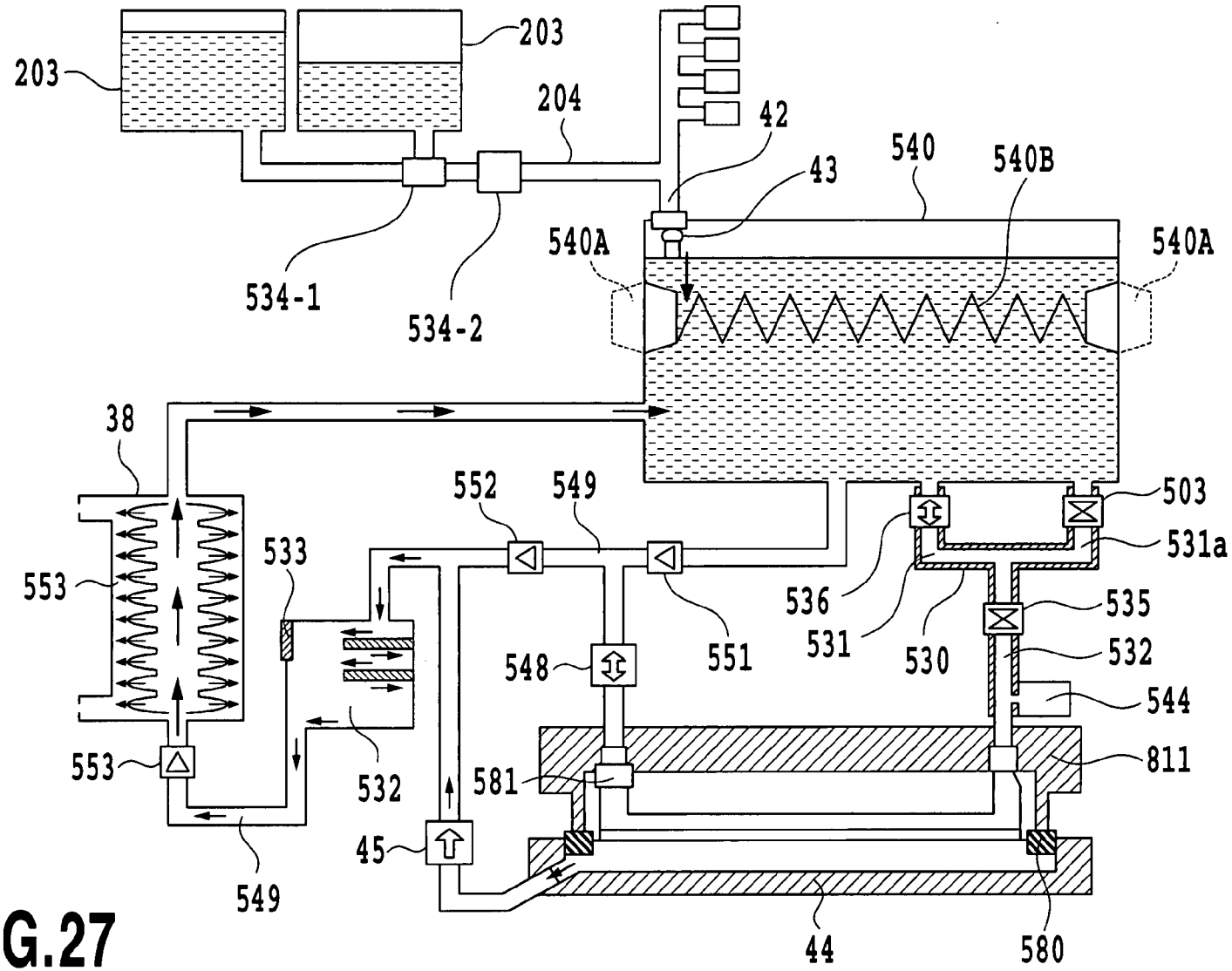
FIG. 27 is a schematic diagram showing an ink system for one print head in the printing apparatus of FIG. 26.

The positional relation among the essential parts of the ink system for one print head is the same as that of FIG. 8 in the preceding embodiment. FIG. 27 shows an example inner construction of the ink system for one print head. The print head 811 is connected with two ink tubes, one of which forms an ink supply path 530 that supplies ink to the print head and maintains and controls a preferable negative pressure. The other ink tube constitutes an ink path 550 that is connected to the ink supply unit (also referred to as a subtank) 540 for each print head 811 through a pump 548 and a one-way valve 551.

The print head 811 used in this embodiment is constructed, for example, in the same way as in FIG. 10.

Figure 28:
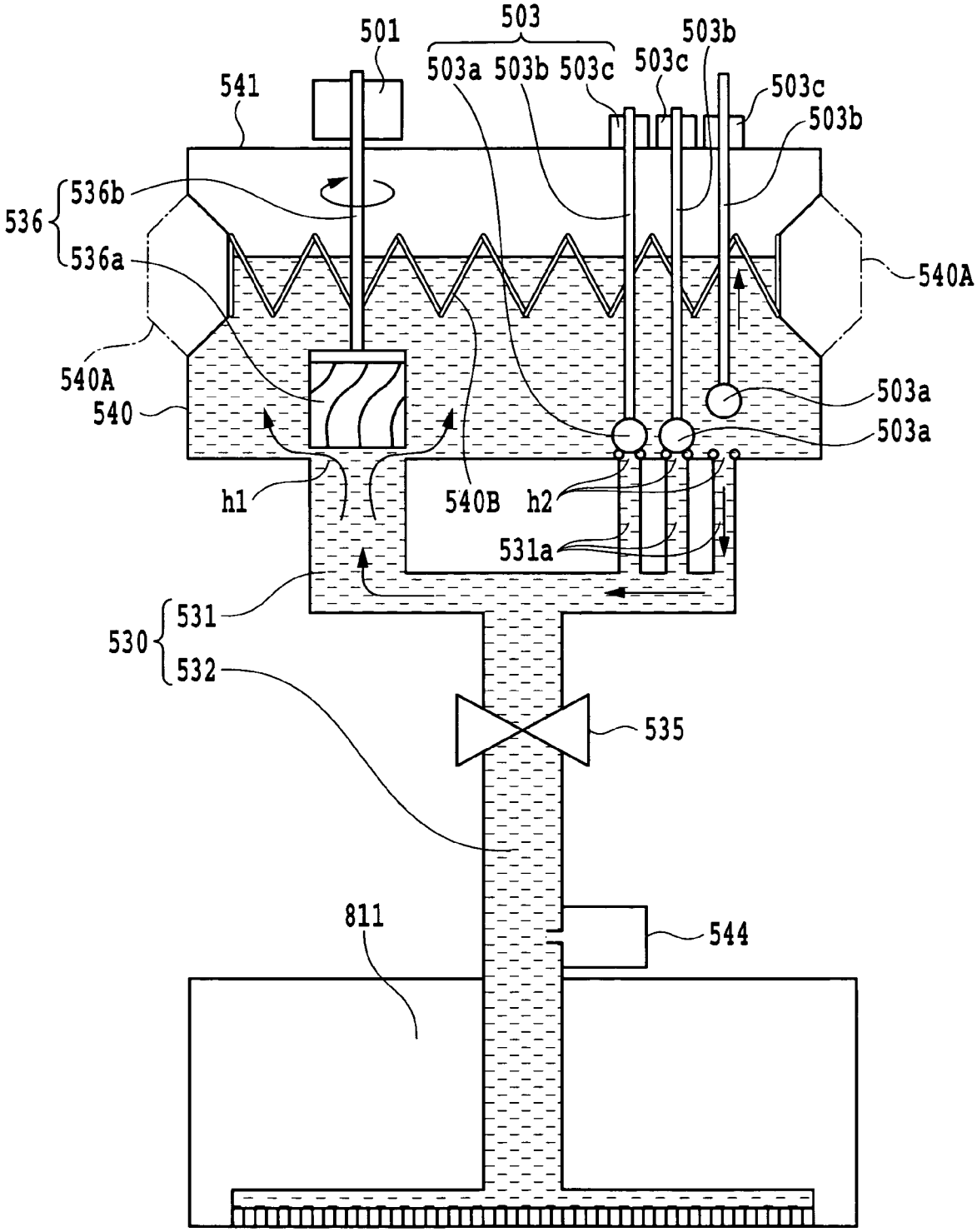
FIG. 28 is a schematic diagram showing an ink supply path connecting the print head and the ink tank of FIG. 27.
Figure 29:
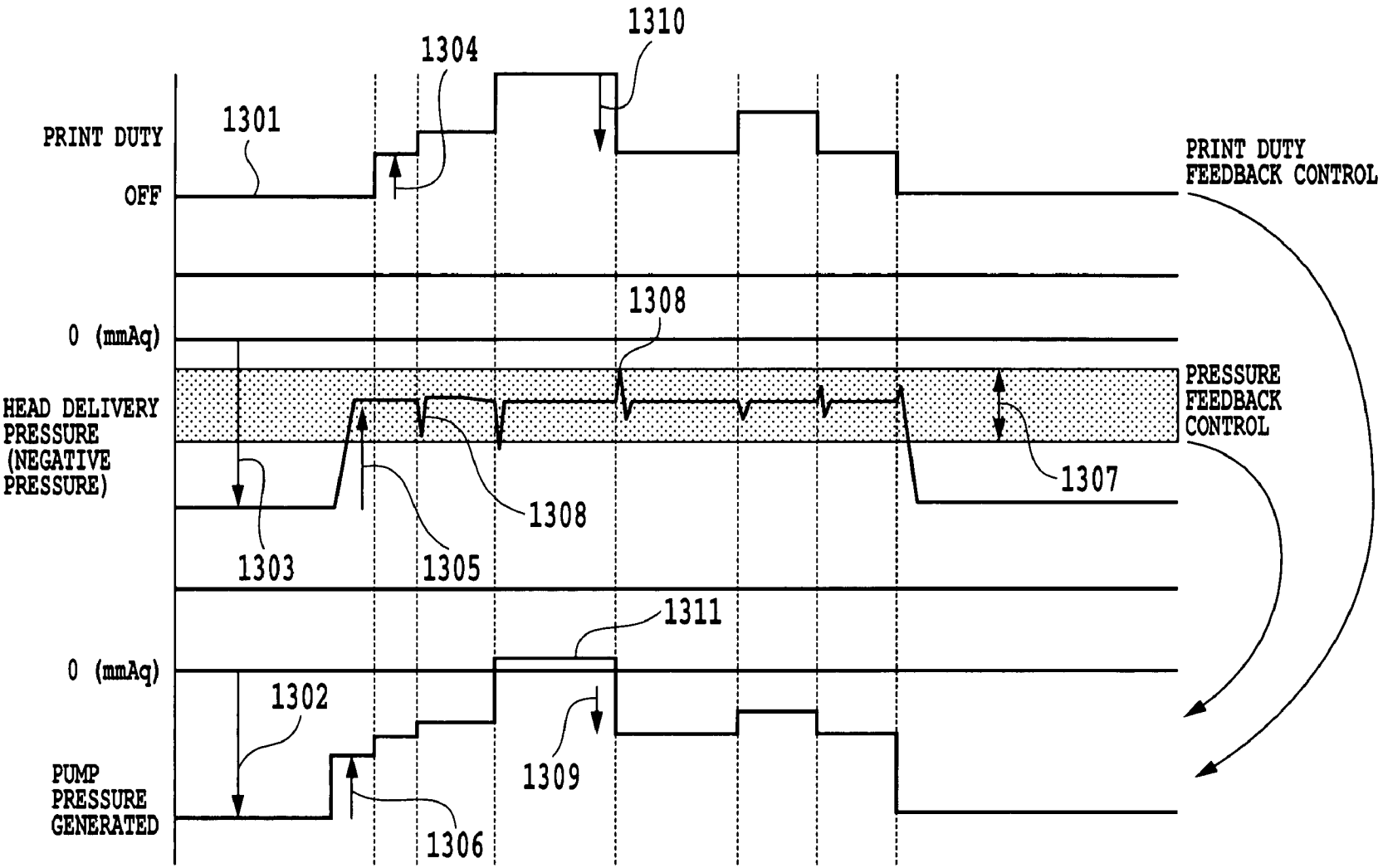
FIG. 29 is a time chart showing an operation of the ink system of FIG. 27.

FIG. 28 shows the construction of the ink supply path 530 connecting the print head 811 to the ink tank, and of a negative pressure generation means provided to the ink supply path 530. In FIG. 28, the ink supply path 530 comprises a circulation path 531 whose ends communicate with two different locations at the bottom of the subtank 540 and a connecting path 532 connecting the print head 811 to a middle part of the circulation path 531. In the connecting path 532 there is provided a pressure adjust valve 535 that permits and interrupts an ink flow.

In the subtank 540 is installed a pressure adjust pump 536 to circulate ink through the circulation path 531. The pressure adjust pump 536 in this example is an axial flow pump and comprises a rotating shaft 536*b* rotated forwardly or backwardly by a motor 501 mounted on the top surface of the subtank 540 and an impeller 536*a* secured to the rotating shaft 536*b*. The impeller 536*a* is installed near an opening h1 of the subtank 540 that communicates with one end of the circulation path 531. The impeller 536*a* rotates forwardly to draw ink from the circulation path 531 through the opening h1 into the subtank 540 to circulate the ink in the direction of arrow in the figure. The impeller 536*a* rotates backwardly to deliver ink from the subtank 540 through the opening h1 into the circulation path 531.

At the other end of the circulation path 531 is installed a flow adjust valve (flow resistance adjust means) 503 to adjust the ink volume that flows between the subtank 540 and the circulation path 531. In this example, the second end of the circulation path 531 branches into three divided paths 531*a*. A total of three openings h2 of the subtank 540 that communicate with the branched paths 531*a* are opened and closed by ball valve discs 503*a* as they advance and retract to and from the openings. The advancing and retracting operation of the ball valve discs 503*a* is performed by solenoids 503*c* that move shafts 503*b* of the valve discs 503*a* back and forth. By selectively opening and closing the three openings h2 by the valve discs 503*a*, an overall area of the openings h2 of the subtank 540 communicating with the second end of the circulation path 531 can be changed stepwise (in this example, in three steps) Changing the area of the openings h2 can adjust the ink flow resistance between the circulation path 531 and the subtank 540. In this embodiment, the ink flow control means comprises the pressure adjust pump 536, the flow adjust valve 503 and the CPU 800 as a controller that controls them.

Then, the impeller 536*a* is rotated forwardly by the motor 501 to cause the ink to flow in the circulation path 531 in the direction of arrow to generate a negative pressure in the connecting path 532. The magnitude of the negative pressure corresponds to the ink flow velocity running in the circulation path 531 in the direction of arrow and increases as the flow velocity increases. This negative pressure is applied to the print head 811. Therefore, the negative pressure applied to the print head 811 can be controlled by adjusting the ink flow speed in the circulation path 531 by performing at least one, or preferably both, of the control of the forward rotation speed of the pressure adjust pump 536 and the control of the area of the openings h2 by the flow adjust valve 503. The higher the forward rotation speed of the pressure adjust pump 536 and the smaller the area of the openings h2, the greater the negative pressure generated will become.

When the impeller 536*a* is reversed by the motor 501, an ink flow in a direction opposite the arrow is produced in the circulation path 531, generating a positive pressure in the connecting path 532. As described later, in controlling the negative pressure applied to the print head 811, such a forward and backward rotation control of the pressure adjust pump 536 can be used positively. In that case, as the reverse rotation speed of the pump 536 increases and the area of the openings h2 decreases, the positive pressure produced increases.

In the connecting path 532 there is installed a pressure adjust valve 535 that can permit and interrupt the ink flow. The pressure adjust valve 535 may use a construction similar to what was shown in FIG. 12A and FIG. 12B.

The valves installed in various parts of the ink supply path, including the valves 535 and 503, need only be able to properly open and close the flow path or properly control the ink flow in response to a control signal and may have any desired construction in addition to those shown in FIG. 28 and FIG. 12A. As for the valve 503, it is effective to use a lightweight device such as a piezoelectric device as an actuator to realize a high-performance negative pressure control with high response.

The pumps installed in various parts of the ink supply path, including the pressure adjust pump 536, need only be able to deliver ink in response to a drive signal and may have any desired construction. It is preferred, however, that the pump 536 be able to change the ink flow direction and also to cooperate with the flow adjust valve 503 to adjust the ink flow with small pressure variations.

In this example, the pump 536 used is of a constant pressure axial flow type that is driven by a motor (not shown) capable of controlling its rotation direction and rotation speed. As described above, when the pump 536 is driven forwardly, an ink flow is produced in a direction that draws ink from the connecting path 532, i.e., applies a negative pressure to the connecting path 532. When the pump is reversed, an ink flow is produced in a direction that supplies ink to the connecting path 532, i.e., applies a positive pressure to the connecting path 532. As the pump 548 a gear pump may be used. In the following description, the rotation of the pump 536 that produces an ink-flow applying a negative pressure to the print head 811 is called a forward rotation and the rotation that produces an ink flow applying a positive pressure to the print head 811 is called a backward or reverse rotation.

As shown in FIG. 27 and FIG. 28, the subtank 540 has a pair of opposing movable members 540A made of a resilient material and a compression spring 540B interposed between them. Expansion and compression of this spring 540B suppresses sharp pressure variations in the subtank 540.

Near the print head 811 is installed a pressure sensor 544 to detect a pressure in the connecting path 532. The CPU 800 reads an output of the pressure sensor 544 and, as described later, feedback-controls (or feedforward-controls) the pump 536 that is rotatable in both directions to adjust the pressure in the print head 811 to a desired value.

In the subtank 540 is installed a pressure sensor not shown, which detects when the ink in the subtank decreases and the inner pressure falls below a predetermined level so that the ink can be supplied automatically from the main tank 203.

Two main tanks 203 are provided for each ink color. One of them is selected by a direction control valve 534-1 and the ink can be supplied from the selected ink tank 203 through a tube 204 into the subtank 540 by driving a pump 534-2. The joint 42 connecting the tube 204 and the subtank 540 may have a similar construction to those shown in FIG. 14A and FIG. 14B.

In addition to the appropriate connection and disconnection of joints as described above to enable or disable the fluid communication, it is possible to have the ink supply paths themselves connected at all times and to establish the fluid communication in an on/off fashion by means of an open-close valve. What is required is that, when the ink volume required differs among the printer units depending on the contents of the divided image data, the ink supply operation in one printer unit does not interfere with that of another printer unit. In this respect, the independence of the individual printer units in this embodiment is assured.

The ink tank 203 (203Y, 203M, 203C, 203K) connected to the joint 43 may have a construction similar to that shown in FIG. 15A and FIG. 15B.

Now, let us return to FIG. 27.

The ink can be circulated as follows through the other tube connected to the print head 811.

With the ink flow adjust valve 503 open, the pump 548 is rotated in a direction that draws ink from the print head 811, circulating the ink from the subtank 540 through the pump 536, valve 535, print head 811, pump 548, valve 552, bubble elimination chamber 532 and deaeration system 38 and back into the subtank 540. As the ink is circulated along this path, gases in the ink are removed by the deaeration system 38. In this operation, if the pump 536 is not operated, there is no problem in terms of performance. During this operation, because of the flow resistance of the filter 581, ink though small in volume is discharged from the print head 811 into the ink receiver in the cap 44.

As a constitutional element of the recovery system intended to keep the ink ejection performance of the print head in good condition or recover the normal ejection performance, the cap 44 is provided in the printer unit. During the printing operation, the cap 44 is retracted from the nozzle-formed surface of the print head 811 to avoid interference with the printing operation. During the standby for printing operation or when a recovery operation of the print head 811 is needed, the nozzle-formed surface is hermetically capped.

Next, a pressurization-based recovery operation to restore a sound ink ejection performance of the print head 811 will be explained.

With the print head 811 capped with the cap 44, the valve 535 is closed and then the ink collecting suction pump 45 is started to suck out ink from the cap 44. Denoted 580 is a seal portion that comes into hermetic contact with the print head 811.

Next, the pump 548 is operated to pressurize the ink toward the print head 811. Since the valve 535 is closed, the interior of the print head 811 is rapidly pressurized, forcibly discharging a relatively large amount of ink from the nozzles, restoring the nozzles of the print head 811 to a sound state. The discharged ink is quickly collected by the already running pump 45 and is deaerated by the deaeration system 38 and returned to the subtank 540. The deaeration system 38 may have the same construction as shown in FIG. 13.

The drive signals for the pumps and valves and the sensor output are transferred to and from the control unit including the CPU 800 and I/O port 806.

Next, the operation of the ink supply device in this embodiment will be explained. First, from the viewpoint of the print duty of the print head 811 and the pressure acting on the print head, the operation of the ink system will be described by referring to FIG. 29. During a non-ejection state 1301 in which the print head 811 does not eject ink, the pump 536 is operated forwardly to generate a predetermined negative pressure as indicated at 1302 to maintain the interior of the print head at a relatively large negative pressure as shown at 1303. Before the ink ejection from the print head is started (at 1304), the negative pressure produced by the pump 536 being rotated forwardly is reduced to approach the atmospheric pressure (0 mmAq) as indicated at 1306. That is, the forward rotation speed of the pump 536 is lowered so as to reduce the negative pressure in the print head to an optimum negative pressure range (ejection permissible range 1307).

Once the printing operation is started, the pressure generated by the pump 536 is controlled according to changes in the print duty to adjust the negative pressure applied to the print head 811 and thereby mitigate negative pressure changes in the print head caused by ink ejection to keep the negative pressure in a preferable ejection permissible range 1307. The pressure generated by the pump 536 is adjusted by controlling the pump 536 and the flow adjust valve 503, as described above, to adjust the negative pressure applied to the print head 811.

In the following, a case of adjusting the negative pressure in the print head by controlling the pump 536 will be explained. The negative pressure in the print head 811 can also be adjusted by the control of the flow adjust valve 503 or by a combined control of the valve 503 and the pump 536.

The negative pressure in the print head 811 tends to increase as the print duty increases. So, the forward rotation speed of the pump 536 is reduced according to the print duty to keep the negative pressure in the print head 811 within an optimum ejection permissible range 1307. When the print duty is extremely high, i.e., the tendency for the negative pressure in the print head 811 to increase is strong, if the reduction in the forward rotation speed of the pump 536 fails to prevent the negative pressure in the print head from becoming too large, the pump 536 is reversed to produce a positive pressure as indicated at 1311 and thereby lower the negative pressure in the print head 811 to the ejection permissible range 1307. Further, when the print duty decreases as indicated at 1310, the pump 536 is rotated forwardly to return the generated pressure to the negative pressure (as indicated at 1309) to prevent a reduction in the negative pressure in the print head 811 which would otherwise be caused by the inertia force of the ink flowing from the subtank 540 toward the print head 811.

By controlling the pump 536 based on the print duty as described above, the negative pressure in the print head 811 can be maintained within the preferable ejection permissible range 1307. When changing the rotation speed and rotation direction of the pump 536, there is some delay in the negative pressure control response with respect to a print duty change, resulting in small irregular pressure changes (at 1308). This level of pressure variations, however, has almost no effect on the formation of an image. It is also possible to detect such small pressure changes by the pressure sensor 544 installed near the print head 811 and, based on the result of detection, control the pump 536 or the pressure adjust valve 535 to alleviate such small pressure variations.

Figure 30:
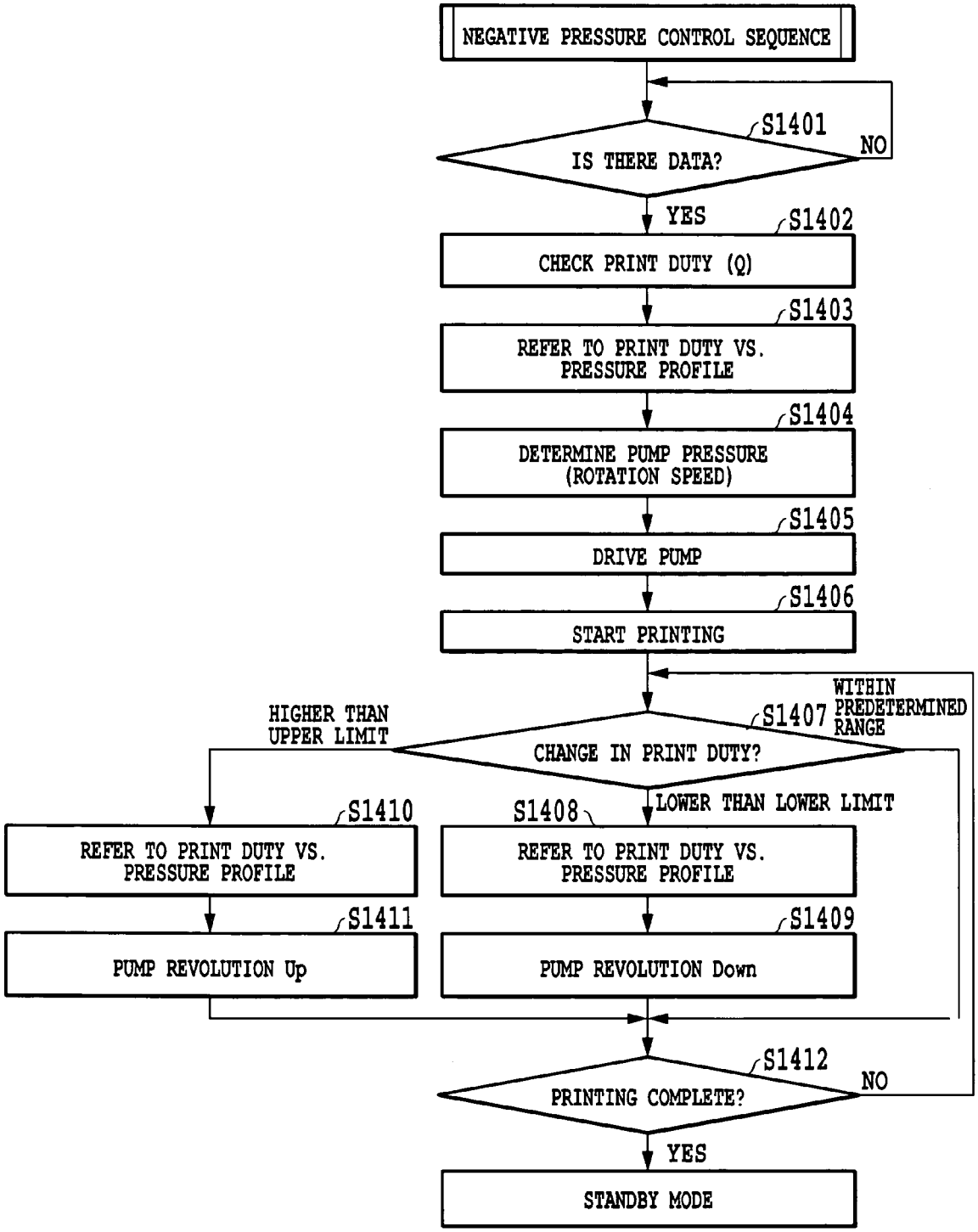
FIG. 30 is a flow chart showing an example control sequence for the ink system of FIG. 27.

FIG. 30 shows an example pressure control procedure in this embodiment. In the control system configuration for the printer unit shown in FIG. 3, this procedure can be executed by the CPU 800 according to the program stored in the ROM 803.

First, a check is made to see if there is print data (step S1401) and, if so, a print duty per unit print area is determined (step S1402). In the printer unit (e.g., EEPROM 804), a print head pressure change profile with respect to a print duty is set beforehand. By referring to the profile (step S1403), a pressure set value for the pump 536 that matches the print duty is determined (step S1404). Then, based on the pressure set value, the pump 536 is controlled to adjust the pressure in the print head within the ejection permissible range 1307.

When the printing operation is started (step S1406), a check is made as to whether the print duty per unit print area has changed more than a predetermined amount from the print duty from which the current pressure set value was determined (step S1407). If the print duty has changed more than the predetermined amount, the print duty vs. print head pressure change profile is referred to again and the setting of the pressure to be generated by the pump 536 is changed (step S1407, S1411). That is, if the print duty rises above an upper limit of the predetermined range, the negative pressure in the print head tends to increase. So, the forward rotation speed of the pump 536 is lowered or the pump is reversed in order to keep the negative pressure in the print head within the ejection permissible range 1307. Conversely, if the print duty falls below a lower limit of the predetermined range, the negative pressure in the print head tends to decrease. So, the forward rotation speed of the pump 536 is increased or the reverse rotation speed lowered in order to maintain the negative pressure in the print head within the ejection permissible range 1307. This control is repeated until the printing operation is finished (step S1412), after which the control sequence moves to a standby mode.

The above control may be realized, rather than by using software processing, but by hardware configuration which comprises a counter to count the number of bits of image data and a means to control the motor to drive the pump 536 according to the count value. Further, instead of performing the control when the print duty changes as the printing operation proceeds, it is also possible to determine a pump control curve based on the print data in advance and perform a feed-forward control on the pump according to the control curve. Further, based on an output of a means that detects an actual pressure in the print head (if the pressure in the subtank 540 can be deemed practically equal to the print head pressure, the pressure sensor 544 may be used), a local feedback loop control may be performed on the pump.

Next, in each of stages ranging from shipping a manufactured ink jet printing apparatus from a factory to the use of the apparatus by the user, we will explain about the setting performed on the ink supply device and its operation by referring to FIG. 31 to FIG. 36.

Preparation for Shipping

Figure 31:
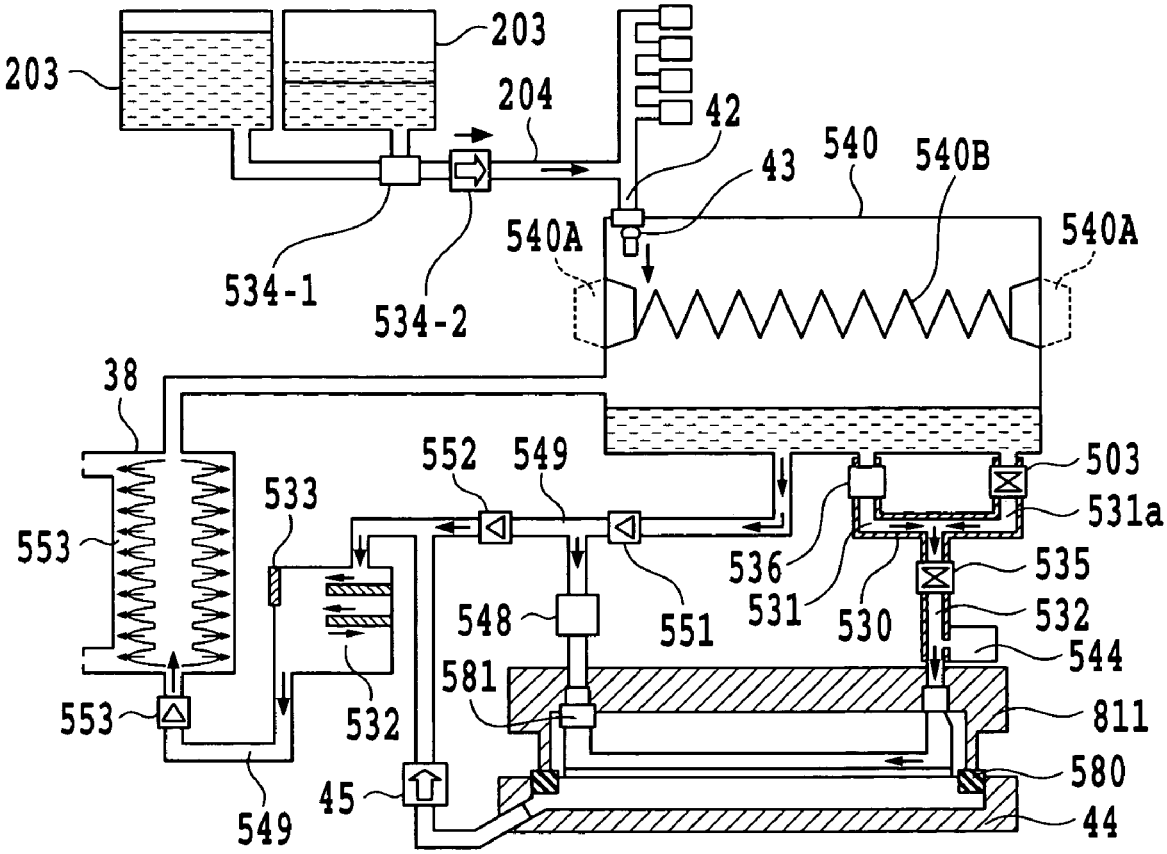
FIG. 31 is a schematic diagram showing an operation of filling ink into the ink system of FIG. 27 at time of shipping.
Figure 32:
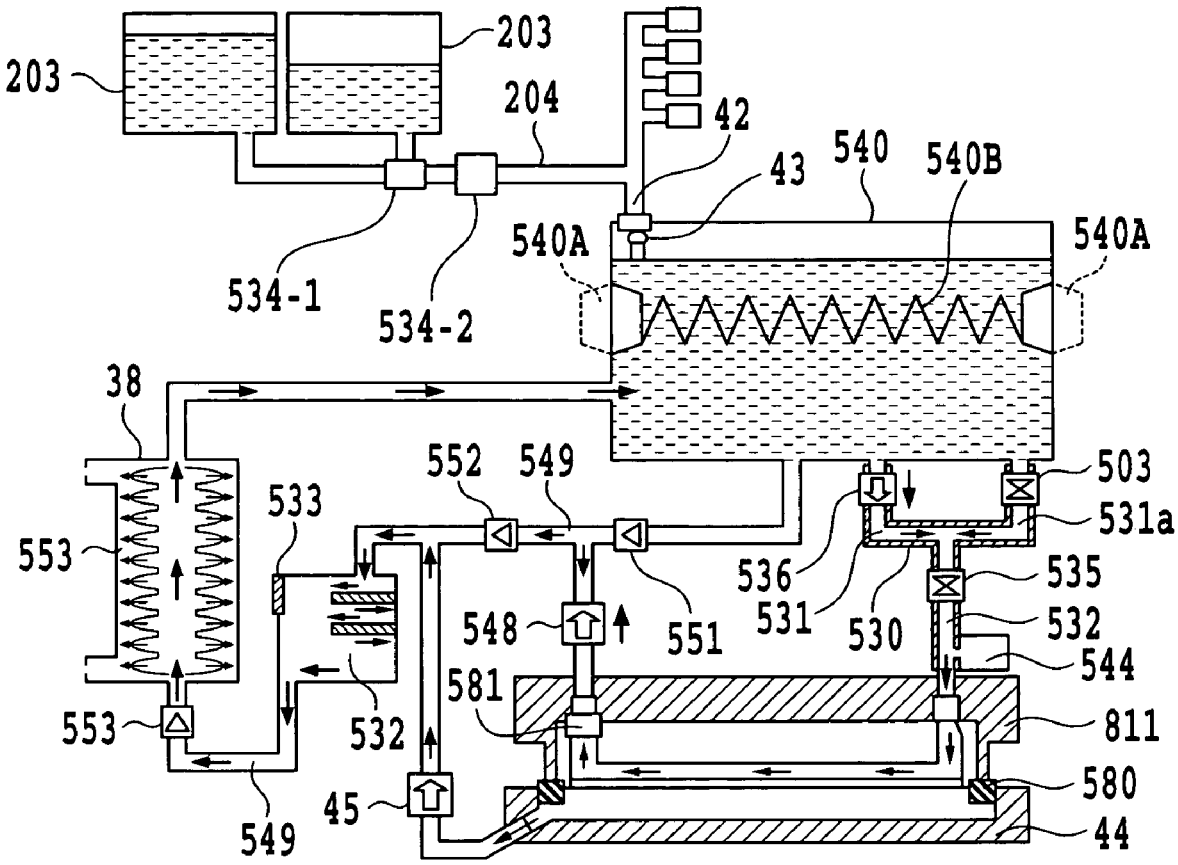
FIG. 32 is a schematic diagram showing an operation of deaerating the ink system of FIG. 27 at time of shipping.
Figure 33:
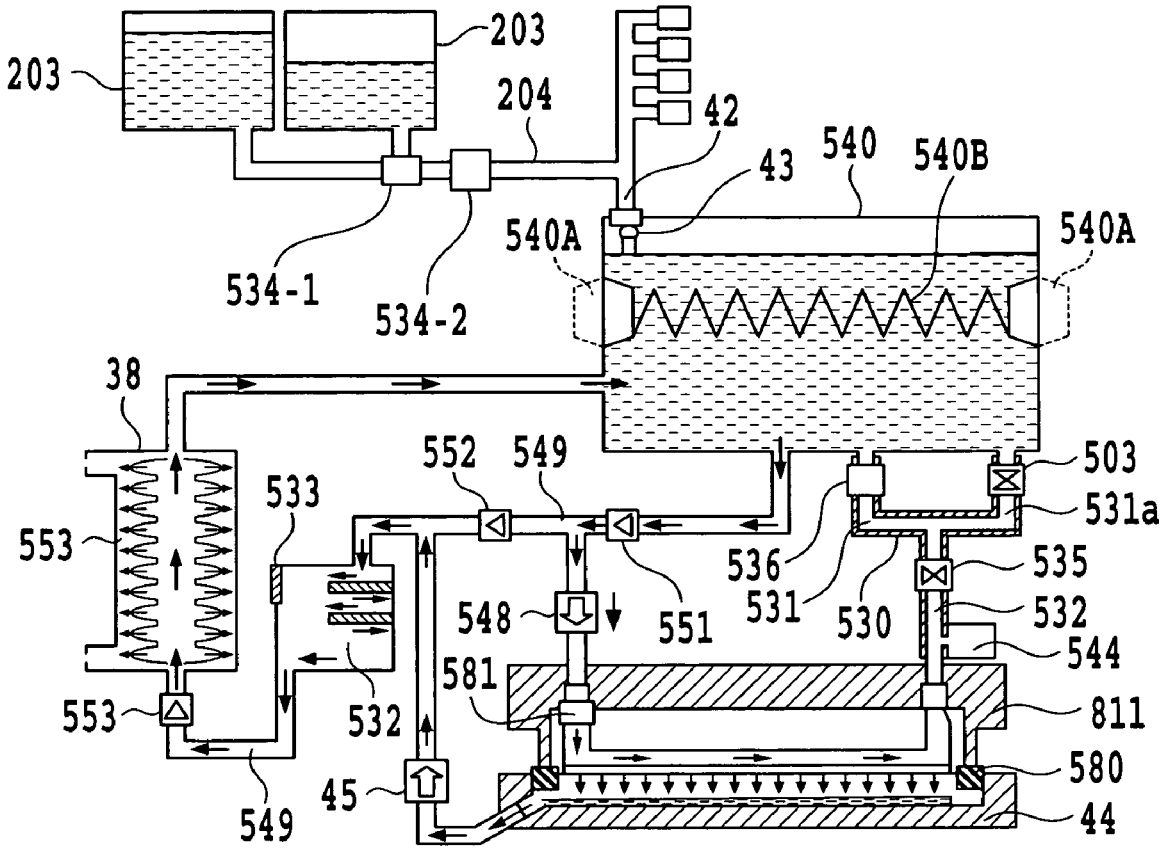
FIG. 33 is a schematic diagram showing a recovery operation of the ink system of FIG. 27 at time of shipping.

FIG. 31 to FIG. 33 show an operation of the ink supply device until the manufactured ink jet printing apparatus is shipped. First, as shown in FIG. 31, a pump 534-2 is operated to pour ink from the main tank 203 into the subtank 540 through joints 42, 43. At this time, valves 535, 503 are open. Although the pumps 536, 548 are at rest, ink can flow past them.

During the process of filling ink into the subtank 540, basically all ink paths and the interior of the print head 811 are filled with ink. At this point in time, there may be bubbles in many parts of the ink path.

With the ink filling from the main tank 205 into the subtank 540 complete, the elimination of bubbles from the ink path and the deaeration operation are performed.

That is, the pumps 536, 548, 45 are operated forwardly to circulate ink from the subtank 540 through the valve 503 and pump 536 into the valve 535, print head 811, pump 548, valve 552, bubble elimination chamber 532 and deaeration system 38 and back into the subtank 540. By circulating the ink in this manner, bubbles in ink are eliminated in the bubble elimination chamber 532 and the ink is deaerated by the deaeration system 38. In this operation, no performance problem arises if the pump 536 is not rotated. Although a small amount of ink is discharged into the ink receiver in the cap 44 because of the flow resistance of the filter 581 of the print head 811, the discharged ink is quickly collected by the pump 45 into the circulation path. Executing this operation continuously for a predetermined duration can remove bubbles and gases from the ink flow.

FIG. 33 shows a recovery operation of the print head 811 in a final step of preparing for the shipping.

The ink in the ink path is already deaerated by the time the recovery operation is started. In the recovery operation, the valve 535 is closed first and then the pumps 45, 548 are operated to move the ink in the direction of arrow in FIG. 33. The ink in the subtank 540 is drawn into the pump 548 through the one-way valve 551 and supplied to the print head 811. Since the valve 535 is closed, the ink in the print head 811 is rapidly pressurized, forcing out a relatively large amount of ink from the nozzles. As a result, the ink ejection performance of the nozzles are restored to normal. The ink discharged to the ink receiver in the cap 44 is quickly collected by the already running pump 45 to the bubble elimination chamber 532 for reuse.

Then, the pumps 548, 45 are stopped and the valve 535 is opened, after which the nozzle surface of the print head 811 (the surface in which nozzles are formed) is wiped with a wiper blade not shown. Then, ink not contributing to the image forming is ejected from the nozzles of the print head 811 into the cap 44. Now the recovery operation is complete.

During Installation

Figure 34:
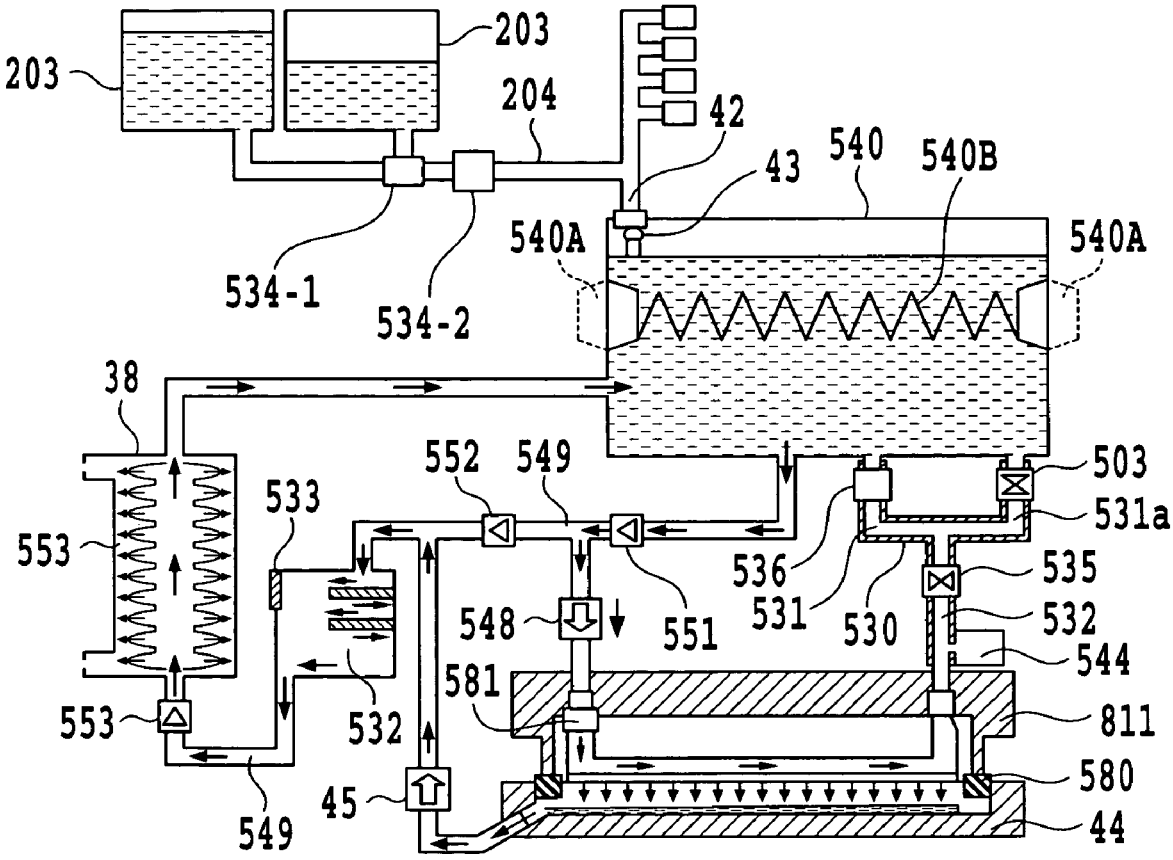
FIG. 34 is a schematic diagram showing a recovery operation of the ink system of FIG. 27 when the apparatus is installed.

After the printing apparatus is delivered to the user and before it begins to be used, the joints 42, 43 are coupled as shown in FIG. 31 and the recovery operation of the print head 811 is executed as shown in FIG. 34. The ink flow during this recovery operation is the same as during the recovery operation of FIG. 33 and the only difference is the operation time. So detailed explanations are omitted here. If a long period of time has passed after shipping, the bubble elimination and the deaeration operation such as described with reference to FIG. 32 may be performed. If the elapsed time is short, the recovery operation of FIG. 34 may be omitted. The decision on the length of elapsed time and the associated operation are performed by the CPU 800 executing the program stored in the ROM 803 in the printing apparatus.

During Standby for Printing

During a normal standby before starting the printing operation, a large negative pressure (about 20-150 mmAq lower than the atmospheric pressure) is maintained in the print head 811 to secure stability against environmental changes. In this state, when a print command is received, the print head 811 is moved from the capping position to the print position above the print medium 206 and at the same time the pressure set value is changed to reduce the negative pressure in the print head 811.

The CPU 800 reads an output of the pressure sensor 544 and performs a PWM (Pulse Width Modulation) control on the rotation direction and speed of the pump 536 to realize a feedback control with a relatively high response.

In connection with the control of the pump 536, the valve 503 is also controlled to realize a more responsive feedback control. In that case, it is preferable to use as the valve 503 a lightweight valve capable of high response.

Supply Control During Printing

Figure 36:
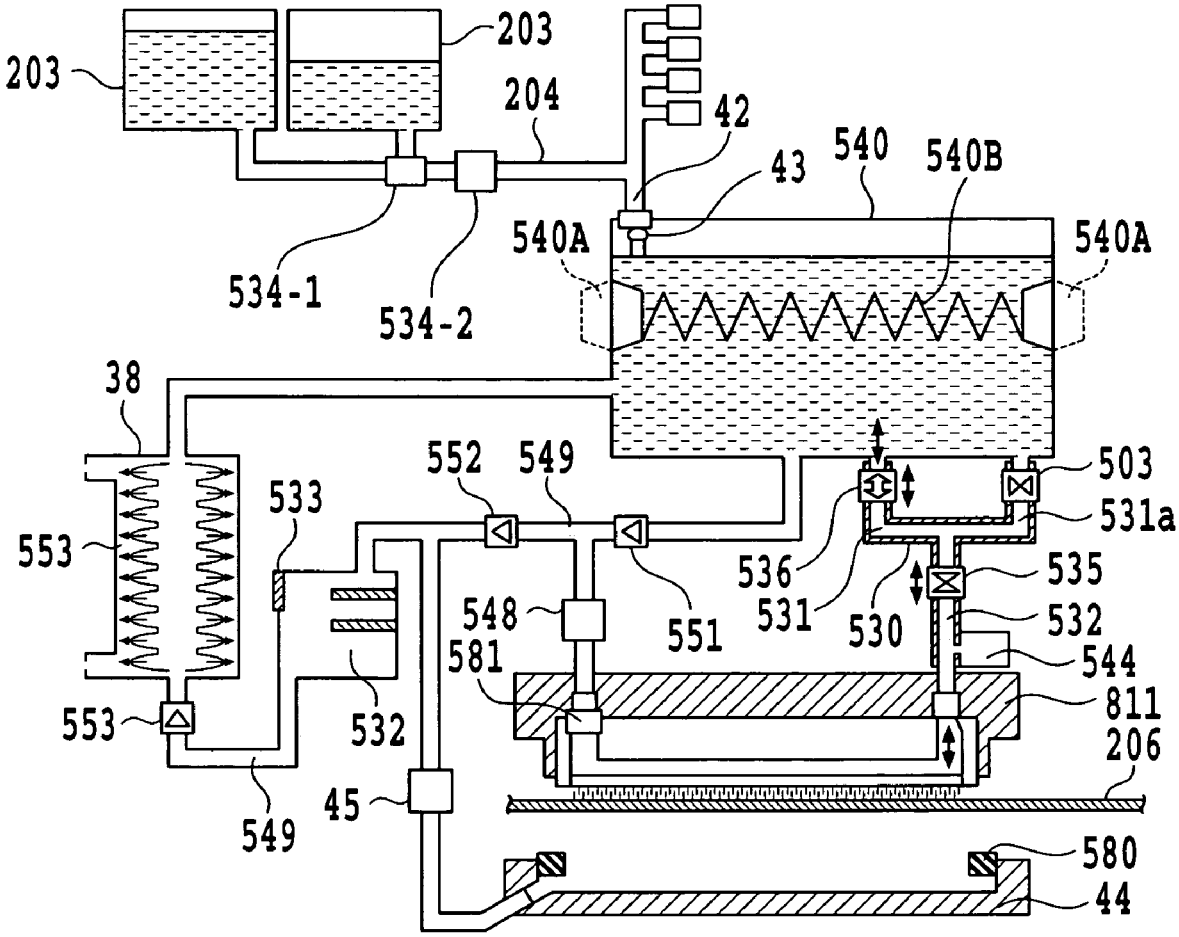
FIG. 36 is a schematic diagram showing an operation of the ink system of FIG. 27 during printing.

FIG. 36 shows a negative pressure control during the printing operation.

Figure 35:
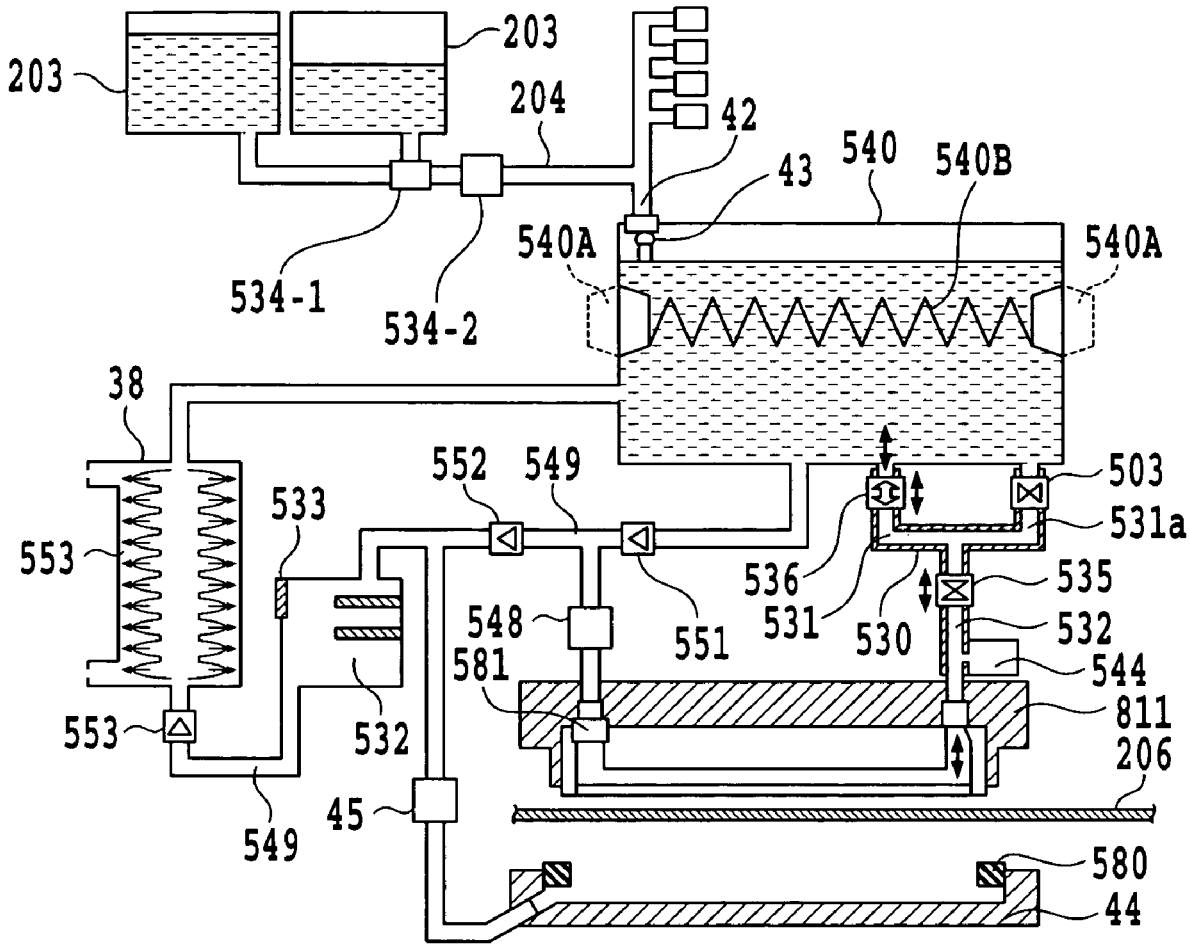
FIG. 35 is a schematic diagram showing an operation of the ink system of FIG. 27 during a standby for printing.

The negative pressure control during the printing operation is almost the same as during the standby of FIG. 35. The CPU 800 reads an output of the pressure sensor 544 and performs a PWM (Pulse Width Modulation) control on elements including the rotation direction of the pump 536 to realize a high responsiveness. In this embodiment, the valve 503 is closed and the ink path on the pump 548 side is also closed during the printing operation. As described above, controlling the valve 503 in connection with the control of the pump 536 can realize a feedback control with an improved response.

The control on the pump motor 508 (drive motor for the pump 536) using the output of the pressure sensor 544 as a feedback signal can be performed by using a pressure control system similar to that of the preceding embodiment shown in FIG. 23.

Third Embodiment

Figure 37A:
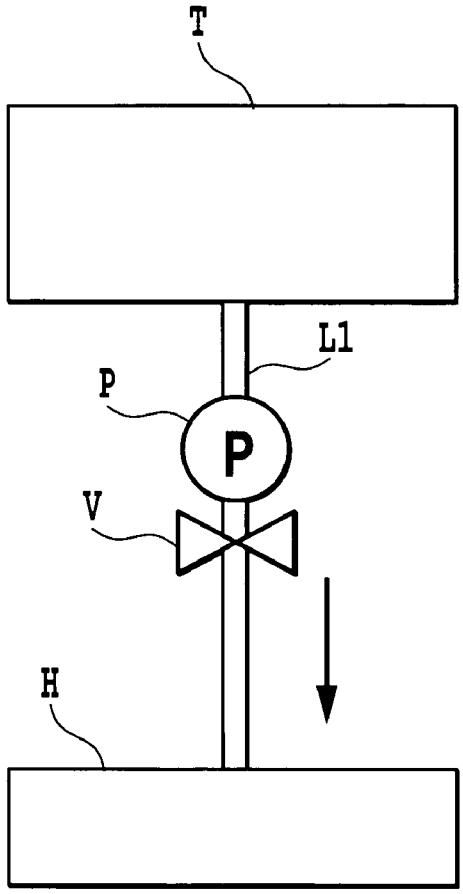
FIG. 37A illustrates an outline configuration of the ink system in the first and second embodiment of this invention.
Figure 37B:
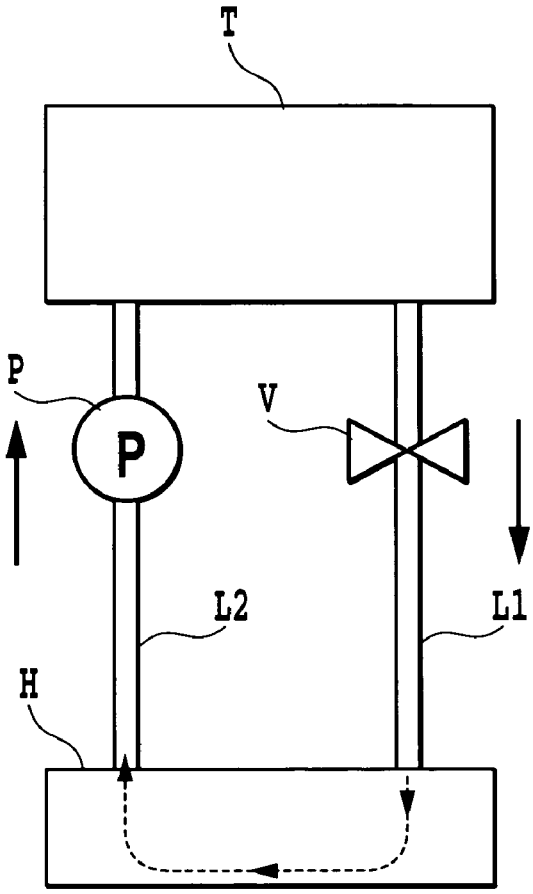
FIG. 37B illustrates an outline configuration of an ink system in a third embodiment of this invention.

FIG. 37A and FIG. 37B show ink systems of different configurations.

The ink system of FIG. 37A, as in the first and second embodiment, has a negative pressure application means including a pump P and a valve V in an ink supply path L1 running between an ink tank T and a print head H. The pump P and the valve V correspond to the mechanical pump 36 and the pressure adjust valve 35 in the first embodiment and to the pressure adjust pump 536 and the pressure adjust valve 535 in the second embodiment. The print head H corresponds to the print head 811 in the first and the second embodiment. The ink communication path L1 is equivalent to the ink path for supplying ink from the ink tank to the print head 811 in the first embodiment and to the ink path for supplying ink from the ink tank 540 to the print head 811, i.e., the ink supply path 530 including the circulation path 531 and the connecting path 532, in the second embodiment.

As described above, FIG. 37A shows a construction having the negative pressure application means including the pump P and the valve V in the ink supply path L1 connecting the ink tank T and the print head H. That is, FIG. 37A conceptually explains the construction common to the first and second embodiment. FIG. 37A therefore leaves out the deaeration system 38, the negative pressure chamber 30, the ink return path from the print head 811 to the ink tank 40, and the ink collecting path from the cap 44 in the first embodiment. Similarly, FIG. 37A omits the circulation path 531, the flow adjust valve 503, the ink return path from the print head 811 to the ink tank 40, the bubble elimination chamber 532, the deaeration system 38, and the ink collecting path from the cap 44 in the second embodiment.

Such an ink system shown in FIG. 37A applies a pressure (including negative and positive pressure) to the ink in the ink supply path L1 by the negative pressure application means including the pump P and the valve V, to apply a negative pressure to the interior of the print head H. The negative pressure application means may include at least one of the pump P and the valve V. This ink system can be constructed simple and compact since the ink supply path L1 can perform both the ink supply and the negative pressure application to the print head H.

FIG. 37B is a conceptual diagram showing the construction of an ink system that differs from FIG. 37A in the installed positions of the pump P and the valve V. In this example, the valve V is installed in the ink supply path L1 and the pump P in the return path L2 through which to return ink from the print head H to the ink tank T. The pump P applies a pressure (including negative and positive pressure) to the ink in the return path L2 to impress a negative pressure in the print head H. The valve V is controlled in connection with the control of the pump P to adjust the ink flow in the ink supply path L1, making it possible to apply a highly responsive, highly precise negative pressure to the print head H. The negative pressure application means may include at least one of the pump P and the valve V. The pump P may serve the function of the pump 48 in the first embodiment or the pump 548 in the second embodiment.

The negative pressure application means may be provided in the ink supply path L1 or the return path L2 or both. The only requirement is that the negative pressure application means be installed in the ink path communicating the ink tank to the print head and be able to apply an adjustable negative pressure to the print head.

Fourth Embodiment

Figure 38:
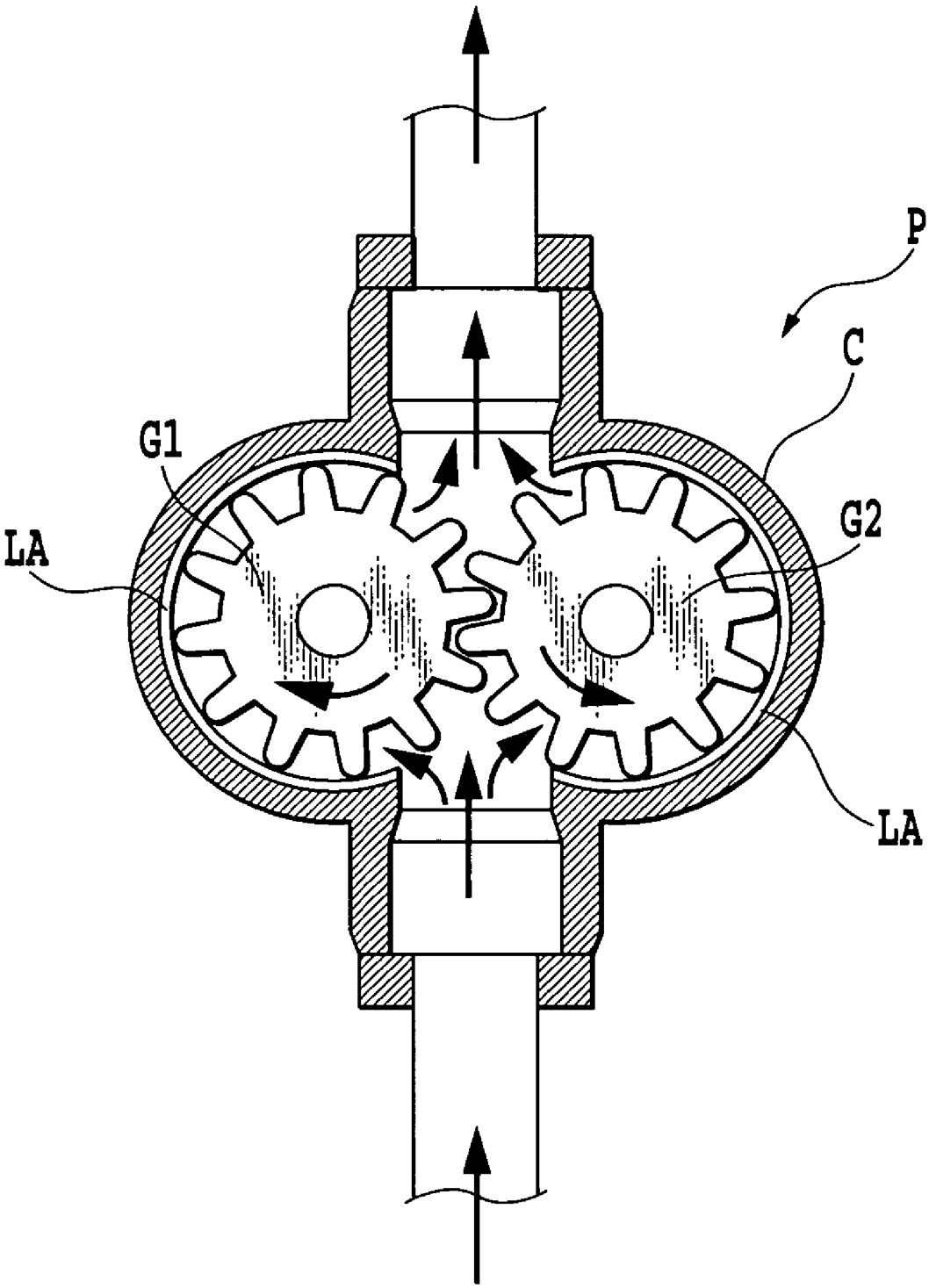
FIG. 38 is an outline cross-sectional view of a pump used in the third embodiment of this invention.

FIG. 38 is an outline cross-sectional view showing an example construction of the pump P of FIG. 37A and FIG. 37B.

The pump P in this example is a gear pump similar to the mechanical pump 36 of the first embodiment. However, it differs from the normal volume type gear pump in that it has a gap formed as an ink pass-through channel LA between tooth crests of the gears G1, G2 and an inner circumferential surface of the casing C. More specifically, the casing C has an enlarged diameter portion in its inner surface to form a gap between it and the tooth crests of the gears G1, G2. Thus, the ink can pass through the channel LA and therefore the pump P, and its flow changes according to the rotating speed of the gears G1, G2. When the gears G1, G2 rotate at high speed in the direction of arrow in FIG. 38, a strong force acts to deliver ink upstream, producing a large negative pressure on the downstream side. When the gears G1, G2 rotate at low speed in the direction of arrow, a force acting to deliver the ink upstream is weak, producing a small negative pressure on the downstream side. By controlling the rotating speed of the pump P, the negative pressure acting on the ink can be adjusted.

The provision of the ink pass-through channel and the control of the rotating speed can provide the pump P with characteristics of both a constant volume pump and a constant pressure pump. The pass-through channel may be formed to have a gap of about 10 μm to 1 mm between the gears and the casing.

The pass-through channel need only be formed at a position where it receives a delivery force that depends on the rotating speed of the gears, and may have a desired construction in addition to the one employed in this embodiment. For example, a part of the gear crest may be cut away to form a gap as the pass-through channel between the gear and the inner surface of the casing.

Fifth Embodiment

Figure 39:
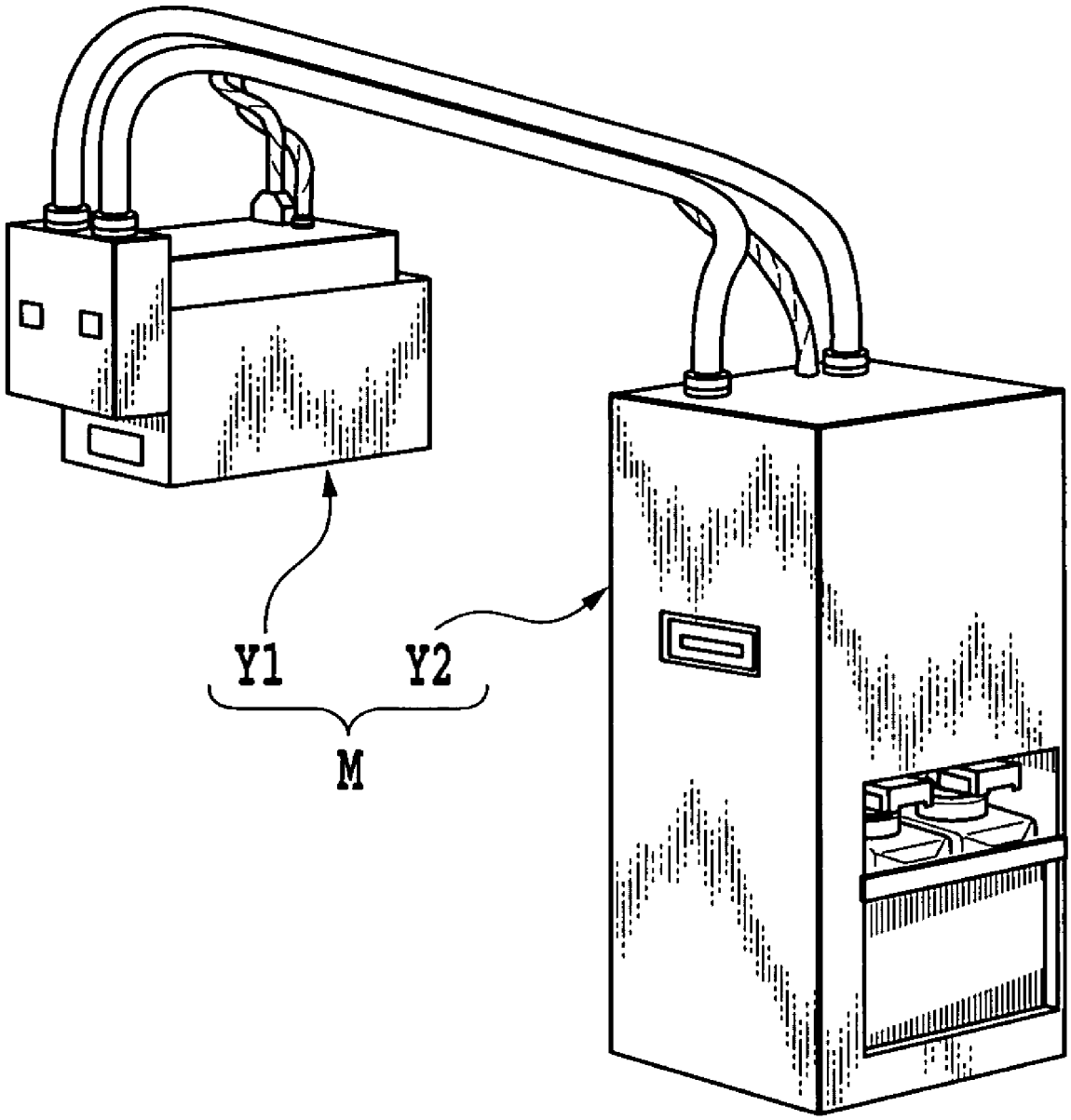
FIG. 39 is a perspective view of a print module as a fourth embodiment of this invention.

FIG. 39 is an explanatory diagram showing an example construction comprising modules of elements in the printer composite system shown in FIG. 1 and FIG. 2.

The printer composite system such as shown in FIG. 1 and FIG. 2 is suitably employed as an industrial printing machines that can print on large-size posters and cardboards. It can cope with large objects to be printed by adding printer units 116 (116-1 to 116-5). When the object to be printed is small, the number of printer units 116 in operation may be reduced without reducing the number of printer units 116 installed. Or the number of printer units 116 installed may be reduced. There may be a large difference in frequency of use among the printer units 116 according to their installed positions, so it is preferred that the printer units 116 be able to be repaired or replaced individually.

From this point of view, the printer units 116 in this example are constructed into print modules M, each of which comprises a print unit Y1 including a print head and an ink supply unit Y2 including an ink tank. A detailed construction of the print module M will be explained for the case of the printer unit 116 in the first and second embodiment.

The print unit Y1 incorporates four print heads 811 (811K, 811C, 811M, 811Y) in one printer unit 116 and a print head control circuit 810 (see FIG. 3) in the printer unit 116. The print unit Y1 also incorporates the control circuit board 60 of FIG. 9, i.e., the control system of FIG. 3 for each printer unit 116. It is also possible to construct the print unit Y1 to include the cap 44, a mechanism for capping the print heads with the cap 44, and a control unit to control the mechanism.

The ink supply unit Y2 incorporates an ink system for each printer unit 116, i.e., the ink system of FIG. 9 in the first embodiment or the ink system of FIG. 27 in the second embodiment. The main ink tank commonly connected with a plurality of printer units 116 can be connected commonly with a plurality of ink supply units Y2. The main ink tank may be provided for at least one ink supply unit Y2. Further, the ink supply unit Y2 may incorporate a power supply circuit for each printer unit 116. The pressure sensor 49 of the first embodiment and the pressure sensor 544 of the second embodiment are preferably built, near the print heads 811, into the print unit Y1 along with the print heads 811 for the purpose of detecting the inner pressure with high precision. It is also possible to incorporate these pressure sensors into the ink supply unit Y2.

These units Y1 and Y2 are connected by wires including signal lines and power supply wires and also by pipes forming the ink path, and combine to form the print module M. As described above, by building a mechanism for each printer unit 116 (including a control system and an ink system) into a module, independence of individual printer units 116 can be more clearly secured, allowing the mounting, dismounting, replacement and repairing to be performed for each printer unit 116. This is very advantageous when the printer composite system such as shown in FIG. 1 and FIG. 2 is applied as an industrial printing machine.

It is noted, however, that the units Y1, Y2 do not have to be handled as a printer module M but may be used as separate units. In that case, the units Y1, Y2 need only be constructed such that they can be connected to or disconnected from each other. This arrangement allows for individual mounting, dismounting, replacement and repair, which proves more advantageous when the printer composite system such as shown in FIG. 1 and FIG. 2 is used as an industrial printing machine.

(Other Features)

A plurality of printer units adopted in this embodiment are independent of one another. That is, the printer units are independent of one another in terms of space (arrangement) and also in terms of a signal system and an ink system. Therefore, according to the operational state of each printer unit, i.e., the amount of data being printed, a supply of an appropriate volume of ink and an appropriate recovery operation can be realized. The printer units can also be controlled under various conditions separately from an image forming system and an image forming device, and independently of other printer units. It is also possible to trade or handle single printer units.

It is noted that this invention is not limited to the embodiments described above and that modifications may be made as required within the spirit of this invention.

For example, ink may be supplied to one or more print heads used in one printer unit. The printer units are not limited to any particular printing system or type, and may for example be of a full line type which prints without moving the print heads or of a serial scan type which prints by moving the print heads in a main scan direction. The only requirement of this invention is an ability to stabilize the negative pressure of ink supplied to the print head by positively controlling the ink negative pressure using pumps and valves.

This application claims the benefit of Japanese Patent Application Nos. 2004-163730 and 2004-163731 both filed on Jun. 1, 2004, which are hereby incorporated by reference herein in their entirety.

The invention claimed is:

1. An ink supply device for supplying ink from an ink tank to a print head, the ink supply device comprising:

detection means for detecting an ink pressure in the print head;

pressure application means for selectively applying a negative pressure or a positive pressure to an interior of the print head, the pressure application means being installed in an ink supply path for supplying ink from an interior of the ink tank to the interior of the print head;

predetermined negative pressure application means installed in the ink supply path to apply a predetermined negative pressure to the print head; and control means for controlling the pressure application means based on the ink pressure detected by the detection means to adjust the pressure applied to the interior of the print head;

wherein the detection means is installed near the print head to detect the ink pressure in the print head without a pressure loss and, along with the print head, forms a print unit, wherein the pressure application means applies the negative pressure to the interior of the print head by a delivery force acting on the ink in the ink supply path in a direction from the print head toward the ink tank, and applies the positive pressure to the interior of the print head by a delivery force acting on the ink in the ink supply path in a direction from the ink tank toward the print head, and wherein the control means controls the pressure application means based on the ink pressure detected by the detection means in a way that selects the negative pressure or the positive pressure as the pressure applied to the interior of the print head, and controls the selected negative pressure or positive pressure so as to maintain the ink pressure in the print head within a predetermined negative pressure range during a printing operation in which the print head applies ink supplied thereinto onto a print medium to print an image.

2. An ink supply device according to claim 1, wherein the ink supply path is an ink supply path to supply ink from the ink tank to the print head.

3. An ink supply device according to claim 1, wherein the detection means is installed in a first straight portion of the ink supply path.

4. An ink supply device according to claim 1, wherein the control means controls the pressure application means based on the ink pressure detected by the detection means and an ink consumption per unit time of the print head.

5. An ink supply device according to claim 1, wherein the control means controls the pressure application means based on the ink pressure detected by the detection means and a print duty of an image being printed using the print head.

6. An ink supply device according to claim 1, wherein the pressure application means includes a pump and a valve installed in the ink supply path and the control means controls the pump and the valve in connection with each other.

7. An ink supply device according to claim 6, wherein the pump includes a rotation element and applies the negative pressure to the interior of the print head by rotating the rotation element in one direction and applies the positive pressure to the interior of the print head by rotating the rotation element in the other direction.

8. An ink supply device according to claim 6, wherein the pump is a gear pump having an ink pass-through channel formed at a position where it receives a delivery force corresponding to a rotation speed of the gear.

9. An ink supply device according to claim 6, wherein the ink supply path includes a circulation path through which the ink can be circulated and a connecting path communicating the circulation path with the print head;

wherein the pump is installed in the circulation path; and wherein the valve is installed in at least one of the circulation path and the connecting path.

10. An ink supply device according to claim 9, wherein the valve is installed in the circulation path and is constructed to adjust a flow resistance of the ink.

11. An ink supply device according to claim 6, wherein the control means closes the valve immediately after a printing operation using the print head is ended.

12. An ink supply device according to claim 6, wherein the control means controls the pump and the valve according to a state of use of a printing apparatus which is operable to perform a printing operation using the print head.

13. An ink supply device according to claim 1, wherein the predetermined negative pressure application means has a negative pressure chamber communicating with the ink supply path and a movable member formed in at least a part of the negative pressure chamber and urged outwardly by a predetermined biasing force.

14. An ink supply device according to claim 1, wherein the print head is used in a composite print system comprising a plurality of printing apparatus.

15. An ink supply device according to claim 1, wherein the print head is an ink jet print head constructed to eject ink.

16. An ink supply device for supplying ink from an ink tank to a print head, the ink supply device comprising:

detection means for detecting an ink pressure in the print head;

pressure application means for selectively applying a negative pressure or a positive pressure to an interior of the print head, the pressure application means being installed in an ink supply path for supplying ink from an interior of the ink tank to the interior of the print head;

predetermined negative pressure application means installed in the ink supply path to apply a predetermined negative pressure to the print head; and control means for controlling the pressure application means based on the ink pressure detected by the detection means to adjust the pressure applied to the interior of the print head;

wherein the pressure application means includes a pump constructed to adjustably pressurize and depressurize an interior of the ink supply path and a valve installed in the ink supply path between the print head and the pump, wherein the pump pressurizes the interior of the ink supply path by a delivery force acting on the ink in the ink supply path in a direction from the print head toward the ink tank, and depressurizes the interior of the ink supply path by a delivery force acting on the ink in the ink supply path in a direction from the ink tank toward the print head, and wherein the control means controls the pump and the valve based on the ink pressure detected by the detection means in a way that selects the negative pressure or the positive pressure as the pressure applied to the interior of the print head, and controls the selected negative pressure or positive pressure so as to maintain the ink pressure in the print head within a predetermined negative pressure range during a printing operation in which the print head applies ink supplied thereinto onto a print medium to print an image.

17. An ink supply device for supplying ink from an ink tank to a print head, the ink supply device comprising:

detection means for detecting an ink pressure in the print head;

pressure application means for selectively applying a negative pressure or a positive pressure to an interior of the print head, the pressure application means being installed in an ink supply path for supplying ink from an interior of the ink tank to the interior of the print head;

predetermined negative pressure application means installed in the ink supply path to apply a predetermined negative pressure to the print head; and control means for controlling the pressure application means based on the ink pressure detected by the detection means to adjust the pressure applied to the interior of the print head, wherein the pressure application means applies the negative pressure to the interior of the print head by a delivery force acting on the ink in the ink supply path in a direction from the print head towards the ink tank, and applies the positive pressure to the interior of the print head by a delivery force acting on the ink in the ink supply path in a direction from the ink tank toward the print head, and wherein the control means controls the pressure application means based on the ink pressure detected by the detection means in a way that selects the negative pressure or the positive pressure as the pressure applied to the interior of the print head, and controls the selected negative pressure or positive pressure so as to maintain the ink pressure in the print head within a predetermined negative pressure range during a printing operation in which the print head applies ink supplied thereinto onto a print medium to print an image.

18. A printing apparatus capable of printing an image using a print head supplied with ink, the printing apparatus having the ink supply device claimed in any one of claims 1, 2, 3, 4 to 12, 13 to 15, 16 and 17.

19. An ink supply method for supplying ink from an ink tank to a print head, comprising the steps of:

using a pressure application means for selectively applying a negative pressure or a positive pressure to an interior of the print head, the pressure application means being installed in an ink supply path for supplying ink from an interior of the ink tank to the interior of the print head, the pressure application means applying the negative pressure to the interior of the print head by a delivery force acting on the ink in the ink supply path in a direction from the print head toward the ink tank, and applying the positive pressure to the interior of the print head by a delivery force acting on the ink in the ink supply path in a direction from the ink tank toward the print head;

using a detection means installed near the print head to detect an ink pressure in the print head without a pressure loss, the detection means forming a print unit along with the print head;

using predetermined negative pressure application means installed in the ink supply path to apply a predetermined negative pressure to the print head;

controlling the pressure application means based on the ink pressure detected by the detection means in a way that selects the negative pressure or the positive pressure as the pressure applied to the interior of the print head; and controlling the selected negative pressure or positive pressure so as to maintain the ink pressure in the print head within a predetermined negative pressure range during a printing operation in which the print head applies ink supplied thereinto onto a print medium to print an image.

20. A printing method for printing an image using a print head supplied with ink from an ink tank, comprising the steps of:

using pressure application means for selectively applying a negative pressure or a positive pressure to an interior of the print head, the pressure application means being installed in an ink supply path for supplying ink an interior of the ink tank to the interior of the print head, the pressure application means applying the negative pressure to the interior of the print head by a delivery force acting on the ink in the ink supply path in a direction from the print head toward the ink tank, and applying the positive pressure to the interior of the print head by a delivery force acting on the ink in the ink supply path in a direction from the ink tank toward the print head;

using detection means installed near the print head to detect an ink pressure in the print head without a pressure loss, the detection means forming a print unit along with the print head;

using predetermined negative pressure application means installed in the ink supply path to apply a predetermined negative pressure to the print head;

controlling the pressure application means based on the ink pressure detected by the detection means in a way that selects the negative pressure or the positive pressure ad the pressure applied to the interior of the print head; and controlling the selected negative pressure or positive pressure so as to maintain the ink pressure in the print head within a predetermined negative pressure range during a printing operation in which the print head applies ink supplied thereinto onto a print medium to a print image.

* * * * *